US011854565B2

(12) United States Patent
Fan et al.

(10) Patent No.: US 11,854,565 B2
(45) Date of Patent: Dec. 26, 2023

(54) WRIST WEARABLE APPARATUSES AND METHODS WITH DESIRED SIGNAL EXTRACTION

(71) Applicant: SOLOS TECHNOLOGY LIMITED, Hong Kong (HK)

(72) Inventors: Dashen Fan, Bellevue, WA (US); Xi Chen, San Jose, CA (US); Hua Bao, Santa Clara, CA (US); Eric Frederic Davis, San Francisco, CA (US)

(73) Assignee: SOLOS TECHNOLOGY LIMITED, Hong Kong (HK)

( * ) Notice: Subject to any disclaimer, the term of this patent is extended or adjusted under 35 U.S.C. 154(b) by 0 days.

(21) Appl. No.: 14/886,054

(22) Filed: Oct. 18, 2015

(65) Prior Publication Data

US 2016/0140949 A1 May 19, 2016

Related U.S. Application Data

(63) Continuation-in-part of application No. 14/207,163, filed on Mar. 12, 2014, now Pat. No. 9,633,670.

(60) Provisional application No. 61/941,088, filed on Feb. 18, 2014, provisional application No. 61/780,108, filed on Mar. 13, 2013.

(51) Int. Cl.

| | |
|---|---|
| ***G10K 11/178*** | (2006.01) |
| ***H04R 29/00*** | (2006.01) |
| ***G10L 21/0208*** | (2013.01) |
| *G10L 21/0216* | (2013.01) |
| *G10L 25/78* | (2013.01) |

(52) U.S. Cl.

CPC ..... *G10L 21/0208* (2013.01); *H04R 29/004* (2013.01); *G10K 2210/108* (2013.01); *G10K 2210/117* (2013.01); *G10K 2210/3023* (2013.01); *G10L 25/78* (2013.01); *G10L 2021/02165* (2013.01); *G10L 2021/02166* (2013.01); *H04R 2203/12* (2013.01)

(58) Field of Classification Search

CPC ..... H04R 29/004; H04R 2203/12; G10K 11/178; G10K 2210/108; G10K 2210/117; G10K 2210/3023; G10L 21/0208; G10L 25/78; G10L 2021/02165; G10L 2021/02166

See application file for complete search history.

(56) References Cited

U.S. PATENT DOCUMENTS

| | | | | |
|---|---|---|---|---|
| 9,432,768 | B1 * | 8/2016 | O'Neill | H04R 3/005 |
| 2012/0051548 | A1 * | 3/2012 | Visser | G10L 21/0208 381/56 |
| 2014/0301558 | A1 * | 10/2014 | Fan | G10L 21/0208 381/71.2 |

* cited by examiner

*Primary Examiner* — Mark Fischer

(74) *Attorney, Agent, or Firm* — Caldwell Intellectual Property Law, LLC

(57) ABSTRACT

Systems and methods are described to extract desired audio from an apparatus to be worn on a user's wrist. The apparatus includes a wrist wearable device, configured to be worn on the user's wrist. The wrist wearable device includes a first microphone. The first microphone has a first response pattern. The first microphone is coupled to the wrist wearable device. The first microphone is positioned on the wrist wearable device to receive a voice signal from a user when the wrist wearable device is on the user's wrist.

32 Claims, 30 Drawing Sheets

600

1893

1894

| 1895a | 1895b | 1895c | 1895d | 1895e |
|---|---|---|---|---|
| X | Y=X | $Y=Log_{10}(X)$ | Y=ln(X) | $Y=Log_2(X)$ |
| 0.01 | 0.01 | -2 | -4.60 | -6.64 |
| 0.10 | 0.10 | -1 | -2.30 | -3.32 |
| 1.00 | 1.00 | 0 | 0 | 0 |
| 10.00 | 10.00 | 1 | 2.30 | 3.32 |
| 100.0 | 100.0 | 2 | 4.60 | 6.64 |
| 1000.0 | 1000.0 | 3 | 6.90 | 9.96 |

1896

FIGURE 18E

WRIST WEARABLE APPARATUSES AND METHODS WITH DESIRED SIGNAL EXTRACTION

RELATED APPLICATIONS

This patent application is a continuation-in-part of United States Non-Provisional Patent Application titled "Dual Stage Noise Reduction Architecture For Desired Signal Extraction," filed on Mar. 12, 2014, Ser. No. 14/207,163 which claims priority from United States Provisional Patent Application titled "Noise Canceling Microphone Apparatus," filed on Mar. 13, 2013, Ser. No. 61/780,108 and from United States Provisional Patent Application titled "Systems and Methods for Processing Acoustic Signals," filed on Feb. 18, 2014, Ser. No. 61/941,088.

U.S. Provisional Patent Application Ser. No. 61/780,108 is hereby incorporated by reference. U.S. Provisional Patent Application Ser. No. 61/941,088 is hereby incorporated by reference. U.S. Non-Provisional patent application Ser. No. 14/207,163 is hereby incorporated by reference.

BACKGROUND OF THE INVENTION

1. Field of Invention

The invention relates generally to wrist wearable devices which detect and processing acoustic signal data and more specifically to reducing noise in wrist wearable acoustic systems.

2. Art Background

Acoustic systems employ acoustic sensors such as microphones to receive audio signals. Often, these systems are used in real world environments which present desired audio and undesired audio (also referred to as noise) to a receiving microphone simultaneously. Such receiving microphones are part of a variety of systems such as a mobile phone, a handheld microphone, a hearing aid, etc. These systems often perform speech recognition processing on the received acoustic signals. Simultaneous reception of desired audio and undesired audio have a negative impact on the quality of the desired audio. Degradation of the quality of the desired audio can result in desired audio which is output to a user and is hard for the user to understand. Degraded desired audio used by an algorithm such as in speech recognition (SR) or Automatic Speech Recognition (ASR) can result in an increased error rate which can render the reconstructed speech hard to understand. Either of which presents a problem.

Handheld systems require a user's fingers to grip and/or operate the device in which the handheld system is implemented. Such as a mobile phone for example. Occupying a user's fingers can prevent the user from performing mission critical functions. This can present a problem.

Undesired audio (noise) can originate from a variety of sources, which are not the source of the desired audio. Thus, the sources of undesired audio are statistically uncorrelated with the desired audio. The sources can be of a non-stationary origin or from a stationary origin. Stationary applies to time and space where amplitude, frequency, and direction of an acoustic signal do not vary appreciably. For, example, in an automobile environment engine noise at constant speed is stationary as is road noise or wind noise, etc. In the case of a non-stationary signal, noise amplitude, frequency distribution, and direction of the acoustic signal vary as a function of time and or space. Non-stationary noise originates for example, from a car stereo, noise from a transient such as a bump, door opening or closing, conversation in the background such as chit chat in a back seat of a vehicle, etc. Stationary and non-stationary sources of undesired audio exist in office environments, concert halls, football stadiums, airplane cabins, everywhere that a user will go with an acoustic system (e.g., mobile phone, tablet computer etc. equipped with a microphone, a headset, an ear bud microphone, etc.) At times the environment the acoustic system is used in is reverberant, thereby causing the noise to reverberate within the environment, with multiple paths of undesired audio arriving at the microphone location. Either source of noise, i.e., non-stationary or stationary undesired audio, increases the error rate of speech recognition algorithms such as SR or ASR or can simply make it difficult for a system to output desired audio to a user which can be understood. All of this can present a problem.

Various noise cancellation approaches have been employed to reduce noise from stationary and non-stationary sources. Existing noise cancellation approaches work better in environments where the magnitude of the noise is less than the magnitude of the desired audio, e.g., in relatively low noise environments. Spectral subtraction is used to reduce noise in speech recognition algorithms and in various acoustic systems such as in hearing aids. Systems employing Spectral Subtraction do not produce acceptable error rates when used in Automatic Speech Recognition (ASR) applications when a magnitude of the undesired audio becomes large. This can present a problem.

In addition, existing algorithms, such as Spectral Subtraction, etc., employ non-linear treatment of an acoustic signal. Non-linear treatment of an acoustic signal results in an output that is not proportionally related to the input. Speech Recognition (SR) algorithms are developed using voice signals recorded in a quiet environment without noise. Thus, speech recognition algorithms (developed in a quiet environment without noise) produce a high error rate when non-linear distortion is introduced in the speech process through non-linear signal processing. Non-linear treatment of acoustic signals can result in non-linear distortion of the desired audio which disrupts feature extraction which is necessary for speech recognition, this results in a high error rate. All of which can present a problem.

Various methods have been used to try to suppress or remove undesired audio from acoustic systems, such as in Speech Recognition (SR) or Automatic Speech Recognition (ASR) applications for example. One approach is known as a Voice Activity Detector (VAD). A VAD attempts to detect when desired speech is present and when undesired speech is present. Thereby, only accepting desired speech and treating as noise by not transmitting the undesired speech. Traditional voice activity detection only works well for a single sound source or a stationary noise (undesired audio) whose magnitude is small relative to the magnitude of the desired audio. Therefore, traditional voice activity detection renders a VAD a poor performer in a noisy environment. Additionally, using a VAD to remove undesired audio does not work well when the desired audio and the undesired audio are arriving simultaneously at a receive microphone. This can present a problem.

Acoustic systems used in noisy environments with a single microphone present a problem in that desired audio and undesired audio are received simultaneously on a single channel. Undesired audio can make the desired audio unintelligible to either a human user or to an algorithm designed to use received speech such as a Speech Recognition (SR) or an Automatic Speech Recognition (ASR) algorithm. This can present a problem. Multiple channels have been employed to address the problem of the simultaneous reception of desired and undesired audio. Thus, on one channel, desired audio and undesired audio are received and on the other channel an acoustic signal is received which also contains undesired audio and desired audio. Over time the sensitivity of the individual channels can drift which results in the undesired audio becoming unbalanced between the channels. Drifting channel sensitivities can lead to inaccurate removal of undesired audio from desired audio. Nonlinear distortion of the original desired audio signal can result from processing acoustic signals obtained from channels whose sensitivities drift over time. This can present a problem.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements.

FIG. 18E illustrates different functions to provide compression according to embodiments of the invention.

DETAILED DESCRIPTION

In the following detailed description of embodiments of the invention, reference is made to the accompanying drawings in which like references indicate similar elements, and in which is shown by way of illustration, specific embodiments in which the invention may be practiced. These embodiments are described in sufficient detail to enable those of skill in the art to practice the invention. In other instances, well-known circuits, structures, and techniques have not been shown in detail in order not to obscure the understanding of this description. The following detailed description is, therefore, not to be taken in a limiting sense, and the scope of the invention is defined only by the appended claims.

Apparatuses and methods are described for detecting and processing acoustic signals containing both desired audio and undesired audio within a wrist wearable device. In one or more embodiments, noise cancellation architectures combine multi-channel noise cancellation and single channel noise cancellation to extract desired audio from undesired audio. In one or more embodiments, multi-channel acoustic signal compression is used for desired voice activity detection. In one or more embodiments, acoustic channels are auto-balanced.

Figure 1:
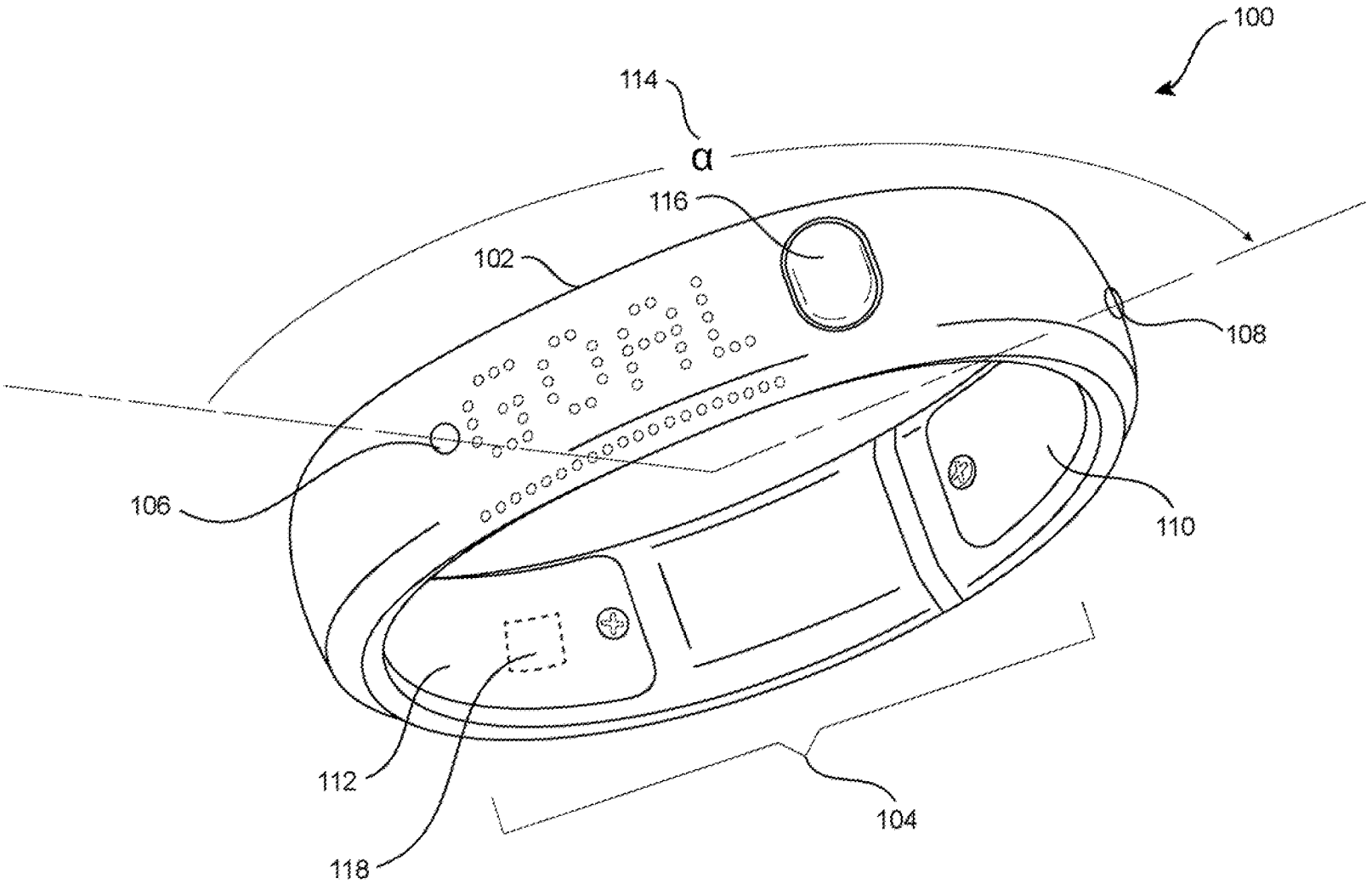
FIG. 1 illustrates a wrist wearable device, according to embodiments of the invention.

FIG. 1 illustrates, generally at 100, a wrist wearable device, according to embodiments of the invention. With reference to FIG. 1, a wrist wearable device 102 is configured to enclose a space 104, through which a user's hand is inserted while wearing. An illustration of a user wearing a wrist wearable device is shown below in conjunction with FIG. 4. Referring back to FIG. 1, the wrist wearable device 102 has a first microphone 106 which is positioned on the wrist wearable device 102 to receive voice signals from a user (desired audio) as well as noise (undesired audio) when the wrist wearable device 102 is worn on a user's wrist. In various embodiments, the first microphone faces outward toward a user when the wrist wearable device 102 is in a receive orientation relative to a user. A receive orientation is illustrated below in conjunction with FIG. 4.

Referring back to FIG. 1, a second microphone 108 is mounted on the wrist wearable device 102. In various embodiments the second microphone 108 is located in various places on the wrist wearable device 102 such as rotated around the circumference of the wrist wearable device 102 by an angle alpha (α) 114 or in other embodiments substantially co-located with the first microphone 106. In operation, the first microphone 106 receives desired audio and undesired audio and is referred to herein as a "primary" or "main" channel as described further below in conjunction with FIG. 11. The second microphone forms a second channel referred to herein and below as a reference channel and receives desired audio and undesired audio. In various embodiments there can be multiple reference channels or multiple main channels.

The wrist wearable device 102 has an internal volume, defined by its structure, within which electronics 118 are mounted. In one or more embodiments, an access panel such as 112 and/or 110 is provided to access the electronics 118. In other embodiments no access door is provided explicitly but the electronics 118 are contained within the volume of the wrist wearable device 102. In such cases, the electronics 118 can be inserted prior to assembly of a wrist wearable device where one or more parts interlock together thereby forming a housing which captures the electronics 118 therein. In yet other embodiments, a wrist wearable device is molded around electronics 118 thereby encapsulating the electronics 118 within the volume of the wrist wearable device 102. In various non-limiting embodiments, electronics 118 include an adaptive noise cancellation unit, a single channel noise cancellation unit, a filter control, a power supply, a desired voice activity detector, a filter, etc. Other components of electronics 118 are described below in the figures that follow.

The wrist wearable device 102 can include a switch 116 which is used to power up or down the wrist wearable device 102. The wrist wearable device 102 can contain a data processing system within its volume for processing acoustic signals which are received by the microphones associated therewith, such as the first microphone 106 and the second microphone 108. The data processing system can contain one or more of the elements of the system illustrated in FIG. 21 described further below.

The wrist wearable device 102 can be referred to as a wristband. Alternatively, a wrist wearable device which incorporates embodiments of the invention can be created in the form of a watch (FIG. 2) or a bracelet (FIG. 3) as described below. All other form factors of a wrist wearable device are within the teachings of embodiments of the invention disclosed herein. As such, embodiments of the invention are not limited to devices which would be described as a wristband, a watch or a bracelet but extend to all wrist wearable devices both existing today and to those wrist wearable devices which have not yet been named or invented.

Figure 2:
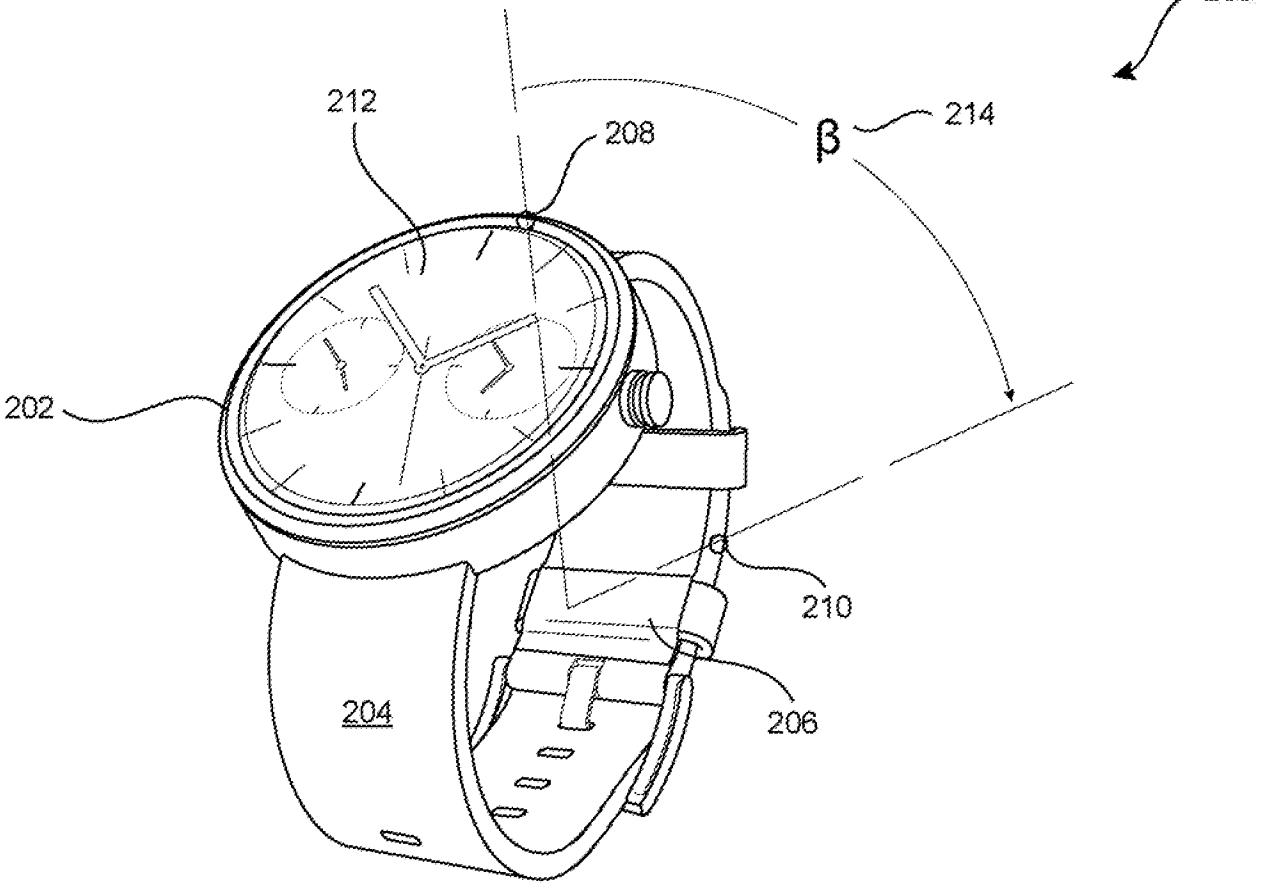
FIG. 2 illustrates a wrist wearable device in the form of a watch, according to embodiments to the invention.

FIG. 2 illustrates, generally at 200, a wrist wearable device in the form of a watch, according to embodiments to the invention. With reference to FIG. 2, a wrist wearable device 202 has a curved member 204 (referred to at times as a band or a strap) which defines an opening 206 through which a user's hand would be inserted in order to wear the wrist wearable device 202 on the user's wrist or arm. The wrist wearable device 202 can provide clock functionality and contain a data screen 212 on which data such as time is displayed.

The wrist wearable device 202 has a first microphone 208 positioned thereon and receives both desired audio and undesired audio (as described above in conjunction with FIG. 1). In various embodiments, the first microphone 208 is positioned to face outward. Facing outward provides a substantially direct path from a user's mouth to the first microphone 208. In various embodiments, the first microphone 208 is a main microphone. A signal from the first microphone is input into an acoustic signal processing system such as a noise cancellation system. The signal can be input directly into a noise cancellation system. The signal can be input into a beamformer or an adaptive noise cancellation unit as described more fully below in conjunction with the figures that follow.

A second microphone 210 is mounted on the wrist wearable device 202 and receives both desired audio and undesired audio (as described above in conjunction with FIG. 1). In various embodiments the second microphone 210 is located in various places on the wrist wearable device 202 such as rotated around the circumference of the wrist wearable device 102 by an angle beta (β) 214 or in other embodiments substantially co-located with the first microphone 208. In operation, the first microphone 208 receives desired audio and undesired audio and is referred to herein as a "primary" or "main" channel as described further below in conjunction with FIG. 11. The second microphone forms a second channel referred to herein and below as a reference channel. In various embodiments there can be multiple reference channels or multiple main channels.

Figure 3:
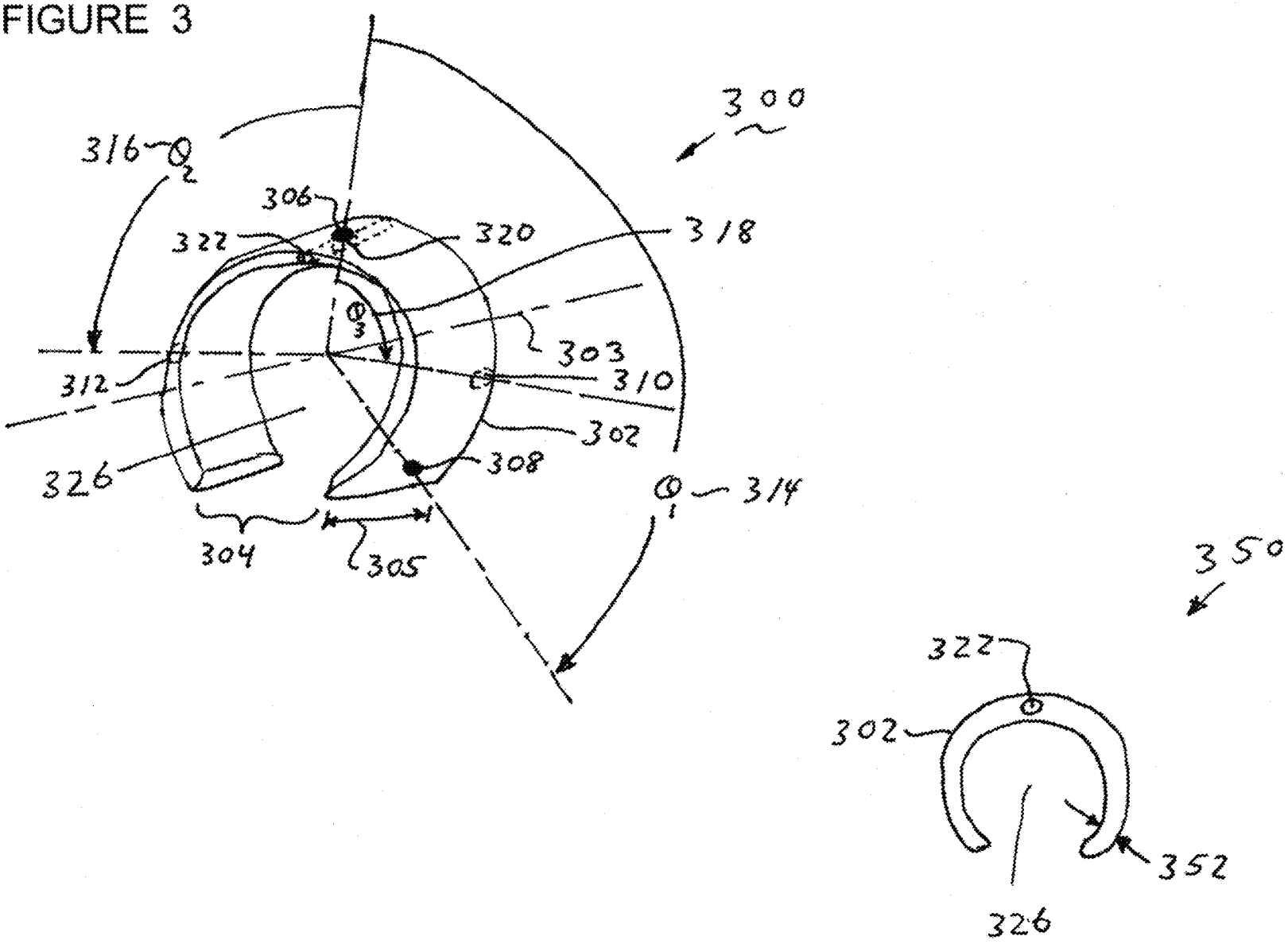
FIG. 3 illustrates a wrist wearable device in the form of a bracelet, according to embodiments to the invention.

FIG. 3 illustrates, generally at 300 and in an end view in 350, a wrist wearable device in the form of a bracelet, according to embodiments to the invention. With reference to FIG. 3, a wrist wearable device 302 has a curved shape around an axis 303 defining an opening 326 with a gap 304, a width 305 and a thickness 352. The shape illustrated in FIG. 3 is provided for illustration only and does not limit embodiments of the invention in any way.

The wrist wearable device 302 has a first microphone 306 positioned thereon and receives both desired audio and undesired audio (as described above in conjunction with FIG. 1). In various embodiments, the first microphone 306 is positioned to face outward. Facing outward provides a substantially direct path from a user's mouth to the first microphone 306. In various embodiments, the first microphone 306 is a main microphone. A signal from the first microphone 306 is input into an acoustic signal processing system such as a noise cancellation system. The signal can be input directly into a noise cancellation system. The signal can be input into a beamformer or an adaptive noise cancellation unit as described more fully below in conjunction with the figures that follow.

A second microphone 308 is mounted on the wrist wearable device 302 and receives both desired audio and undesired audio (as described above in conjunction with FIG. 1). In various embodiments the second microphone 308 is located in various places on the wrist wearable device 302 such as rotated around the circumference of the wrist wearable device 302 by an angle theta-one ($\theta_1$) 314 or in other embodiments substantially co-located with the first microphone 306 as shown by a microphone 322. Alternatively a second microphone can be located in another place on the wrist wearable device 302 such as 312 (indicated by theta-two ($\theta_2$) at 316) or 310 (indicated by theta-three ($\theta_3$) at 318). In operation, the first microphone 306 receives desired audio and undesired audio and is referred to herein as a "primary" or "main" channel as described further below in conjunction with FIG. 11. The second microphone forms a second channel referred to herein and below as a reference channel. In various embodiments there can be multiple reference channels or multiple main channels.

Figure 4:
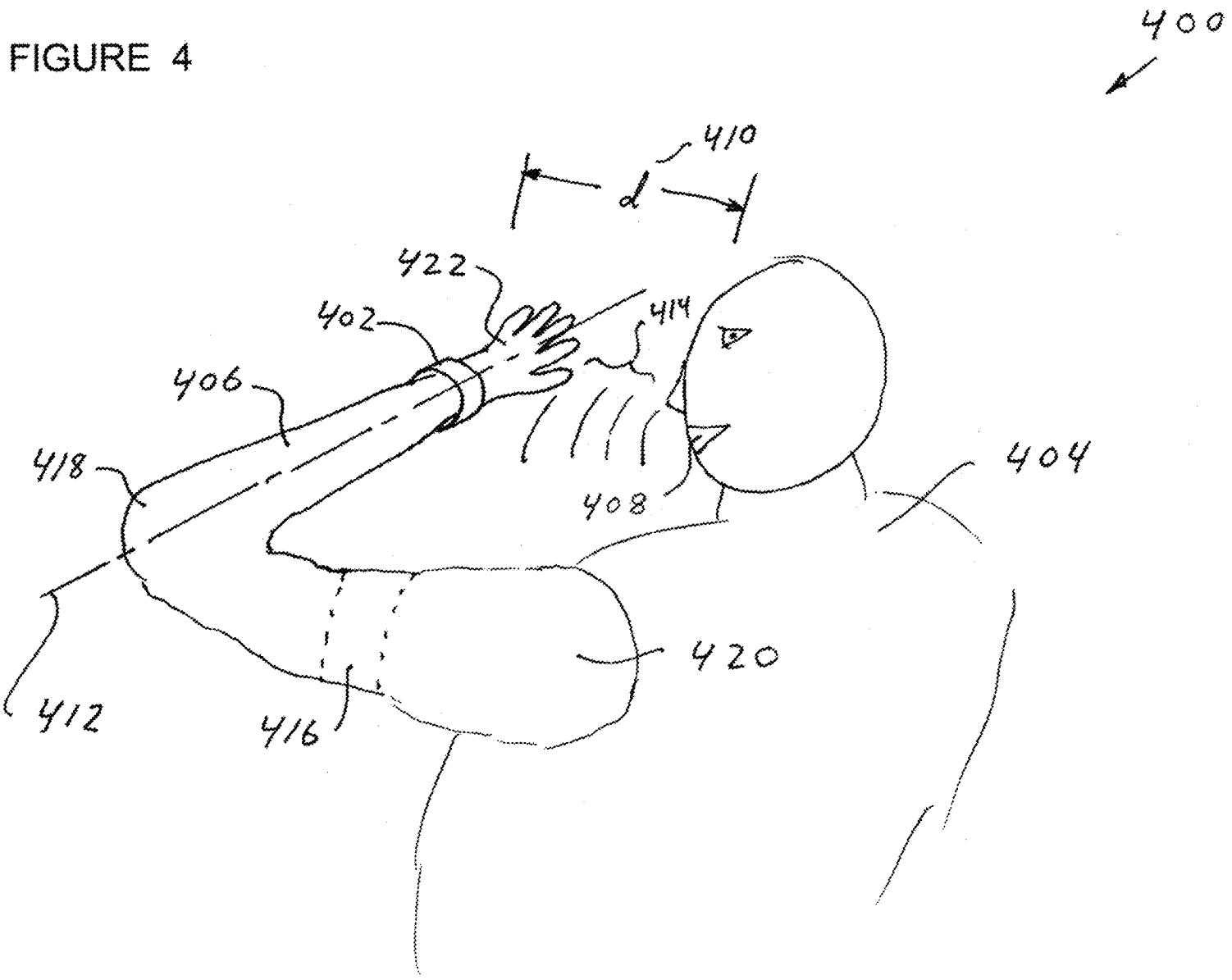
FIG. 4 illustrates a wrist wearable device in receive orientation, according to embodiments of the invention

FIG. 4 illustrates, generally at 400, a wrist wearable device in receive orientation, according to embodiments of the invention. With reference to FIG. 4, a user 404 has a forearm 406 extending along an axis 412. On the user's forearm 406 is a wrist wearable device 402. Note that the wrist wearable device 402 can be worn at any location between the user's elbow 418 and the user's hand 422. The location of wrist wearable device 402 is provided merely for illustration and does not limit embodiments of the invention. Alternatively, the wrist wearable device 402 can be positioned as shown at 416 at a location between the user's elbow 418 and the user's shoulder 420.

In one or more embodiments, when worn on the wrist as shown in FIG. 4, a receive orientation is established when the user raises the forearm 406 up from hanging downward at the user's side. In some embodiments, a receive orientation is when the user's arm is hanging downward at the user's side. In other embodiments, receive orientation is achieved when a user tilts his or her head toward the wrist wearable device. In yet other embodiments, receive orientation is achieved when the user faces forward and his or her arm is either raised or hanging down at the user's side. Receive orientation is not constrained by the view presented in FIG. 4. The view presented in FIG. 4 is illustrative and is not limiting.

In operation, when the user 404 speaks the user's mouth 408 creates a desired audio signal 414 which is received at a first microphone and a second microphone as described above in conjunction with FIG. 1 through FIG. 3. The user's mouth 408 is separated from a front surface of the wrist wearable device 402 by a distance d at 410.

Figure 5:
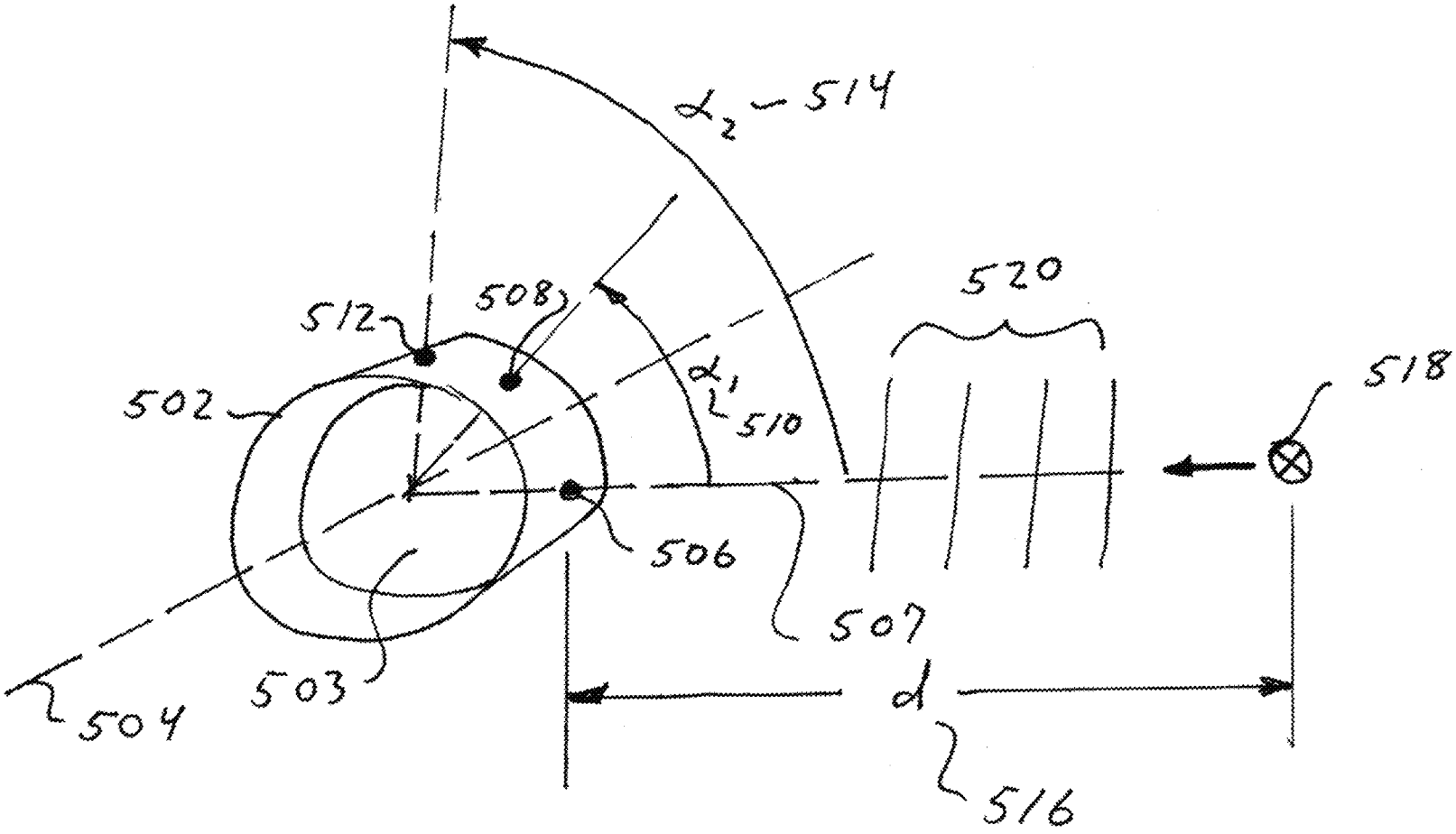
FIG. 5 illustrates microphones in different locations, according to embodiments of the invention.

FIG. 5 illustrates, generally at 500, microphones in different locations, according to embodiments of the invention. Microphones can be placed in various locations on a wrist wearable device. Whether a set of given locations will provide satisfactory performance for a noise cancellation system according to embodiments of the invention depends on a difference in signal-to-noise ratio between a first microphone and a second microphone mounted on a wrist wearable device. Signal-to-noise ratio for a particular microphone is influenced by the desired audio and undesired audio incident upon the microphone as well as the directional response of the microphone.

With reference to FIG. 5, a wrist wearable device 502 defines an opening 503 and has an axis 504 along which a user inserts a hand, a forearm, an arm, etc. when the wrist wearable device is worn. A source of desired audio indicated at 518 (e.g., speech uttered from the user's mouth) is indicated at 520 and is incident upon the wrist wearable device 502.

A first microphone 506 is located as illustrated along a reference axis 507 with the source of desired audio 518. A second microphone is located at a first position 508 as indicated by angle alpha-one ($\alpha_1$) at 510. In the position 508, the first and second microphones are exposed to a combination of desired and undesired audio and a signal-to-noise ratio measurement is made for the first microphone and the second microphone. A signal-to-noise ratio difference is then computed for these measurements. The second microphone is rotated further away from the first microphone 506 by moving it to a position indicated at 512 by angle alpha-two ($\alpha_2$) at 514. In the position indicated at 512 the microphones are exposed to the combination of desired audio and undesired audio and a signal-to-noise ratio measurement is made for the first microphone and the second microphone. A signal-to-noise ratio difference is computed for these measurements. Following the procedure so described, the second microphone is moved to successive positions around the surface of the wrist wearable device as alpha ($\alpha$) increases from nominally zero degrees to approximately 360 degrees. The results of a set of measurements for one orientation of wrist wearable device 502 and microphone placements are plotted in FIG. 6 below.

Figure 6:
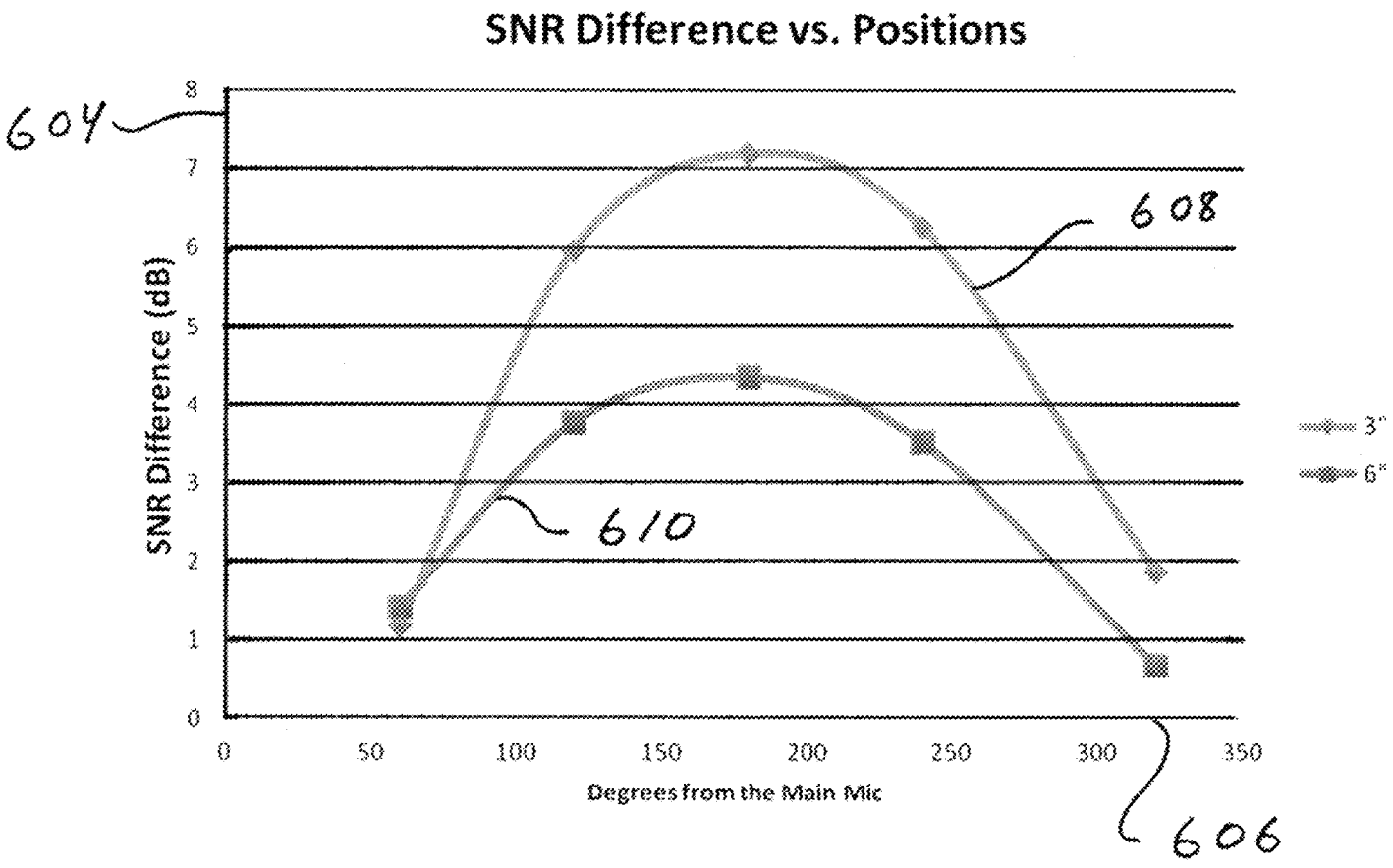
FIG. 6 illustrates signal-to-noise ratio difference between two microphones according to embodiments of the invention.

FIG. 6 illustrates, generally at 600, signal-to-noise ratio difference between two microphones according to embodiments of the invention. With reference to FIG. 6, signal-to-noise ratio difference in decibels is plotted on a vertical axis 604. Angle alpha ($\alpha$) measures degrees of separation between a second microphone and the main microphone (or first microphone) and is plotted on a horizontal axis 606. Two signal-to-noise ratio difference curves are plotted in FIG. 6, a curve 608 corresponding to a distance d equal to three (3) inches and a curve 610 corresponding to a distance d equal to six (6) inches. Signal-to-noise ratio difference increases for increasing angle alpha ($\alpha$) for both curves 608 and 610 reaching a maximum at approximately alpha ($\alpha$) equal to one hundred and eighty (180) degrees. Data was taken following the procedure described above for FIG. 5 in order to construct the curve 608 and the curve 610.

As described below in conjunction with the figures that follow, embodiments of the invention are used to reduce noise (undesired audio) from a main microphone signal with signal-to-noise ratio difference ranging from a fraction of a decibel to several decibels or more. Thus, many different microphone locations are possible for positioning the main and the reference microphone on a wrist wearable device.

The measurements plotted in FIG. 6 were made using omni-directional microphones. Omni-directional microphones are inexpensive and are readily implemented in various embodiments of the invention. In some embodiments, it is desirable to use directional microphones, for example in low signal-to-noise ratio environments directional microphones can be useful. Such an environment can occur, when a wrist wearable device is not directly aligned with a source of desired audio, e.g., a user's mouth, a signal-to-noise ratio of a microphone will decrease as well as a signal-to-noise ratio difference. For example, when a user's arm is in a lowered position and/or when the user is looking away from the wrist wearable device while speaking. In such orientations, increased signal-to-noise ratio and signal-to-noise ratio difference between microphones can be achieved by using a directional microphone to increase the reception of desired audio.

Similarly, a directional microphone can be used to decrease reception of desired audio and to increase reception of undesired audio, thereby lowering a signal-to-noise ratio of a second microphone (reference microphone), which results in an increase in the signal-to-noise ratio difference between the primary and reference microphones. An example is illustrated in FIG. 3 using a second microphone 322 and the techniques taught in FIG. 7 and FIG. 8 below. The second microphone 322 is a directional microphone whose main response axis is substantially parallel with an axis 303 representative of a user's forearm. A null or a direction of lesser response for microphone 322 exists in the direction of desired audio, which results in a decrease in the signal-to-noise ratio of the second microphone 322 and an increase in a signal-to-noise ratio difference calculated between the first microphone and the second microphone. Note that the two microphones can be placed in any location on the wrist wearable device 302, which includes co-location as illustrated with 306 and 322. The axis 303 can be misaligned with a direction of the source of desired audio by as much as ninety (90) degrees.

In some embodiments, more than one main microphone is used on a wrist wearable device. In various embodiments, such a configuration is useful when desired audio can come from more than one direction. In such a case, the system is said to have more than one receive orientation. For example, in FIG. 4 one receive orientation is illustrated where the user's arm is raised and a direction of the desired speech is substantially perpendicular to a microphone mounted on the wrist wearable device 402. A second receive orientation exists when the user's arm is hanging down along the user's side. The second receive orientation places a microphone mounted on an edge of the wrist wearable device (e.g., 312 or 310) in a more direct path of desired audio thereby making the location 312 or 310 a main microphone in the second receive orientation. When more than one main microphone is used in an acoustic signal processing system, logic within the acoustic signal processing system selects a main microphone from the group of main microphones. Selection criteria can be based in part on a consideration of the largest signal-to-noise ratio of the possible main microphones. The selected microphone is used as the main microphone and noise is reduced from the desired audio signal using the techniques described below in the figures that follow. Thus, a wrist wearable system can have more than one receive orientation and the system can switch between a plurality of receive orientations during use by a user.

Figure 7:
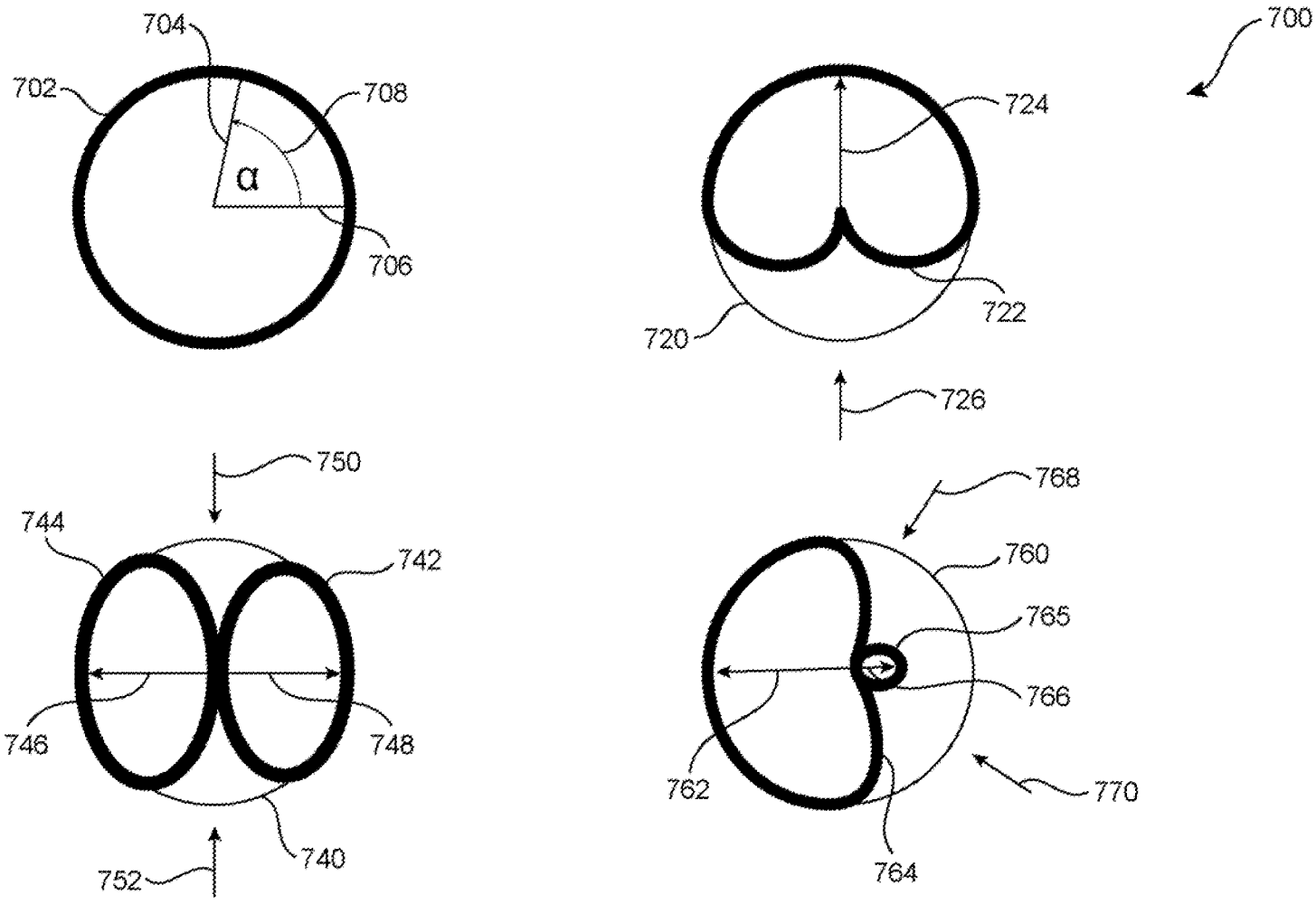
FIG. 7 illustrates microphone directivity patterns according to embodiments of the invention.

FIG. 7 illustrates, generally at 700, microphone directivity patterns according to embodiments of the invention. With reference to FIG. 7, an omni-directional microphone directivity pattern is illustrated with circle 702 having constant radius 704 indicating uniform sensitivity as a function of angle alpha ($\alpha$) at 708 measured from reference 706.

An example of a directional microphone having a cardioid directivity pattern 722 is illustrated within plot 720 where the cardioid directivity pattern 722 has a peak sensitivity axis indicated at 724 and a null indicated at 726. A cardioid directivity pattern can be formed with two omni-directional microphones or with an omni-directional microphone and a suitable mounting structure for the microphone.

An example of a directional microphone having a bidirectional directivity pattern 742/744 is illustrated within plot 740 where a first lobe 742 of the bidirectional directivity pattern has a first peak sensitivity axis indicated at 748 the second lobe 744 has a second peak sensitivity axis indicated at 746. A first null exists at a direction 750 and a second null exists at a direction 752.

An example of a directional microphone having a super-cardioid directivity pattern is illustrated with plot 760 where the super-cardioid directivity pattern 764/765 has a peak sensitivity axis indicated at a direction 762, a minor sensitivity axis indicated at a direction 766 and nulls indicated at directions 768 and 770.

Thus, within the teachings of embodiments presented herein one or more main microphones and one or more reference microphones are placed in locations on a wrist wearable device to obtain suitable signal-to-noise ratio difference between a main and a reference microphone to enable extraction of desired audio from an acoustic signal containing both desired audio and undesired audio as described below in conjunction with the figures that follow. Microphones can be placed at various locations on the wrist wearable device depending on the receive orientations for the system, including co-locating a main and a reference microphone at a common circumferential angular position on a wrist wearable device.

Figure 8:
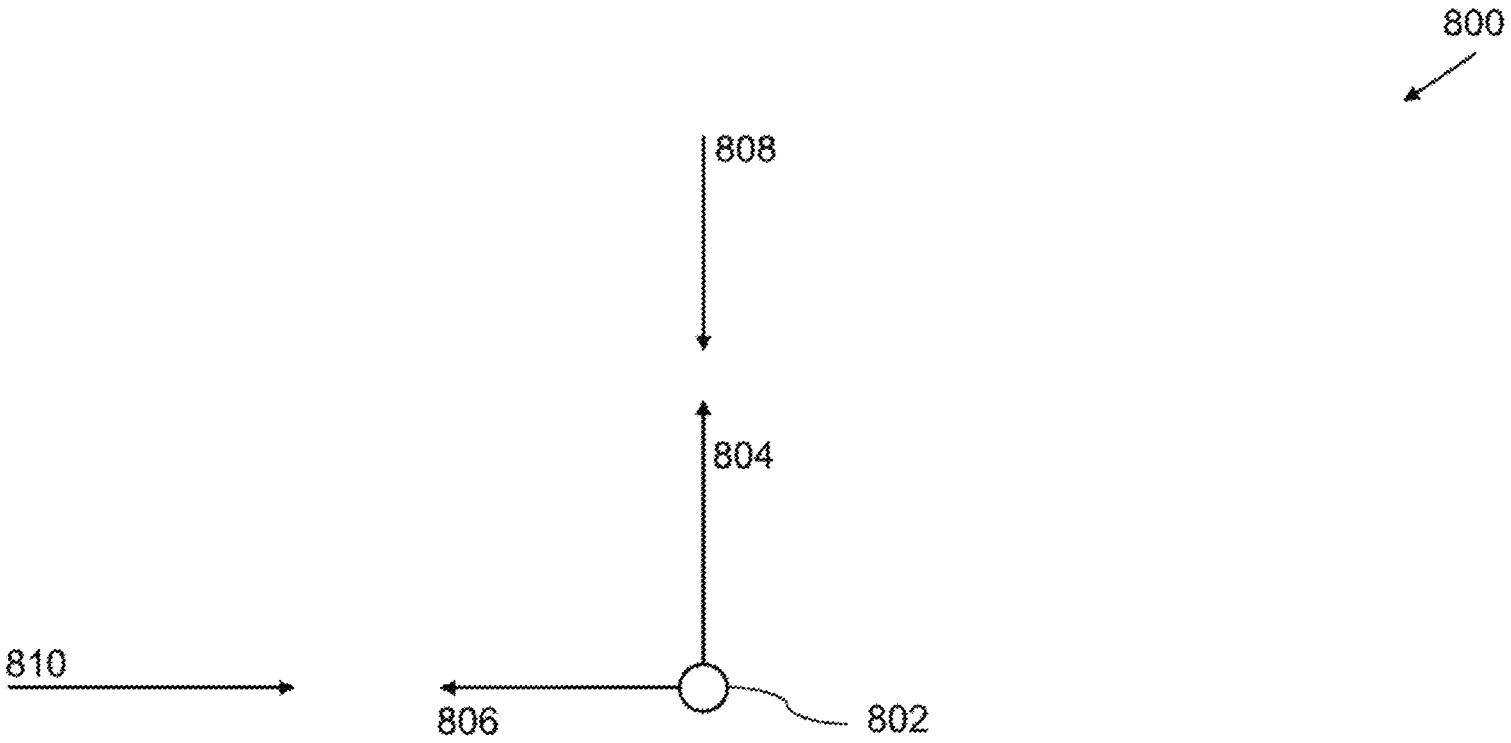
FIG. 8 illustrates a misaligned reference microphone response axis according to embodiments of the invention.

FIG. 8 illustrates, generally at 800, a misaligned reference microphone response axis according to embodiments of the invention. With reference to FIG. 8, a microphone is indicated at 802. The microphone 802 is a directional microphone having a main response axis 806 and a null in its directivity pattern indicated at 804. An incident acoustic field is indicated arriving from a direction 808. In various embodiments, the microphone 802 is for example a bidirectional microphone as illustrated in FIG. 7 above. Suitably positioned on a wrist wearable device, the directional microphone 802 decreases a signal-to-noise ratio when used as a reference microphone by not responding to desired audio coming from direction 808 while responding to undesired audio, coming from a direction 810. The response of the directive microphone 802 will produce an increase in a signal-to-noise ratio difference as described above.

Figure 9:
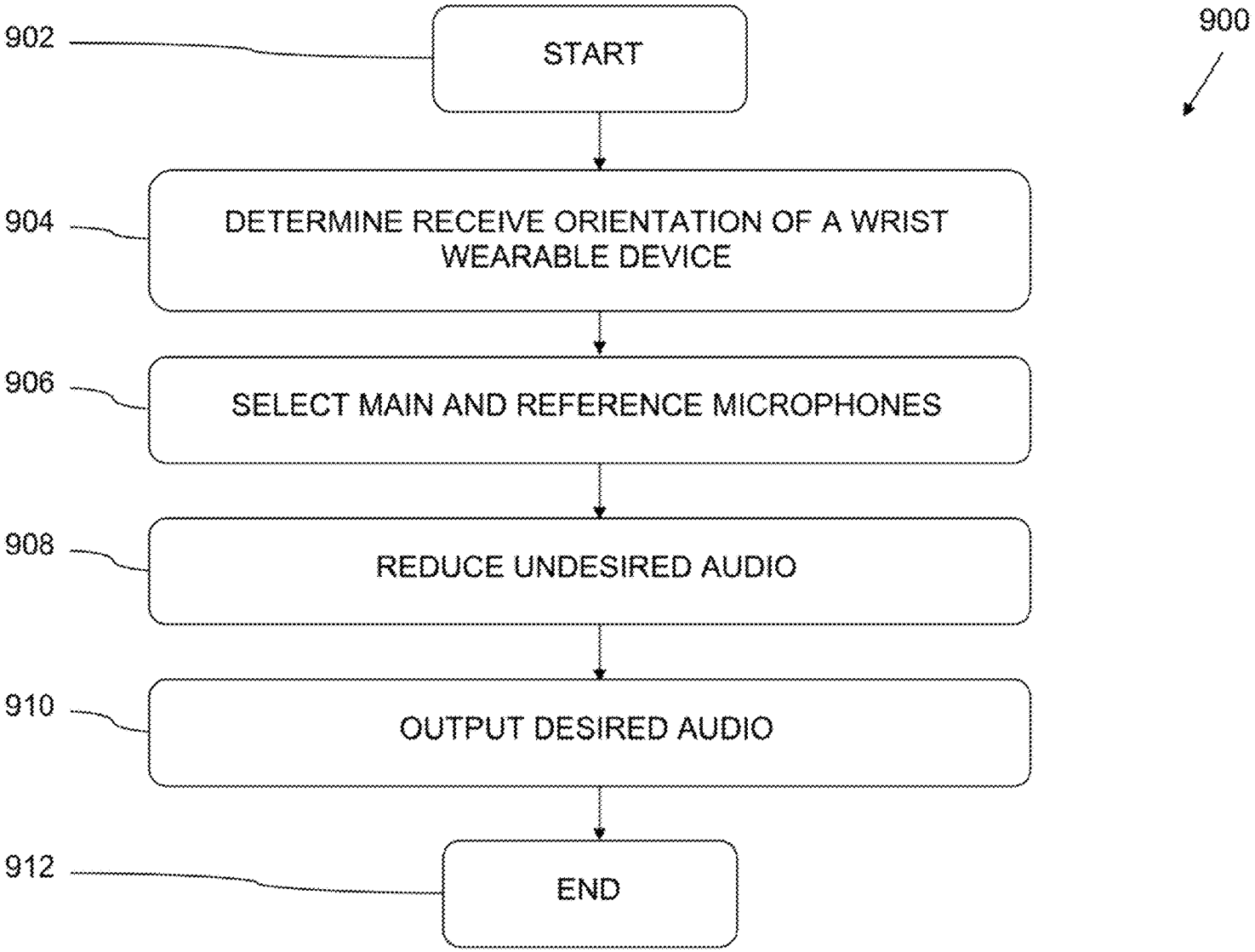
FIG. 9 illustrates a process for extracting a desired audio signal according to embodiments of the invention.

FIG. 9 illustrates, generally at 900, a process for extracting a desired audio signal according to embodiments of the invention. With reference to FIG. 9, a process starts at a block 902. At a block 904 a receive orientation of a wrist wearable device is determined as described above. At a block 906 a main microphone and a reference microphone are selected based on the receive orientation determined in 904. At a block 908 undesired audio is reduced from a main microphone channel as described below in conjunction with the figures that follow. The process stops at a block 912.

Figure 10:
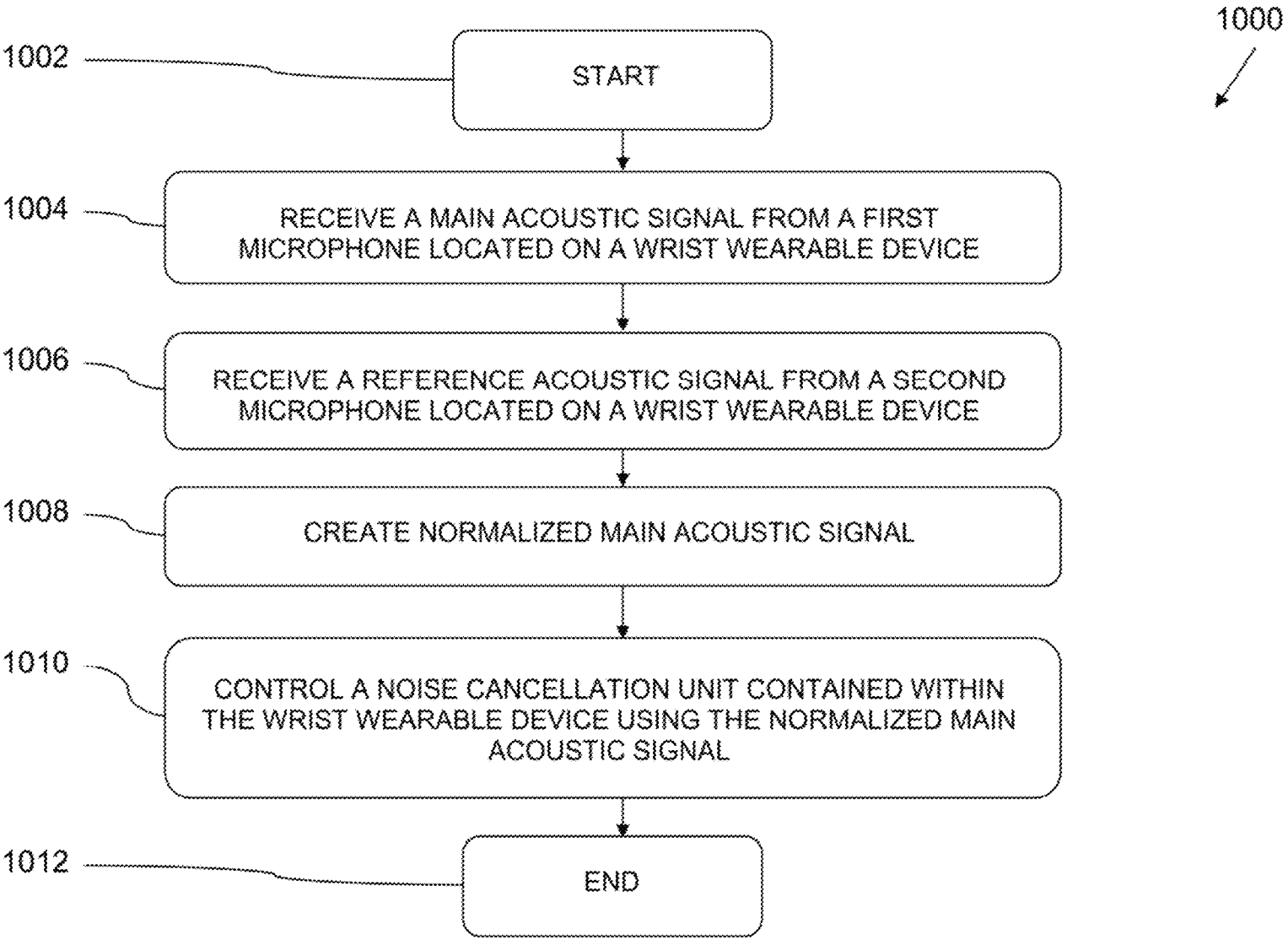
FIG. 10 illustrates another process for extracting a desired audio signal according to embodiments of the invention

FIG. 10 illustrates, generally at 1000, another process for extracting a desired audio signal according to embodiments of the invention. With reference to FIG. 10, a process starts at a block 1002. At a block 1004, a main acoustic signal is received from a main microphone located on a wrist wearable device. At a block 1006, a reference acoustic signal is received from a reference microphone located on a wrist wearable device. At a block 1008, a normalized main acoustic signal is formed. In various embodiments, the normalized main acoustic signal is formed using one or more reference acoustic signals as described in the figures below. At a block 1010 the normalized main acoustic signal is used to control noise cancellation using an acoustic signal processing system contained within the wrist wearable device. The process stops at a block 1012.

Figure 11:
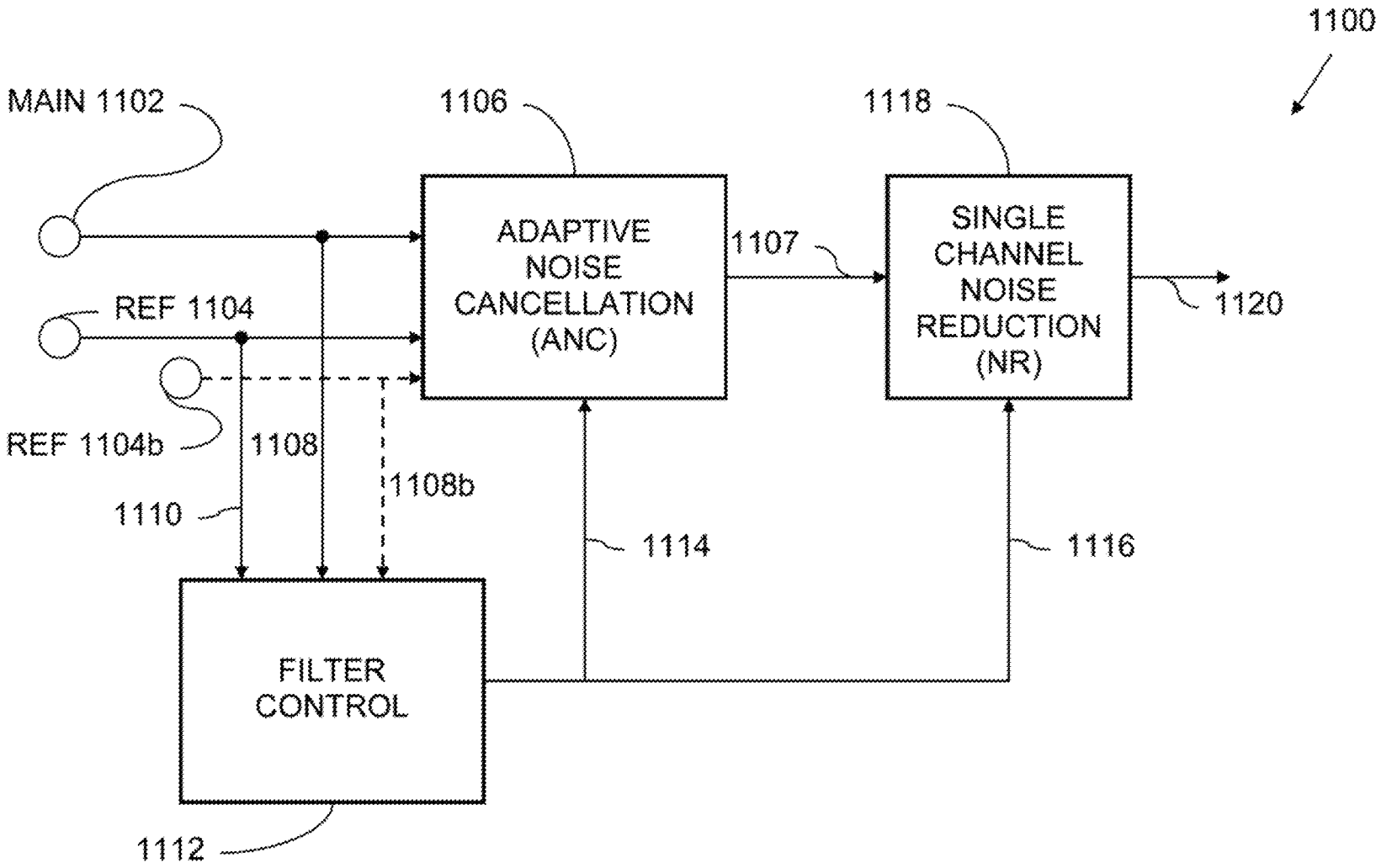
FIG. 11 illustrates system architecture, according to embodiments of the invention.

FIG. 11 illustrates, generally at 1100, system architecture, according to embodiments of the invention. With reference to FIG. 11, two acoustic channels are input into an adaptive noise cancellation unit 1106. A first acoustic channel, referred to herein as main channel 1102, is referred to in this description of embodiments synonymously as a "primary" or a "main" channel. The main channel 1102 contains both desired audio and undesired audio. The acoustic signal input on the main channel 1102 arises from the presence of both desired audio and undesired audio on one or more acoustic elements as described more fully below in the figures that follow. Depending on the configuration of a microphone or microphones used for the main channel the microphone elements can output an analog signal. The analog signal is converted to a digital signal with an analog-to-digital converter (AD) converter (not shown). Additionally, amplification can be located proximate to the microphone element(s) or AD converter. A second acoustic channel, referred to herein as reference channel 1104 provides an acoustic signal which also arises from the presence of desired audio and undesired audio. Optionally, a second reference channel **1104*b* can be input into the adaptive noise cancellation unit 1106**. Similar to the main channel and depending on the configuration of a microphone or microphones used for the reference channel, the microphone elements can output an analog signal. The analog signal is converted to a digital signal with an analog-to-digital converter (AD) converter (not shown). Additionally, amplification can be located proximate to the microphone element(s) or AD converter. In some embodiments the microphones are implemented as digital microphones.

In some embodiments, the main channel 1102 has an omni-directional response and the reference channel 1104 has an omni-directional response. In some embodiments, the acoustic beam patterns for the acoustic elements of the main channel 1102 and the reference channel 1104 are different. In other embodiments, the beam patterns for the main channel 1102 and the reference channel 1104 are the same; however, desired audio received on the main channel 1102 is different from desired audio received on the reference channel 1104. Therefore, a signal-to-noise ratio for the main channel 1102 and a signal-to-noise ratio for the reference channel 1104 are different. In general, the signal-to-noise ratio for the reference channel is less than the signal-to-noise-ratio of the main channel. In various embodiments, by way of non-limiting examples, a difference between a main channel signal-to-noise ratio and a reference channel signal-to-noise ratio is approximately 1 or 2 decibels (dB) or more. In other non-limiting examples, a difference between a main channel signal-to-noise ratio and a reference channel signal-to-noise ratio is 1 decibel (dB) or less. Thus, embodiments of the invention are suited for high noise environments, which can result in low signal-to-noise ratios with respect to desired audio as well as low noise environments, which can have higher signal-to-noise ratios. As used in this description of embodiments, signal-to-noise ratio means the ratio of desired audio to undesired audio in a channel. Furthermore, the term "main channel signal-to-noise ratio" is used interchangeably with the term "main signal-to-noise ratio." Similarly, the term "reference channel signal-to-noise ratio" is used interchangeably with the term "reference signal-to-noise ratio."

The main channel 1102, the reference channel 1104, and optionally a second reference channel 1104*b* provide inputs to an adaptive noise cancellation unit 1106. While a second reference channel is shown in the figures, in various embodiments, more than two reference channels are used. Adaptive noise cancellation unit 1106 filters undesired audio from the main channel 1102, thereby providing a first stage of filtering with multiple acoustic channels of input. In various embodiments, the adaptive noise cancellation unit 1106 utilizes an adaptive finite impulse response (FIR) filter. The environment in which embodiments of the invention are used can present a reverberant acoustic field. Thus, the adaptive noise cancellation unit 1106 includes a delay for the main channel sufficient to approximate the impulse response of the environment in which the system is used. A magnitude of the delay used will vary depending on the particular application that a system is designed for including whether or not reverberation must be considered in the design. In some embodiments, for microphone channels positioned very closely together (and where reverberation is not significant) a magnitude of the delay can be on the order of a fraction of a millisecond. Note that at the low end of a range of values, which could be used for a delay, an acoustic travel time between channels can represent a minimum delay value. Thus, in various embodiments, a delay value can range from approximately a fraction of a millisecond to approximately 500 milliseconds or more depending on the application. Further description of the adaptive noise cancellation unit 1106 and the components associated therewith are provided below in conjunction with the figures that follow.

An output 1107 of the adaptive noise cancellation unit 1106 is input into a single channel noise cancellation unit 1118. The single channel noise cancellation unit 1118 filters the output 1107 and provides a further reduction of undesired audio from the output 1107, thereby providing a second stage of filtering. The single channel noise cancellation unit 1118 filters mostly stationary contributions to undesired audio. The single channel noise cancellation unit 1118 includes a linear filter, such as for example a WEINER filter, a Minimum Mean Square Error (MMSE) filter implementation, a linear stationary noise filter, or other Bayesian filtering approaches which use prior information about the parameters to be estimated. Filters used in the single channel noise cancellation unit 1118 are described more fully below in conjunction with the figures that follow.

Acoustic signals from the main channel 1102 are input at 1108 into a filter control 1112. Similarly, acoustic signals from the reference channel 1104 are input at 1110 into the filter control 1112. An optional second reference channel is input at 1108*b* into the filter control 1112. Filter control 1112 provides control signals 1114 for the adaptive noise cancellation unit 1106 and control signals 1116 for the single channel noise cancellation unit 1118. In various embodiments, the operation of filter control 1112 is described more completely below in conjunction with the figures that follow. An output 1120 of the single channel noise cancellation unit 1118 provides an acoustic signal which contains mostly desired audio and a reduced amount of undesired audio.

The system architecture shown in FIG. 11 can be used in a variety of different systems used to process acoustic signals according to various embodiments of the invention. Some examples of the different acoustic systems are, but are not limited to, a mobile phone, a handheld microphone, a boom microphone, a microphone headset, a hearing aid, a hands free microphone device, a wearable system embedded in a frame of an eyeglass, a near-to-eye (NTE) headset display or headset computing device, a wrist wearable system such as a wristband, a watch, a bracelet, etc. The environments that these acoustic systems are used in can have multiple sources of acoustic energy incident upon the acoustic elements that provide the acoustic signals for the main channel 1102 and the reference channel 1104. In various embodiments, the desired audio is usually the result of a user's own voice. In various embodiments, the undesired audio is usually the result of the combination of the undesired acoustic energy from the multiple sources that are incident upon the acoustic elements used for both the main channel and the reference channel. Thus, the undesired audio is statistically uncorrelated with the desired audio. In addition, there is a non-causal relationship between the undesired audio in the main channel and the undesired audio in the reference channel. In such a case, echo cancellation does not work because of the non-causal relationship and because there is no measurement of a pure noise signal (undesired audio) apart from the signal of interest (desired audio). In echo cancellation noise reduction systems, a speaker, which generated the acoustic signal, provides a measure of a pure noise signal. In the context of the embodiments of the system described herein, there is no speaker, or noise source from which a pure noise signal could be extracted.

Figure 12:
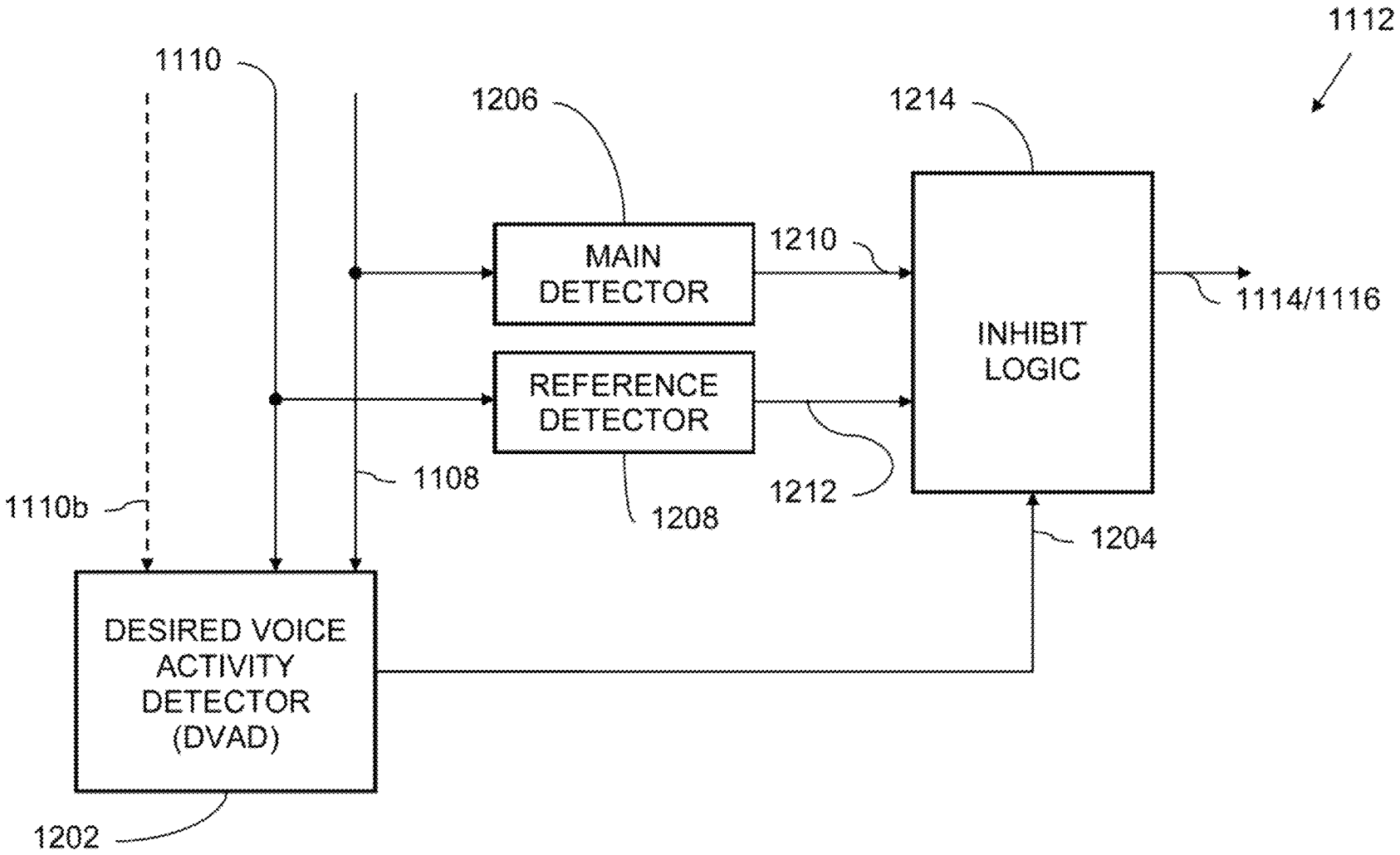
FIG. 12 illustrates filter control, according to embodiments of the invention.

FIG. 12 illustrates, generally at 1112, filter control, according to embodiments of the invention. With reference to FIG. 12, acoustic signals from the main channel 1102 are input at 1108 into a desired voice activity detection unit 1202. Acoustic signals at 1108 are monitored by main channel activity detector 1206 to create a flag that is associated with activity on the main channel 1102 (FIG. 11). Optionally, acoustic signals at 1110*b* are monitored by a second reference channel activity detector (not shown) to create a flag that is associated with activity on the second reference channel. Optionally, an output of the second reference channel activity detector is coupled to the inhibit control logic 1214. Acoustic signals at 1110 are monitored by reference channel activity detector 1208 to create a flag that is associated with activity on the reference channel 1104 (FIG. 11). The desired voice activity detection unit 1202 utilizes acoustic signal inputs from 1110, 1108, and optionally 1110*b* to produce a desired voice activity signal 1204. The operation of the desired voice activity detection unit 1202 is described more completely below in the figures that follow.

In various embodiments, inhibit logic unit 1214 receives as inputs, information regarding main channel activity at 1210, reference channel activity at 1212, and information pertaining to whether desired audio is present at 1204. In various embodiments, the inhibit logic 1214 outputs filter control signal 1114/1116 which is sent to the adaptive noise cancellation unit 1106 and the single channel noise cancellation unit 1118 of FIG. 11 for example. The implementation and operation of the main channel activity detector 1206, the reference channel activity detector 1208 and the inhibit logic 1214 are described more fully in U.S. Pat. No. 7,386,135 titled "Cardioid Beam With A Desired Null Based Acoustic Devices, Systems and Methods," which is hereby incorporated by reference.

In operation, in various embodiments, the system of FIG. 11 and the filter control of FIG. 12 provide for filtering and removal of undesired audio from the main channel 1102 as successive filtering stages are applied by adaptive noise cancellation unit 1106 and single channel nose cancellation unit 1118. In one or more embodiments, throughout the system, application of the signal processing is applied linearly. In linear signal processing an output is linearly related to an input. Thus, changing a value of the input, results in a proportional change of the output. Linear application of signal processing processes to the signals preserves the quality and fidelity of the desired audio, thereby substantially eliminating or minimizing any non-linear distortion of the desired audio. Preservation of the signal quality of the desired audio is useful to a user in that accurate reproduction of speech helps to facilitate accurate communication of information.

In addition, algorithms used to process speech, such as Speech Recognition (SR) algorithms or Automatic Speech Recognition (ASR) algorithms benefit from accurate presentation of acoustic signals which are substantially free of non-linear distortion. Thus, the distortions which can arise from the application of signal processing processes which are non-linear are eliminated by embodiments of the invention. The linear noise cancellation algorithms, taught by embodiments of the invention, produce changes to the desired audio which are transparent to the operation of SR and ASR algorithms employed by speech recognition engines. As such, the error rates of speech recognition engines are greatly reduced through application of embodiments of the invention.

Figure 13:
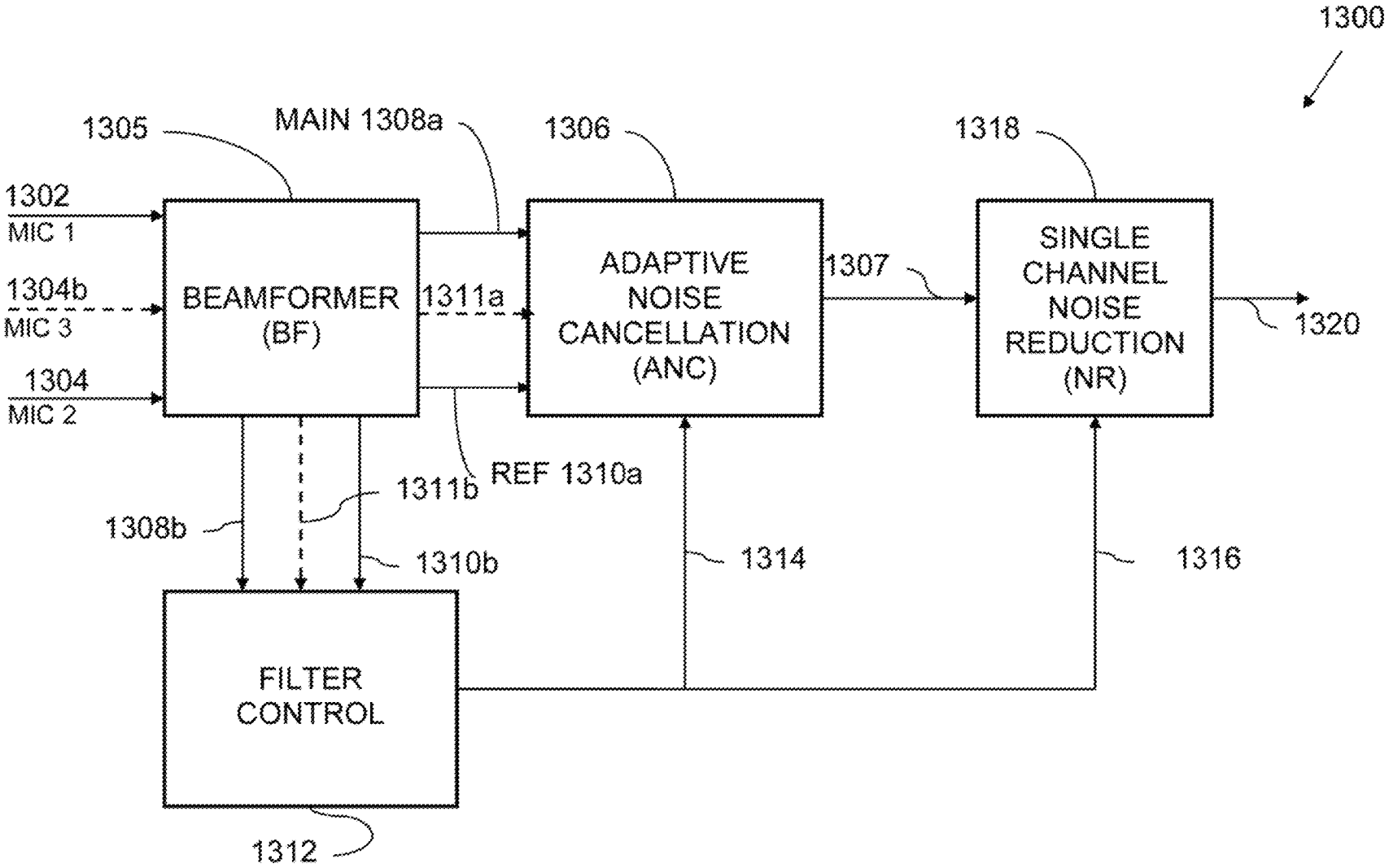
FIG. 13 illustrates another diagram of system architecture, according to embodiments of the invention.

FIG. 13 illustrates, generally at 1300, another diagram of system architecture, according to embodiments of the invention. With reference to FIG. 13, in the system architecture presented therein, a first channel provides acoustic signals from a first microphone at 1302 (nominally labeled in the figure as MIC 1). A second channel provides acoustic signals from a second microphone at 1304 (nominally labeled in the figure as MIC 2). In various embodiments, one or more microphones can be used to create the signal from the first microphone 1302. In various embodiments, one or more microphones can be used to create the signal from the second microphone 1304. In some embodiments, one or more acoustic elements can be used to create a signal that contributes to the signal from the first microphone 1302 and to the signal from the second microphone 1304 (see FIG. 15C described below). Thus, an acoustic element can be shared by 1302 and 1304. In various embodiments, arrangements of acoustic elements which provide the signals at 1302, 1304, the main channel, and the reference channel are described below in conjunction with the figures that follow.

A beamformer 1305 receives as inputs, the signal from the first microphone 1302 and the signal from the second microphone 1304 and optionally a signal from a third microphone 1304*b* (nominally labeled in the figure as MIC 3). The beamformer 1305 uses signals 1302, 1304 and optionally 1304*b* to create a main channel 1308*a* which contains both desired audio and undesired audio. The beamformer 1305 also uses signals 1302, 1304, and optionally 1304*b* to create one or more reference channels 1310*a* and optionally 1311*a*. A reference channel contains both desired audio and undesired audio. A signal-to-noise ratio of the main channel, referred to as "main channel signal-to-noise ratio" is greater than a signal-to-noise ratio of the reference channel, referred to herein as "reference channel signal-to-noise ratio." The beamformer 1305 and/or the arrangement of acoustic elements used for MIC 1 and MIC 2 provide for a main channel signal-to-noise ratio which is greater than the reference channel signal-to-noise ratio.

The beamformer 1305 is coupled to an adaptive noise cancellation unit 1306 and a filter control unit 1312. A main channel signal is output from the beamformer 1305 at 1308*a* and is input into an adaptive noise cancellation unit 1306. Similarly, a reference channel signal is output from the beamformer 1305 at 1310*a* and is input into the adaptive noise cancellation unit 1306. The main channel signal is also output from the beamformer 1305 and is input into a filter control 1312 at 1308*b*. Similarly, the reference channel signal is output from the beamformer 1305 and is input into the filter control 1312 at 1310*b*. Optionally, a second reference channel signal is output at 1311*a* and is input into the adaptive noise cancellation unit 1306 and the optional second reference channel signal is output at 1311*b* and is input into the filter control 1312.

The filter control 1312 uses inputs 1308*b*, 1310*b*, and optionally 1311*b* to produce channel activity flags and desired voice activity detection to provide filter control signal 1314 to the adaptive noise cancellation unit 1306 and filter control signal 1316 to a single channel noise reduction unit 1318.

The adaptive noise cancellation unit 1306 provides multichannel filtering and filters a first amount of undesired audio from the main channel 1308*a* during a first stage of filtering to output a filtered main channel at 1307. The single channel noise reduction unit 1318 receives as an input the filtered main channel 1307 and provides a second stage of filtering, thereby further reducing undesired audio from 1307. The single channel noise reduction unit 1318 outputs mostly desired audio at 1320.

In various embodiments, different types of microphones can be used to provide the acoustic signals needed for the embodiments of the invention presented herein. Any transducer that converts a sound wave to an electrical signal is suitable for use with embodiments of the invention taught herein. Some non-limiting examples of microphones are, but are not limited to, a dynamic microphone, a condenser microphone, an Electret Condenser Microphone, (ECM), and a microelectromechanical systems (MEMS) microphone. In other embodiments a condenser microphone (CM) is used. In yet other embodiments micro-machined microphones are used. Microphones based on a piezoelectric film are used with other embodiments. Piezoelectric elements are made out of ceramic materials, plastic material, or film. In yet other embodiments, micromachined arrays of microphones are used. In yet other embodiments, silicon or polysilicon micromachined microphones are used. In some embodiments, bi-directional pressure gradient microphones are used to provide multiple acoustic channels. Various microphones or microphone arrays including the systems described herein can be mounted on or within structures such as eyeglasses or headsets.

Figure 14A:
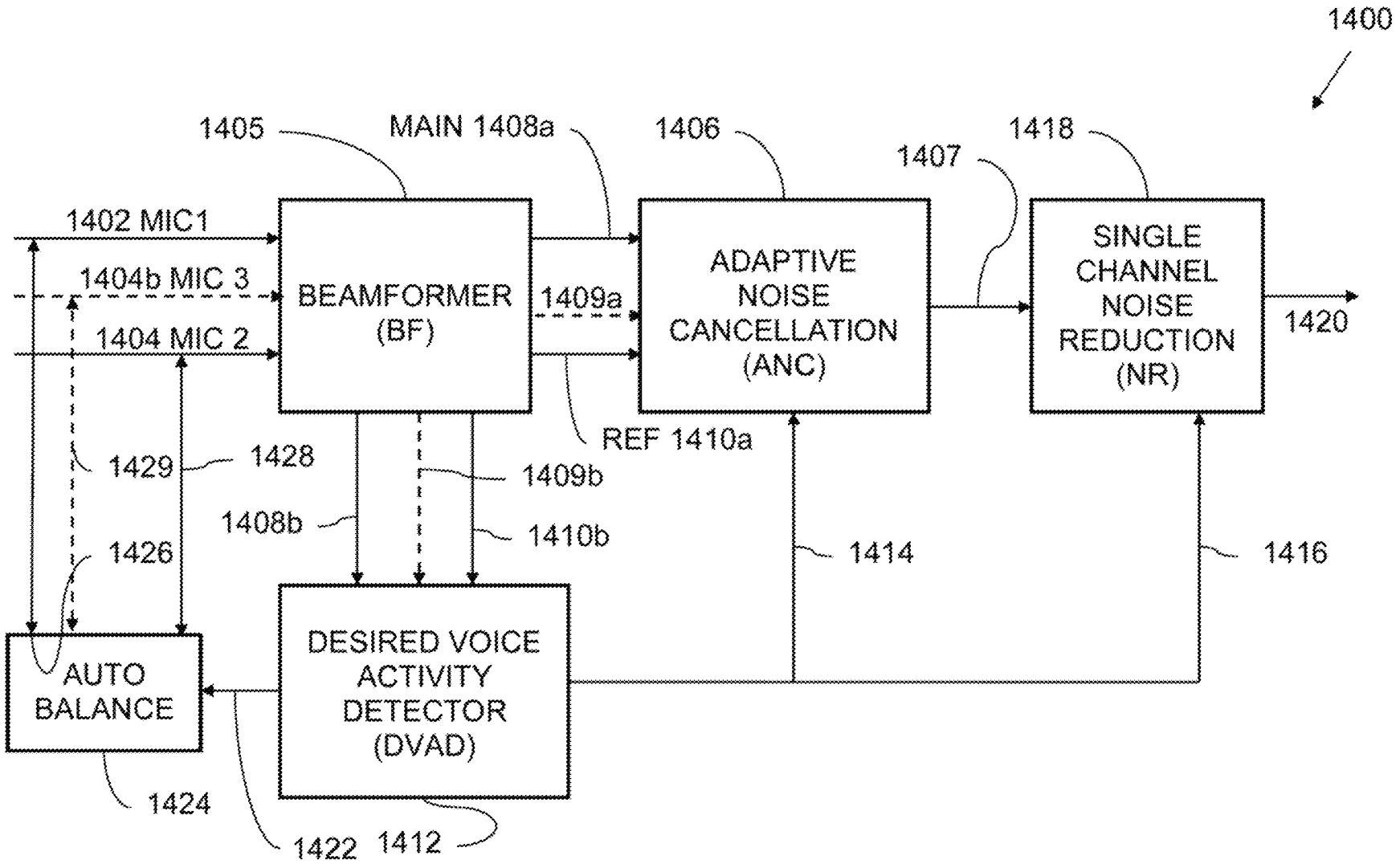
FIG. 14A illustrates another diagram of system architecture incorporating auto-balancing, according to embodiments of the invention.

FIG. 14A illustrates, generally at 1400, another diagram of system architecture incorporating auto-balancing, according to embodiments of the invention. With reference to FIG. 14A, in the system architecture presented therein, a first channel provides acoustic signals from a first microphone at 1402 (nominally labeled in the figure as MIC 1). A second channel provides acoustic signals from a second microphone at 1404 (nominally labeled in the figure as MIC 2). In various embodiments, one or more microphones can be used to create the signal from the first microphone 1402. In various embodiments, one or more microphones can be used to create the signal from the second microphone 1404. In some embodiments, as described above in conjunction with FIG. 13, one or more acoustic elements can be used to create a signal that becomes part of the signal from the first microphone 1402 and the signal from the second microphone 1404. In various embodiments, arrangements of acoustic elements which provide the signals 1402, 1404, the main channel, and the reference channel are described below in conjunction with the figures that follow.

A beamformer 1405 receives as inputs, the signal from the first microphone 1402 and the signal from the second microphone 1404. The beamformer 1405 uses signals 1402 and 1404 to create a main channel which contains both desired audio and undesired audio. The beamformer 1405 also uses signals 1402 and 1404 to create a reference channel. Optionally, a third channel provides acoustic signals from a third microphone at 1404*b* (nominally labeled in the figure as MIC 3), which are input into the beamformer 1405. In various embodiments, one or more microphones can be used to create the signal 1404*b* from the third microphone. The reference channel contains both desired audio and undesired audio. A signal-to-noise ratio of the main channel, referred to as "main channel signal-to-noise ratio" is greater than a signal-to-noise ratio of the reference channel, referred to herein as "reference channel signal-to-noise ratio." The beamformer 1405 and/or the arrangement of acoustic elements used for MIC 1, MIC 2, and optionally MIC 3 provide for a main channel signal-to-noise ratio that is greater than the reference channel signal-to-noise ratio. In some embodiments bi-directional pressure-gradient microphone elements provide the signals 1402, 1404, and optionally 1404*b*.

The beamformer 1405 is coupled to an adaptive noise cancellation unit 1406 and a desired voice activity detector 1412 (filter control). A main channel signal is output from the beamformer 1405 at 1408*a* and is input into an adaptive noise cancellation unit 1406. Similarly, a reference channel signal is output from the beamformer 1405 at 1410*a* and is input into the adaptive noise cancellation unit 1406. The main channel signal is also output from the beamformer 1405 and is input into the desired voice activity detector 1412 at 1408*b*. Similarly, the reference channel signal is output from the beamformer 1405 and is input into the desired voice activity detector 1412 at 1410*b*. Optionally, a second reference channel signal is output at 1409*a* from the beam former 1405 and is input to the adaptive noise cancellation unit 1406, and the second reference channel signal is output at 1409*b* from the beam former 1405 and is input to the desired vice activity detector 1412.

The desired voice activity detector 1412 uses input 1408*b*, 1410*b*, and optionally 1409*b* to produce filter control signal 1414 for the adaptive noise cancellation unit 1408 and filter control signal 1416 for a single channel noise reduction unit 1418. The adaptive noise cancellation unit 1406 provides multi-channel filtering and filters a first amount of undesired audio from the main channel 1408*a* during a first stage of filtering to output a filtered main channel at 1407. The single channel noise reduction unit 1418 receives as an input the filtered main channel 1407 and provides a second stage of filtering, thereby further reducing undesired audio from 1407. The single channel noise reduction unit 1418 outputs mostly desired audio at 1420

The desired voice activity detector 1412 provides a control signal 1422 for an auto-balancing unit 1424. The auto-balancing unit 1424 is coupled at 1426 to the signal path from the first microphone 1402. The auto-balancing unit 1424 is also coupled at 1428 to the signal path from the second microphone 1404. Optionally, the auto-balancing unit 1424 is also coupled at 1429 to the signal path from the third microphone 1404*b*. The auto-balancing unit 1424 balances the microphone response to far field signals over the operating life of the system. Keeping the microphone channels balanced increases the performance of the system and maintains a high level of performance by preventing drift of microphone sensitivities. The auto-balancing unit is described more fully below in conjunction with the figures that follow.

Figure 14B:
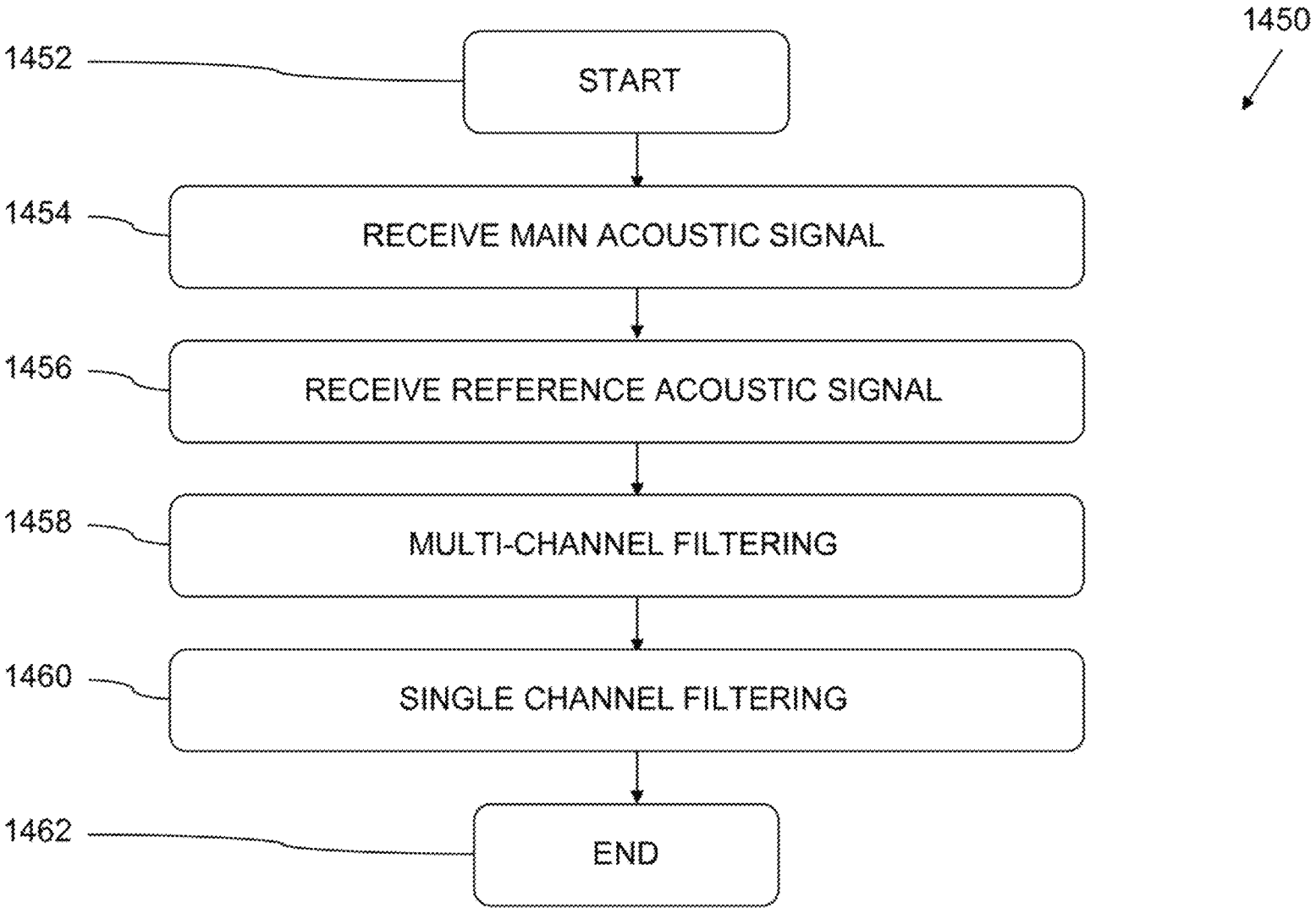
FIG. 14B illustrates processes for noise reduction, according to embodiments of the invention.

FIG. 14B illustrates, generally at 1450, processes for noise reduction, according to embodiments of the invention. With reference to FIG. 14B, a process begins at a block 1452. At a block 1454 a main acoustic signal is received by a system. The main acoustic signal can be for example, in various embodiments such a signal as is represented by 1102 (FIG. 11), 1302/1308*a*/1308*b* (FIG. 13), or 1402/1408*a*/1408*b* (FIG. 14A). At a block 1456 a reference acoustic signal is received by the system. The reference acoustic signal can be for example, in various embodiments such a signal as is represented by 1104 and optionally 1104*b* (FIG. 11), 1304/1310*a*/1310*b* and optionally 1304*b*/1311*a*/1311*b* (FIG. 13), or 1404/1410*a*/1410*b* and optionally 1404*b*/1409*a*/1409*b* (FIG. 14A). At a block 1458 adaptive filtering is performed with multiple channels of input, such as using for example the adaptive filter unit 1106 (FIG. 11), 1306 (FIG. 13), and 1406 (FIG. 14A) to provide a filtered acoustic signal for example as shown at 1107 (FIG. 11), 1307 (FIG. 13), and 1407 (FIG. 14A). At a block 1460 a single channel unit is used to filter the filtered acoustic signal which results from the process of the block 1458. The single channel unit can be for example, in various embodiments, such a unit as is represented by 1118 (FIG. 11), 1318 (FIG. 13), or 1418 (FIG. 14A). The process ends at a block 1462.

In various embodiments, the adaptive noise cancellation unit, such as 1106 (FIG. 11), 1306 (FIG. 13), and 1406 (FIG. 14A) is implemented in an integrated circuit device, which may include an integrated circuit package containing the integrated circuit. In some embodiments, the adaptive noise cancellation unit 1106 or 1306 or 1406 is implemented in a single integrated circuit die. In other embodiments, the adaptive noise cancellation unit 1106 or 1306 or 1406 is implemented in more than one integrated circuit die of an integrated circuit device which may include a multi-chip package containing the integrated circuit.

In various embodiments, the single channel noise cancellation unit, such as 1018 (FIG. 11), 1318 (FIG. 13), and 1418 (FIG. 14A) is implemented in an integrated circuit device, which may include an integrated circuit package containing the integrated circuit. In some embodiments, the single channel noise cancellation unit 1118 or 1318 or 1418 is implemented in a single integrated circuit die. In other embodiments, the single channel noise cancellation unit 1118 or 1318 or 1418 is implemented in more than one integrated circuit die of an integrated circuit device which may include a multi-chip package containing the integrated circuit.

In various embodiments, the filter control, such as 1112 (FIGS. 11 & 12) or 1312 (FIG. 13) is implemented in an integrated circuit device, which may include an integrated circuit package containing the integrated circuit. In some embodiments, the filter control 1112 or 1312 is implemented in a single integrated circuit die. In other embodiments, the filter control 1112 or 1312 is implemented in more than one integrated circuit die of an integrated circuit device which may include a multi-chip package containing the integrated circuit.

In various embodiments, the beamformer, such as 1305 (FIG. 13) or 1405 (FIG. 14A) is implemented in an integrated circuit device, which may include an integrated circuit package containing the integrated circuit. In some embodiments, the beamformer 1305 or 1405 is implemented in a single integrated circuit die. In other embodiments, the beamformer 1305 or 1405 is implemented in more than one integrated circuit die of an integrated circuit device which may include a multi-chip package containing the integrated circuit.

Figure 15A:
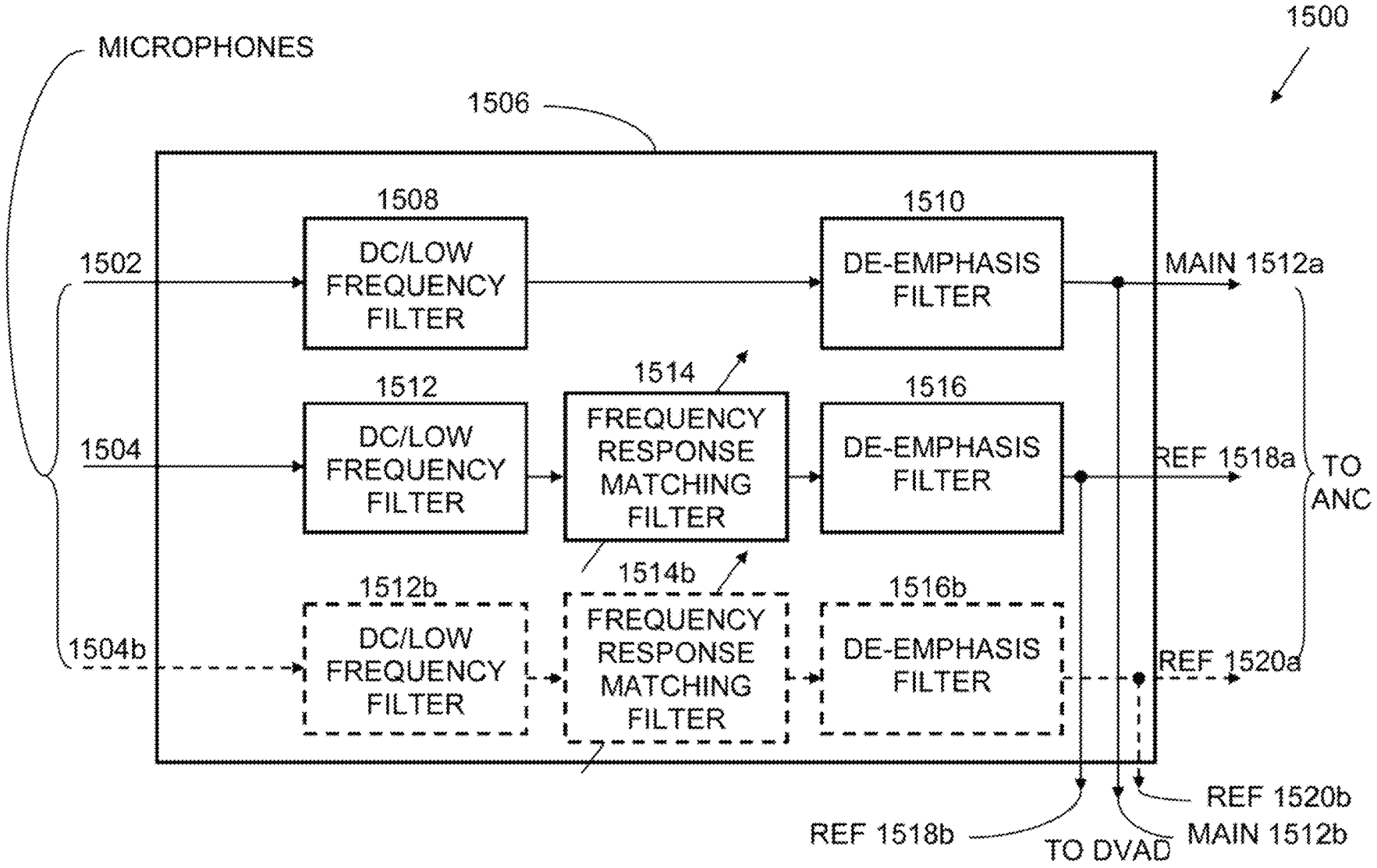
FIG. 15A illustrates beamforming according to embodiments of the invention.

FIG. 15A illustrates, generally at 1500, beamforming according to embodiments of the invention. With reference to FIG. 15A, a beamforming block 1506 is applied to two microphone inputs 1502 and 1504. In one or more embodiments, the microphone input 1502 can originate from a first directional microphone and the microphone input 1504 can originate from a second directional microphone or microphone signals 1502 and 1504 can originate from omni-directional microphones. In yet other embodiments, microphone signals 1502 and 1504 are provided by the outputs of a bi-directional pressure gradient microphone. Various directional microphones can be used, such as but not limited to, microphones having a cardioid beam pattern, a dipole beam pattern, an omni-directional beam pattern, or a user defined beam pattern. In some embodiments, one or more acoustic elements are configured to provide the microphone input 1502 and 1504.

In various embodiments, beamforming block 1506 includes a filter 1508. Depending on the type of microphone used and the specific application, the filter 1508 can provide a direct current (DC) blocking filter which filters the DC and very low frequency components of Microphone input 1502. Following the filter 1508, in some embodiments additional filtering is provided by a filter 1510. Some microphones have non-flat responses as a function of frequency. In such a case, it can be desirable to flatten the frequency response of the microphone with a de-emphasis filter. The filter 1510 can provide de-emphasis, thereby flattening a microphone's frequency response. Following de-emphasis filtering by the filter 1510, a main microphone channel is supplied to the adaptive noise cancellation unit at 1512*a* and the desired voice activity detector at 1512*b*.

A microphone input 1504 is input into the beamforming block 1506 and in some embodiments is filtered by a filter 1512. Depending on the type of microphone used and the specific application, the filter 1512 can provide a direct current (DC) blocking filter which filters the DC and very low frequency components of Microphone input 1504. A filter 1514 filters the acoustic signal which is output from the filter 1512. The filter 1514 adjusts the gain, phase, and can also shape the frequency response of the acoustic signal. Following the filter 1514, in some embodiments additional filtering is provided by a filter 1516. Some microphones have non-flat responses as a function of frequency. In such a case, it can be desirable to flatten the frequency response of the microphone with a de-emphasis filter. The filter 1516 can provide de-emphasis, thereby flattening a microphone's frequency response. Following de-emphasis filtering by the filter 1516, a reference microphone channel is supplied to the adaptive noise cancellation unit at 1518*a* and to the desired voice activity detector at 1518*b*.

Optionally, a third microphone channel is input at 1504*b* into the beamforming block 1506. Similar to the signal path described above for the channel 1504, the third microphone channel is filtered by a filter 1512*b*. Depending on the type of microphone used and the specific application, the filter 1512*b* can provide a direct current (DC) blocking filter which filters the DC and very low frequency components of Microphone input 1504*b*. A filter 1514*b* filters the acoustic signal which is output from the filter 1512*b*. The filter 1514*b* adjusts the gain, phase, and can also shape the frequency response of the acoustic signal. Following the filter 1514*b*, in some embodiments additional filtering is provided by a filter 1516*b*. Some microphones have non-flat responses as a function of frequency. In such a case, it can be desirable to flatten the frequency response of the microphone with a de-emphasis filter. The filter 1516*b* can provide de-emphasis, thereby flattening a microphone's frequency response. Following de-emphasis filtering by the filter 1516*b*, a second reference microphone channel is supplied to the adaptive noise cancellation unit at 1520*a* and to the desired voice activity detector at 1520*b*

Figure 15B:
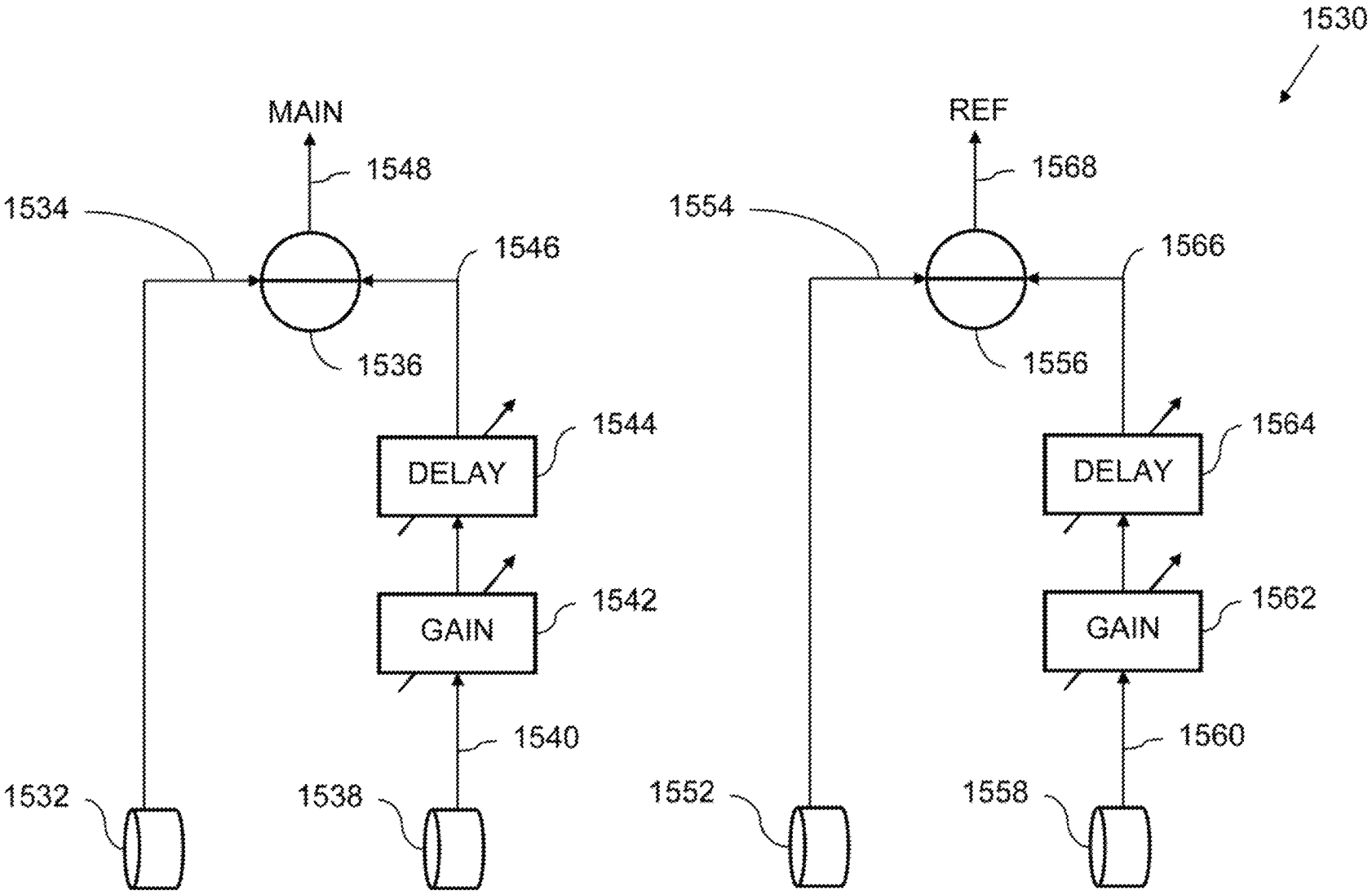
FIG. 15B presents another illustration of beamforming according to embodiments of the invention.

FIG. 15B presents, generally at 1530, another illustration of beamforming according to embodiments of the invention. With reference to FIG. 15B, a beam pattern is created for a main channel using a first microphone 1532 and a second microphone 1538. A signal 1534 output from the first microphone 1532 is input to an adder 1536. A signal 1540 output from the second microphone 1538 has its amplitude adjusted at a block 1542 and its phase adjusted by applying a delay at a block 1544 resulting in a signal 1546 which is input to the adder 1536. The adder 1536 subtracts one signal from the other resulting in output signal 1548. Output signal 1548 has a beam pattern which can take on a variety of forms depending on the initial beam patterns of microphone 1532 and 1538 and the gain applied at 1542 and the delay applied at 1544. By way of non-limiting example, beam patterns can include cardioid, dipole, etc.

A beam pattern is created for a reference channel using a third microphone 1552 and a fourth microphone 1558. A signal 1554 output from the third microphone 1552 is input to an adder 1556. A signal 1560 output from the fourth microphone 1558 has its amplitude adjusted at a block 1562 and its phase adjusted by applying a delay at a block 1564 resulting in a signal 1566 which is input to the adder 1556. The adder 1556 subtracts one signal from the other resulting in output signal 1568. Output signal 1568 has a beam pattern which can take on a variety of forms depending on the initial beam patterns of microphone 1552 and 1558 and the gain applied at 1562 and the delay applied at 1564. By way of non-limiting example, beam patterns can include cardioid, dipole, etc.

Figure 15C:
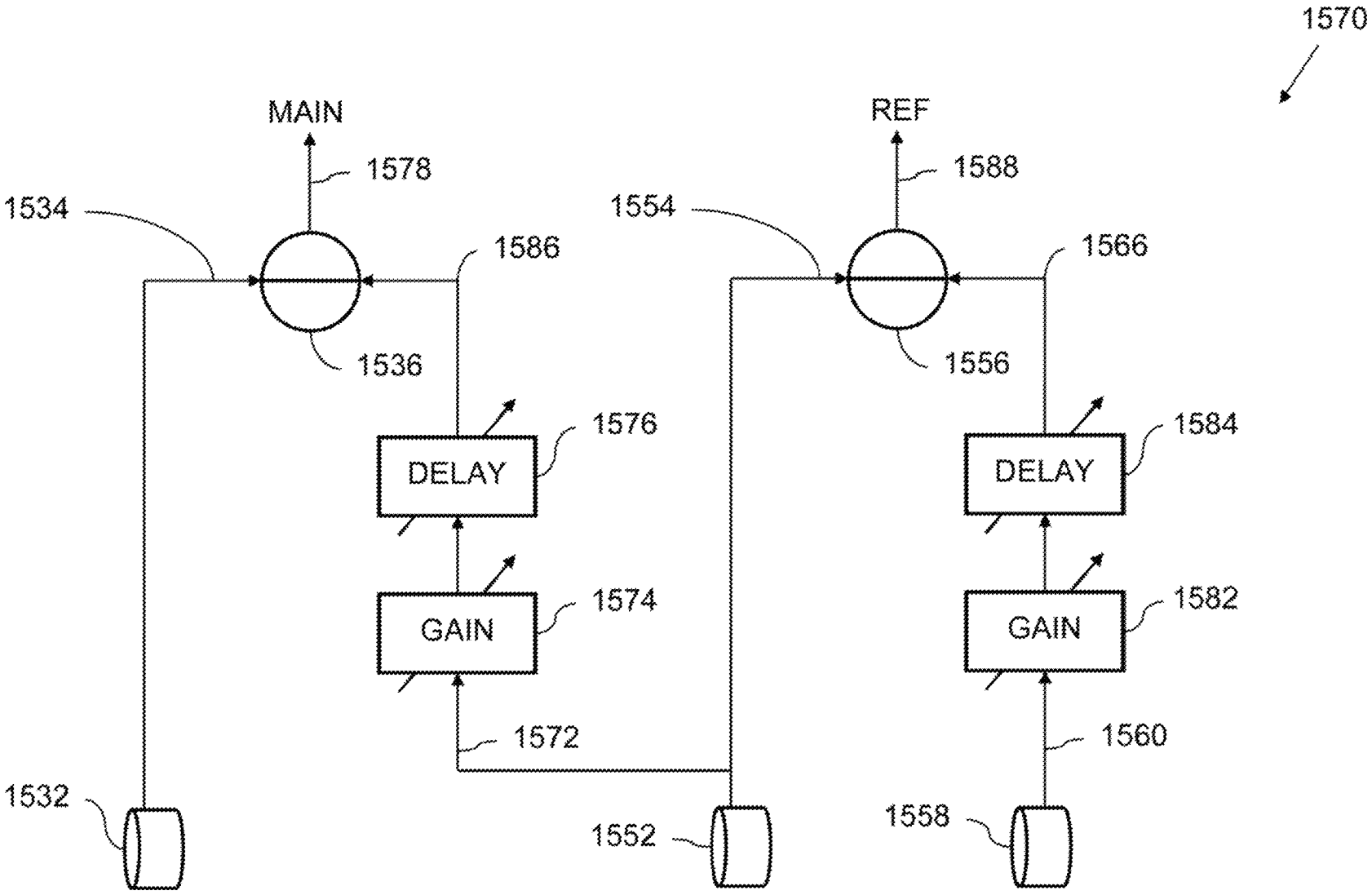
FIG. 15C illustrates beamforming with shared acoustic elements according to embodiments of the invention.

FIG. 15C illustrates, generally at 1570, beamforming with shared acoustic elements according to embodiments of the invention. With reference to FIG. 15C, a microphone 1552 is shared between the main acoustic channel and the reference acoustic channel. The output from microphone 1552 is split and travels at 1572 to gain 1574 and to delay 1576 and is then input at 1586 into the adder 1536. Appropriate gain at 1574 and delay at 1576 can be selected to achieve equivalently an output 1578 from the adder 1536 which is equivalent to the output 1548 from adder 1536 (FIG. 15B). Similarly gain 1582 and delay 1584 can be adjusted to provide an output signal 1588 which is equivalent to 1568 (FIG. 15B). By way of non-limiting example, beam patterns can include cardioid, dipole, etc.

Figure 16:
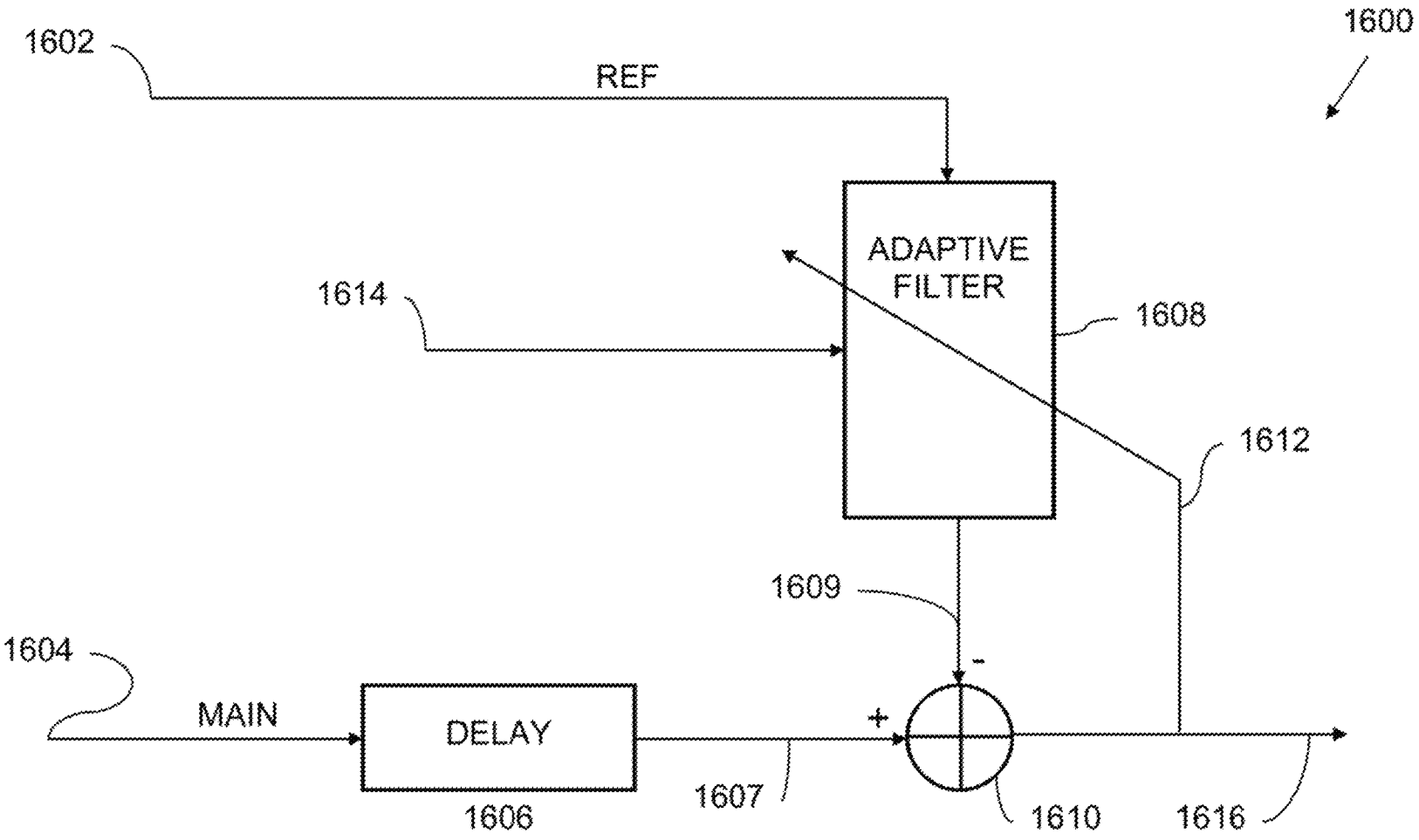
FIG. 16 illustrates multi-channel adaptive filtering according to embodiments of the invention.

FIG. 16 illustrates, generally at 1600, multi-channel adaptive filtering according to embodiments of the invention. With reference to FIG. 16, embodiments of an adaptive filter unit are illustrated with a main channel 1604 (containing a microphone signal) input into a delay element 1606. A reference channel 1602 (containing a microphone signal) is input into an adaptive filter 1608. In various embodiments, the adaptive filter 1608 can be an adaptive FIR filter designed to implement normalized least-mean-square-adaptation (NLMS) or another algorithm. Embodiments of the invention are not limited to NLMS adaptation. The adaptive FIR filter filters an estimate of desired audio from the reference signal 1602. In one or more embodiments, an output 1609 of the adaptive filter 1608 is input into an adder 1610. The delayed main channel signal 1607 is input into the adder 1610 and the output 1609 is subtracted from the delayed main channel signal 1607. The output of the adder 1616 provides a signal containing desired audio with a reduced amount of undesired audio.

Many environments that acoustic systems employing embodiments of the invention are used in present reverberant conditions. Reverberation results in a form of noise and contributes to the undesired audio which is the object of the filtering and signal extraction described herein. In various embodiments, the two channel adaptive FIR filtering represented at 1600 models the reverberation between the two channels and the environment they are used in. Thus, undesired audio propagates along the direct path and the reverberant path requiring the adaptive FIR filter to model the impulse response of the environment. Various approximations of the impulse response of the environment can be made depending on the degree of precision needed. In one non-limiting example, the amount of delay is approximately equal to the impulse response time of the environment. In another non-limiting example, the amount of delay is greater than an impulse response of the environment. In one embodiment, an amount of delay is approximately equal to a multiple n of the impulse response time of the environment, where n can equal 2 or 3 or more for example. Alternatively, an amount of delay is not an integer number of impulse response times, such as for example, 0.5, 1.4, 2.75, etc. For example, in one embodiment, the filter length is approximately equal to twice the delay chosen for 1606. Therefore, if an adaptive filter having 200 taps is used, the length of the delay 1606 would be approximately equal to a time delay of 100 taps. A time delay equivalent to the propagation time through 100 taps is provided merely for illustration and does not imply any form of limitation to embodiments of the invention.

Embodiments of the invention can be used in a variety of environments which have a range of impulse response times. Some examples of impulse response times are given as non-limiting examples for the purpose of illustration only and do not limit embodiments of the invention. For example, an office environment typically has an impulse response time of approximately 100 milliseconds to 200 milliseconds. The interior of a vehicle cabin can provide impulse response times ranging from 30 milliseconds to 60 milliseconds. In general, embodiments of the invention are used in environments whose impulse response times can range from several milliseconds to 500 milliseconds or more.

The adaptive filter unit 1600 is in communication at 1614 with inhibit logic such as inhibit logic 1214 and filter control signal 1114 (FIG. 12). Signals 1614 controlled by inhibit logic 1214 are used to control the filtering performed by the filter 1608 and adaptation of the filter coefficients. An output 1616 of the adaptive filter unit 1600 is input to a single channel noise cancellation unit such as those described above in the preceding figures, for example; 1118 (FIG. 11), 1318 (FIG. 13), and 1418 (FIG. 14A). A first level of undesired audio has been extracted from the main acoustic channel resulting in the output 1616. Under various operating conditions the level of the noise, i.e., undesired audio can be very large relative to the signal of interest, i.e., desired audio. Embodiments of the invention are operable in conditions where some difference in signal-to-noise ratio between the main and reference channels exists. In some embodiments, the differences in signal-to-noise ratio are on the order of 1 decibel (dB) or less. In other embodiments, the differences in signal-to-noise ratio are on the order of 1 decibel (dB) or more. The output 1616 is filtered additionally to reduce the amount of undesired audio contained therein in the processes that follow using a single channel noise reduction unit.

Inhibit logic, described in FIG. 12 above including signal 1614 (FIG. 16) provide for the substantial non-operation of filter 1608 and no adaptation of the filter coefficients when either the main or the reference channels are determined to be inactive. In such a condition, the signal present on the main channel 1604 is output at 1616.

If the main channel and the reference channels are active and desired audio is detected or a pause threshold has not been reached then adaptation is disabled, with filter coefficients frozen, and the signal on the reference channel 1602 is filtered by the filter 1608 subtracted from the main channel 1607 with adder 1610 and is output at 1616.

If the main channel and the reference channel are active and desired audio is not detected and the pause threshold (also called pause time) is exceeded then filter coefficients are adapted. A pause threshold is application dependent. For example, in one non-limiting example, in the case of Automatic Speech Recognition (ASR) the pause threshold can be approximately a fraction of a second.

Figure 17:
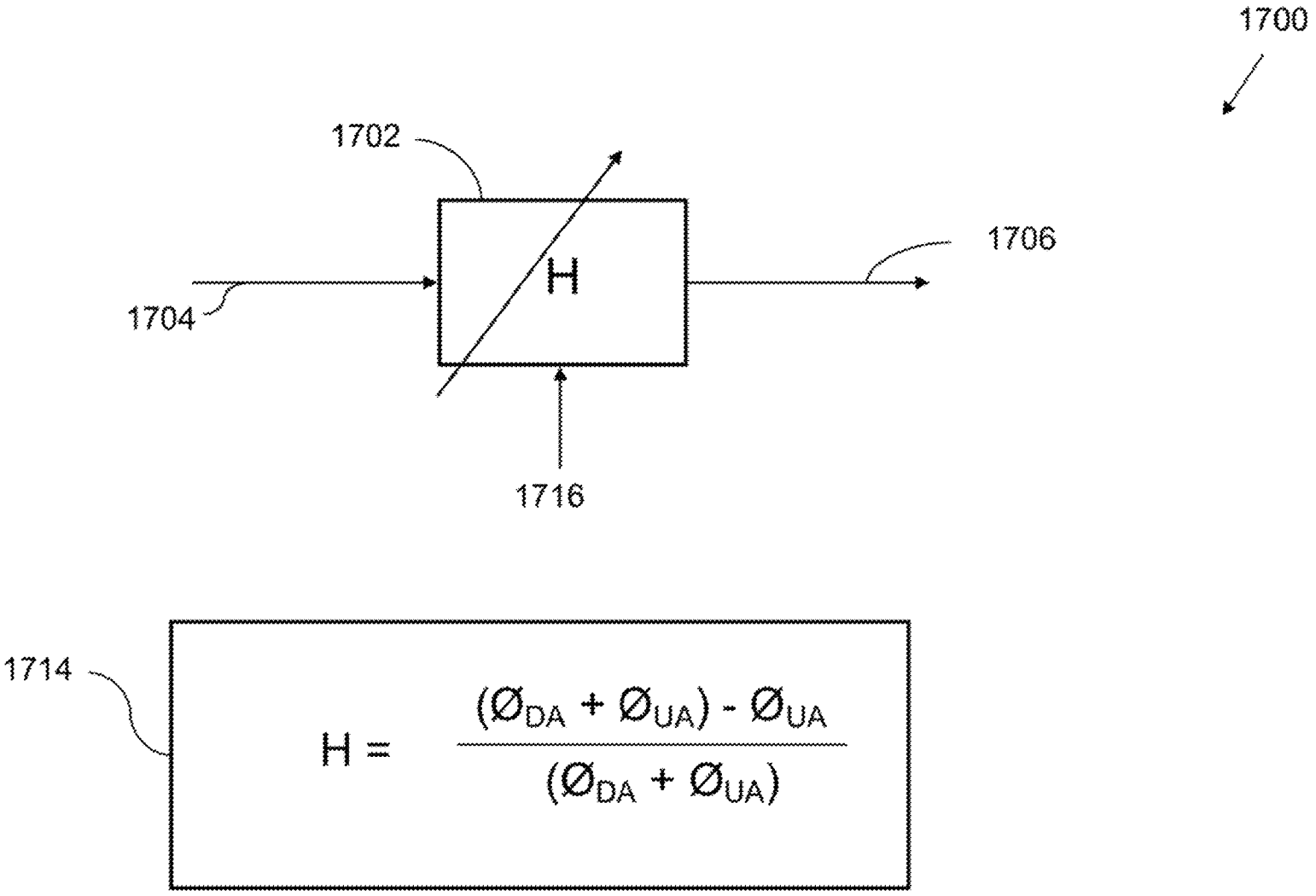
FIG. 17 illustrates single channel filtering according to embodiments of the invention.

FIG. 17 illustrates, generally at 1700, single channel filtering according to embodiments of the invention. With reference to FIG. 17, a single channel noise reduction unit utilizes a linear filter having a single channel input. Examples of filters suitable for use therein are a Weiner filter, a filter employing Minimum Mean Square Error (MMSE), etc. An output from an adaptive noise cancellation unit (such as one described above in the preceding figures) is input at 1704 into a filter 1702. The input signal 1704 contains desired audio and a noise component, i.e., undesired audio, represented in equation 1714 as the total power ($Ø_{DA}$+$Ø_{UA}$). The filter 1702 applies the equation shown at 1714 to the input signal 1704. An estimate for the total power ($Ø_{DA}$+$Ø_{UA}$) is one term in the numerator of equation 1714 and is obtained from the input to the filter 1704. An estimate for the noise $Ø_{UA}$, i.e., undesired audio, is obtained when desired audio is absent from signal 1704. The noise estimate $Ø_{UA}$ is the other term in the numerator, which is subtracted from the total power ($Ø_{DA}$+$Ø_{UA}$). The total power is the term in the denominator of equation 1714. The estimate of the noise $Ø_{UA}$ (obtained when desired audio is absent) is obtained from the input signal 1704 as informed by signal 1716 received from inhibit logic, such as inhibit logic 1214 (FIG. 12) which indicates when desired audio is present as well as when desired audio is not present. The noise estimate is updated when desired audio is not present on signal 1704. When desired audio is present, the noise estimate is frozen and the filtering proceeds with the noise estimate previously established during the last interval when desired audio was not present.

Figure 18A:
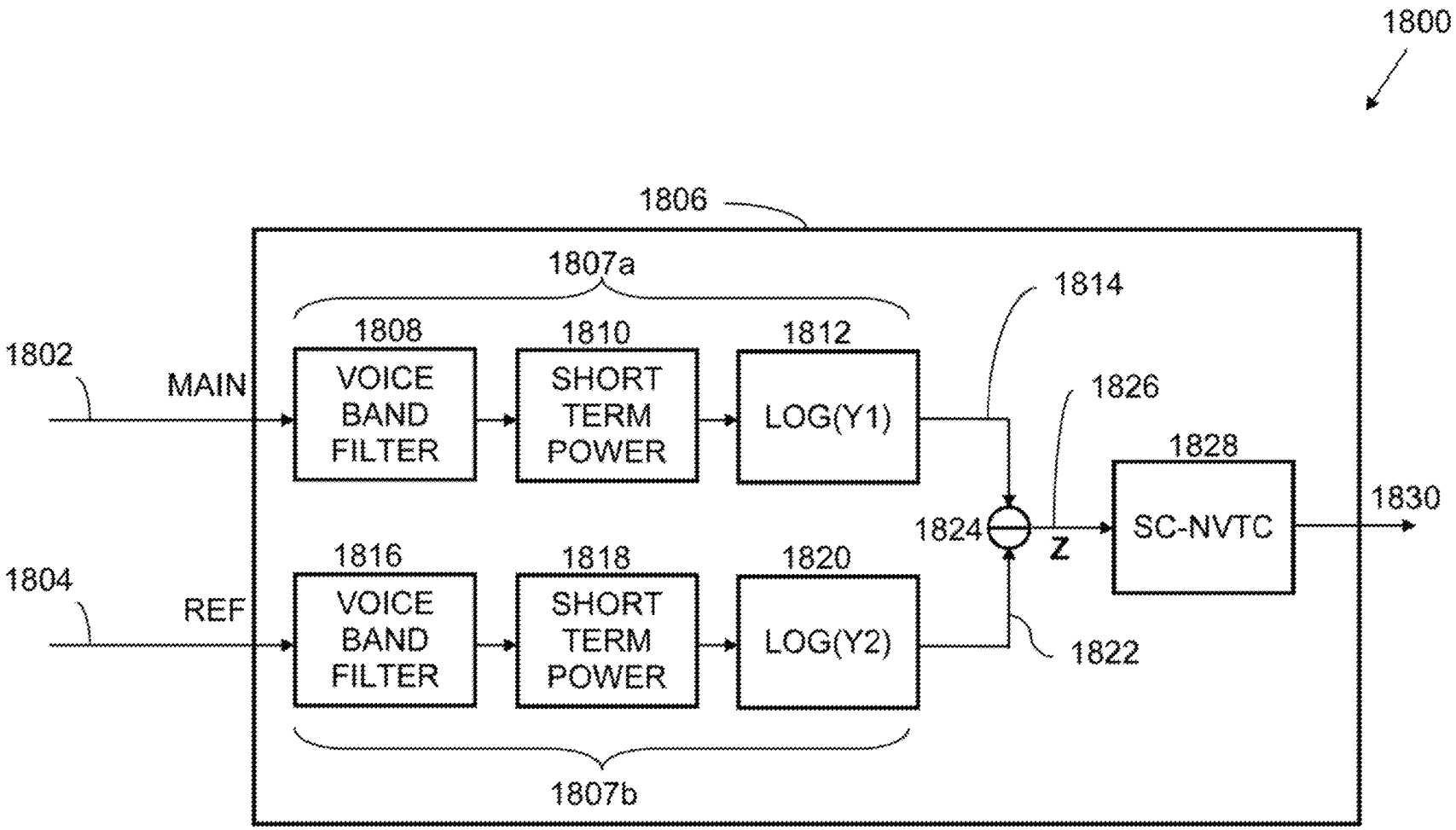
FIG. 18A illustrates desired voice activity detection according to embodiments of the invention.

FIG. 18A illustrates, generally at 1800, desired voice activity detection according to embodiments of the invention. With reference to FIG. 18A, a dual input desired voice detector is shown at 1806. Acoustic signals from a main channel are input at 1802, from for example, a beamformer or from a main acoustic channel as described above in conjunction with the previous figures, to a first signal path 1807*a* of the dual input desired voice detector 1806. The first signal path 1807*a* includes a voice band filter 1808. The voice band filter 1808 captures the majority of the desired voice energy in the main acoustic channel 1802. In various embodiments, the voice band filter 1808 is a band-pass filter characterized by a lower corner frequency an upper corner frequency and a roll-off from the upper corner frequency. In various embodiments, the lower corner frequency can range from 50 to 300 I-Hz depending on the application. For example, in wide band telephony, a lower corner frequency is approximately 50 Hz. In standard telephony the lower corner frequency is approximately 300 Hz. The upper corner frequency is chosen to allow the filter to pass a majority of the speech energy picked up by a relatively flat portion of the microphone's frequency response. Thus, the upper corner frequency can be placed in a variety of locations depending on the application. A non-limiting example of one location is 2,500 Hz. Another non-limiting location for the upper corner frequency is 4,000 Hz.

The first signal path 1807*a* includes a short-term power calculator 1810. Short-term power calculator 1810 is implemented in various embodiments as a root mean square (RMS) measurement, a power detector, an energy detector, etc. Short-term power calculator 1810 can be referred to synonymously as a short-time power calculator 1810. The short-term power detector 1810 calculates approximately the instantaneous power in the filtered signal. The output of the short-term power detector 1810 (Y1) is input into a signal compressor 1812. In various embodiments compressor 1812 converts the signal to the $Log_2$ domain, $Log_{10}$ domain, etc. In other embodiments, the compressor 1812 performs a user defined compression algorithm on the signal Y1.

Similar to the first signal path described above, acoustic signals from a reference acoustic channel are input at 1804, from for example, a beamformer or from a reference acoustic channel as described above in conjunction with the previous figures, to a second signal path 1807*b* of the dual input desired voice detector 1806. The second signal path 1807*b* includes a voice band filter 1816. The voice band filter 1816 captures the majority of the desired voice energy in the reference acoustic channel 1804. In various embodiments, the voice band filter 1816 is a band-pass filter characterized by a lower corner frequency an upper corner frequency and a roll-off from the upper corner frequency as described above for the first signal path and the voice-band filter 1808.

The second signal path 1807*b* includes a short-term power calculator 1818. Short-term power calculator 1818 is implemented in various embodiments as a root mean square (RMS) measurement, a power detector, an energy detector, etc. Short-term power calculator 1818 can be referred to synonymously as a short-time power calculator 1818. The short-term power detector 1818 calculates approximately the instantaneous power in the filtered signal. The output of the short-term power detector 1818 (Y2) is input into a signal compressor 1820. In various embodiments compressor 1820 converts the signal to the $Log_2$ domain, $Log_{10}$ domain, etc. In other embodiments, the compressor 1820 performs a user defined compression algorithm on the signal Y2.

The compressed signal from the second signal path 1822 is subtracted from the compressed signal from the first signal path 1814 at a subtractor 1824, which results in a normalized main signal at 1826 (Z). In other embodiments, different compression functions are applied at 1812 and 1820 which result in different normalizations of the signal at 1826. In other embodiments, a division operation can be applied at 1824 to accomplish normalization when logarithmic compression is not implemented. Such as for example when compression based on the square root function is implemented.

The normalized main signal 1826 is input to a single channel normalized voice threshold comparator (SC-NVTC) 1828, which results in a normalized desired voice activity detection signal 1830. Note that the architecture of the dual channel voice activity detector provides a detection of desired voice using the normalized desired voice activity detection signal 1830 that is based on an overall difference in signal-to-noise ratios for the two input channels. Thus, the normalized desired voice activity detection signal 1830 is based on the integral of the energy in the voice band and not on the energy in particular frequency bins, thereby maintaining linearity within the noise cancellation units described above. The compressed signals 1814 and 1822, utilizing logarithmic compression, provide an input at 1826 (Z) which has a noise floor that can take on values that vary from below zero to above zero (see column 1895*c*, column 1895*d*, or column 1895*e* FIG. 18E below), unlike an uncompressed single channel input which has a noise floor which is always above zero (see column 1895*b* FIG. 18E below).

Figure 18B:
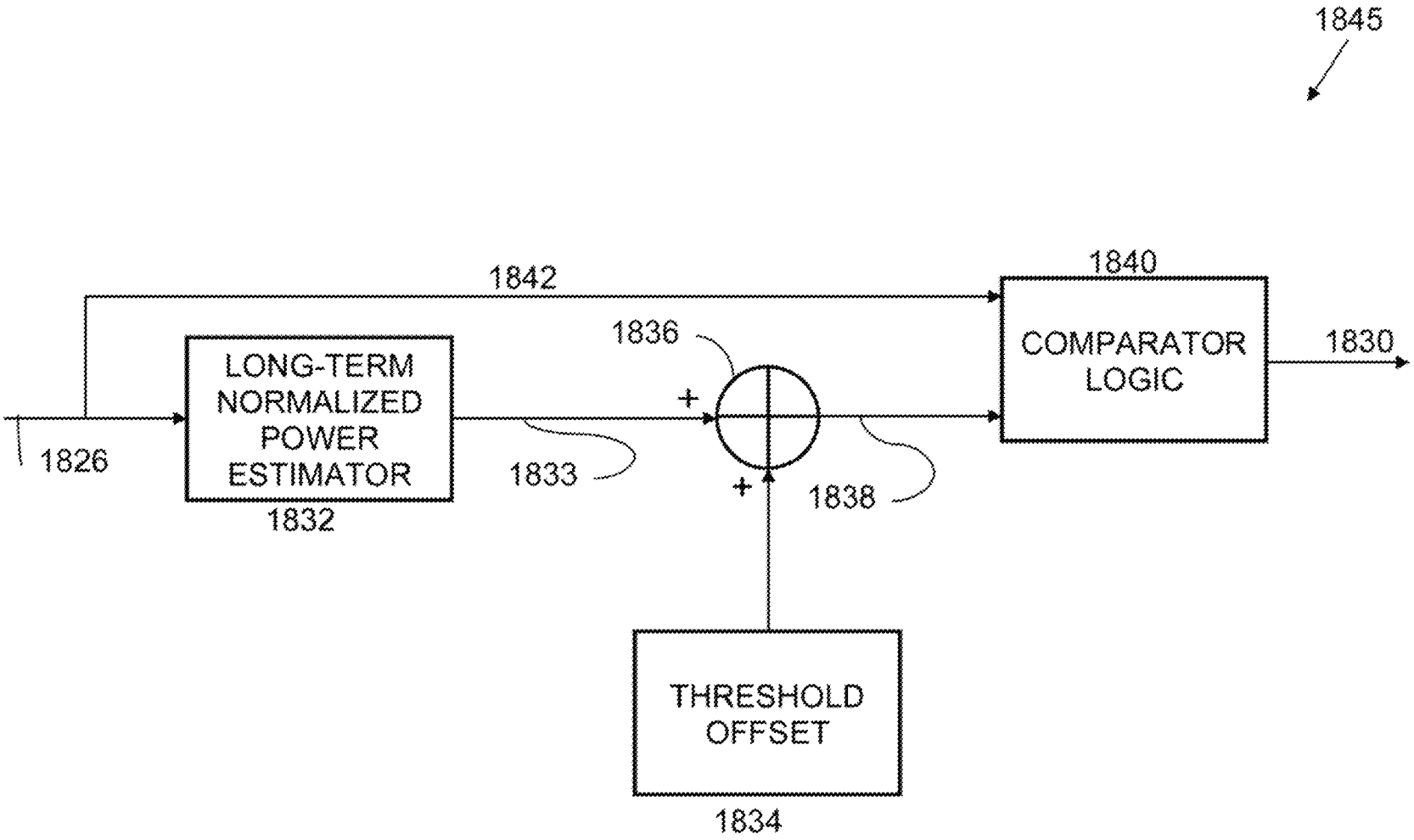
FIG. 18B illustrates a normalized voice threshold comparator according to embodiments of the invention.

FIG. 18B illustrates, generally at 1845, a single channel normalized voice threshold comparator (SC-NVTC) according to embodiments of the invention. With reference to FIG. 18B, a normalized main signal 1826 is input into a long-term normalized power estimator 1832. The long-term normalized power estimator 1832 provides a running estimate of the normalized main signal 1826. The running estimate provides a floor for desired audio. An offset value 1834 is added in an adder 1836 to a running estimate of the output of the long-term normalized power estimator 1832. The output of the adder 1838 is input to comparator 1840. An instantaneous estimate 1842 of the normalized main signal 1826 is input to the comparator 1840. The comparator 1840 contains logic that compares the instantaneous value at 1842 to the running ratio plus offset at 1838. If the value at 1842 is greater than the value at 1838, desired audio is detected and a flag is set accordingly and transmitted as part of the normalized desired voice activity detection signal 1830. If the value at 1842 is less than the value at 1838 desired audio is not detected and a flag is set accordingly and transmitted as part of the normalized desired voice activity detection signal 1830. The long-term normalized power estimator 1832 averages the normalized main signal 1826 for a length of time sufficiently long in order to slow down the change in amplitude fluctuations. Thus, amplitude fluctuations are slowly changing at 1833. The averaging time can vary from a fraction of a second to minutes, by way of non-limiting examples. In various embodiments, an averaging time is selected to provide slowly changing amplitude fluctuations at the output of 1832.

Figure 18C:
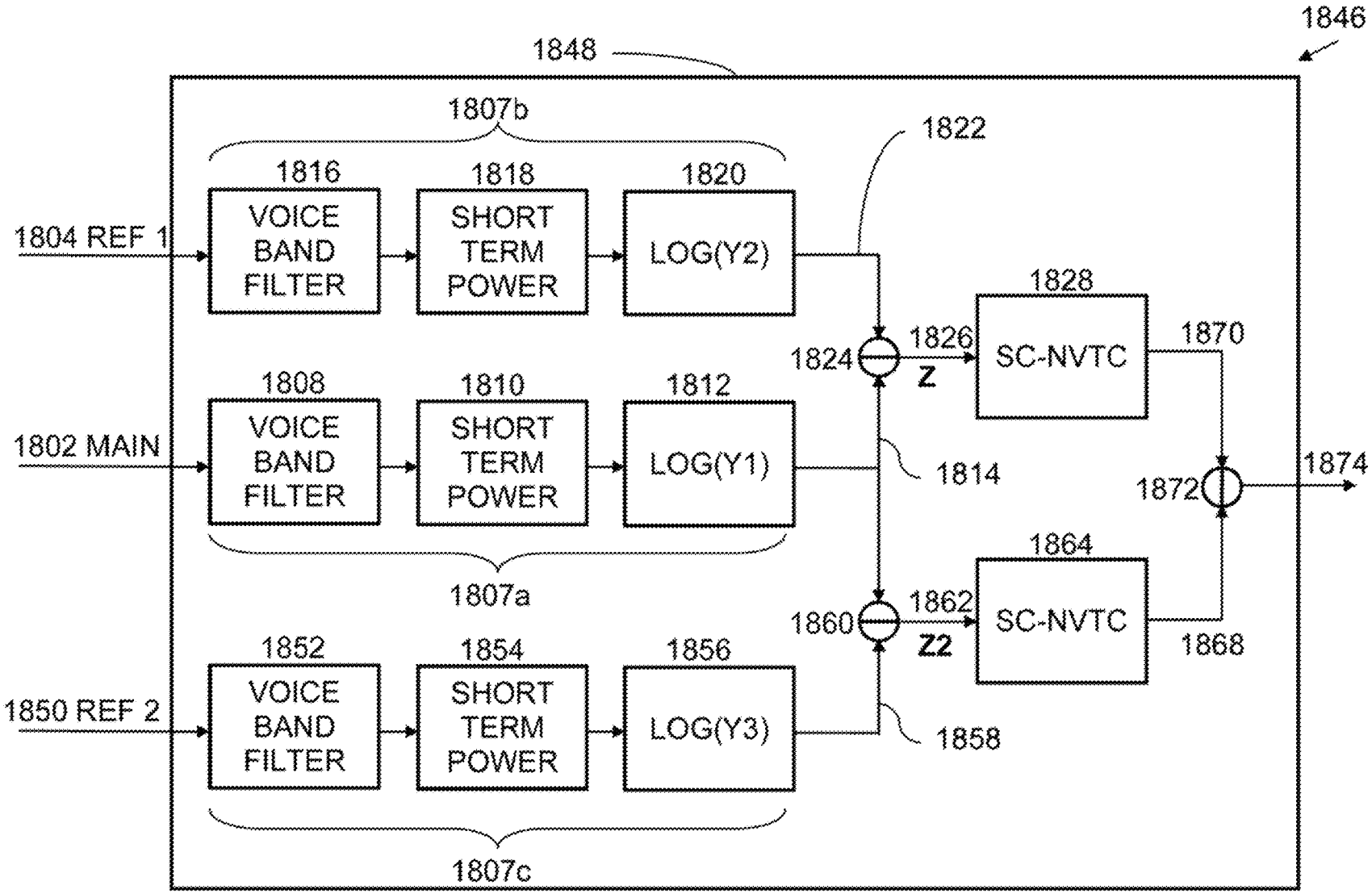
FIG. 18C illustrates desired voice activity detection utilizing multiple reference channels, according to embodiments of the invention.

FIG. 18C illustrates, generally at 1846, desired voice activity detection utilizing multiple reference channels, according to embodiments of the invention. With reference to FIG. 18C, a desired voice detector is shown at 1848. The desired voice detector 1848 includes as an input the main channel 1802 and the first signal path 1807*a* (described above in conjunction with FIG. 18A) together with the reference channel 1804 and the second signal path 1807*b* (also described above in conjunction with FIG. 18A). In addition thereto, is a second reference acoustic channel 1850 which is input into the desired voice detector 1848 and is part of a third signal path 1807*c*. Similar to the second signal path 1807*b* (described above), acoustic signals from the second reference acoustic channel are input at 1850, from for example, a beamformer or from a second reference acoustic channel as described above in conjunction with the previous figures, to a third signal path 1807*c* of the multi-input desired voice detector 1848. The third signal path 1807*c* includes a voice band filter 1852. The voice band filter 1852 captures the majority of the desired voice energy in the second reference acoustic channel 1850. In various embodiments, the voice band filter 1852 is a band-pass filter characterized by a lower corner frequency an upper corner frequency and a roll-off from the upper corner frequency as described above for the second signal path and the voice-band filter 1808.

The third signal path 1807*c* includes a short-term power calculator 1854. Short-term power calculator 1854 is implemented in various embodiments as a root mean square (RMS) measurement, a power detector, an energy detector, etc. Short-term power calculator 1854 can be referred to synonymously as a short-time power calculator 1854. The short-term power detector 1854 calculates approximately the instantaneous power in the filtered signal. The output of the short-term power detector 1854 is input into a signal compressor 1856. In various embodiments compressor 1856 converts the signal to the $Log_2$ domain, $Log_{10}$ domain, etc. In other embodiments, the compressor 1854 performs a user defined compression algorithm on the signal Y3.

The compressed signal from the third signal path 1858 is subtracted from the compressed signal from the first signal path 1814 at a subtractor 1860, which results in a normalized main signal at 1862 (Z2). In other embodiments, different compression functions are applied at 1856 and 1812 which result in different normalizations of the signal at 1862. In other embodiments, a division operation can be applied at 1860 when logarithmic compression is not implemented. Such as for example when compression based on the square root function is implemented.

The normalized main signal 1862 is input to a single channel normalized voice threshold comparator (SC-NVTC) 1864, which results in a normalized desired voice activity detection signal 1868. Note that the architecture of the multi-channel voice activity detector provides a detection of desired voice using the normalized desired voice activity detection signal 1868 that is based on an overall difference in signal-to-noise ratios for the two input channels. Thus, the normalized desired voice activity detection signal 1868 is based on the integral of the energy in the voice band and not on the energy in particular frequency bins, thereby maintaining linearity within the noise cancellation units described above. The compressed signals 1814 and 1858, utilizing logarithmic compression, provide an input at 1862 (Z2) which has a noise floor that can take on values that vary from below zero to above zero (see column 1895*c*, column 1895*d*, or column 1895*e* FIG. 18E below), unlike an uncompressed single channel input which has a noise floor which is always above zero (see column 1895*b* FIG. 18E below).

The desired voice detector 1848, having a multi-channel input with at least two reference channel inputs, provides two normalized desired voice activity detection signals 1868 and 1870 which are used to output a desired voice activity signal 1874. In one embodiment, normalized desired voice activity detection signals 1868 and 1870 are input into a logical OR-gate 1872. The logical OR-gate outputs the desired voice activity signal 1874 based on its inputs 1868 and 1870. In yet other embodiments, additional reference channels can be added to the desired voice detector 1848. Each additional reference channel is used to create another normalized main channel which is input into another single channel normalized voice threshold comparator (SC-NVTC) (not shown). An output from the additional single channel normalized voice threshold comparator (SC-NVTC) (not shown) is combined with 1874 via an additional exclusive OR-gate (also not shown) (in one embodiment) to provide the desired voice activity signal which is output as described above in conjunction with the preceding figures. Utilizing additional reference channels in a multi-channel desired voice detector, as described above, results in a more robust detection of desired audio because more information is obtained on the noise field via the plurality of reference channels.

Figure 18D:
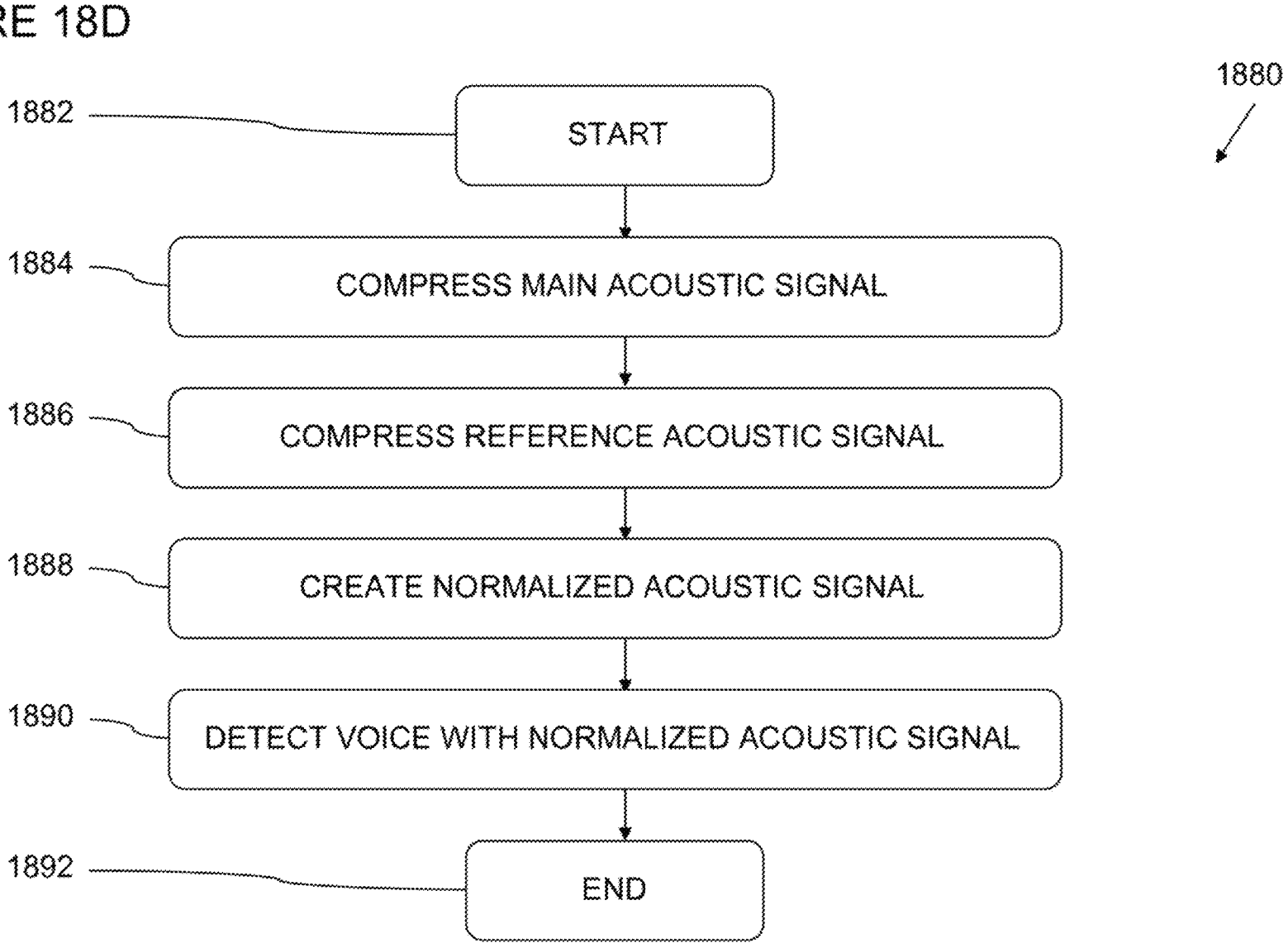
FIG. 18D illustrates a process utilizing compression according to embodiments of the invention.

FIG. 18D illustrates, generally at 1880, a process utilizing compression according to embodiments of the invention. With reference to FIG. 18D, a process starts at a block 1882. At a block 1884 a main acoustic channel is compressed, utilizing for example $Log_{10}$ compression or user defined compression as described in conjunction with FIG. 18A or FIG. 18C. At a block 1886 a reference acoustic signal is compressed, utilizing for example $Log_{10}$ compression or user defined compression as described in conjunction with FIG. 18A or FIG. 18C. At a block 1888 a normalized main acoustic signal is created. At a block 1890 desired voice is detected with the normalized acoustic signal. The process stops at a block 1892.

FIG. 18E illustrates, generally at 1893, different functions to provide compression according to embodiments of the invention. With reference to FIG. 18E, a table 1894 presents several compression functions for the purpose of illustration, no limitation is implied thereby. Column 1895*a* contains six sample values for a variable X. In this example, variable X takes on values as shown at 1896 ranging from 0.01 to 1000.0. Column 1895*b* illustrates no compression where Y=X. Column 1895*c* illustrates Log base 10 compression where the compressed value Y=Log 10(X). Column 1895*d* illustrates ln(X) compression where the compressed value Y=ln(X). Column 1895*e* illustrates Log base 2 compression where Y=Log 2(X). A user defined compression (not shown) can also be implemented as desired to provide more or less compression than 1895*c*, 1895*d*, or 1895*e*. Utilizing a compression function at 1812 and 1820 (FIG. 15A) to compress the result of the short-term power detectors 1810 and 1818 reduces the dynamic range of the normalized main signal at 1826 (Z) which is input into the single channel normalized voice threshold comparator (SC-NVTC) 1828. Similarly utilizing a compression function at 1812, 1820 and 1856 (FIG. 18C) to compress the results of the short-term power detectors 1810, 1818, and 1854 reduces the dynamic range of the normalized main signals at 1826 (Z) and 1862 (Z2) which are input into the SC-NVTC 828 and SC-NVTC 864 respectively. Reduced dynamic range achieved via compression can result in more accurately detecting the presence of desired audio and therefore a greater degree of noise reduction can be achieved by the embodiments of the invention presented herein.

In various embodiments, the components of the multi-input desired voice detector, such as shown in FIG. 18A, FIG. 18B, FIG. 18C, FIG. 18D, and FIG. 18E are implemented in an integrated circuit device, which may include an integrated circuit package containing the integrated circuit. In some embodiments, the multi-input desired voice detector is implemented in a single integrated circuit die. In other embodiments, the multi-input desired voice detector is implemented in more than one integrated circuit die of an integrated circuit device which may include a multi-chip package containing the integrated circuit.

Figure 19A:
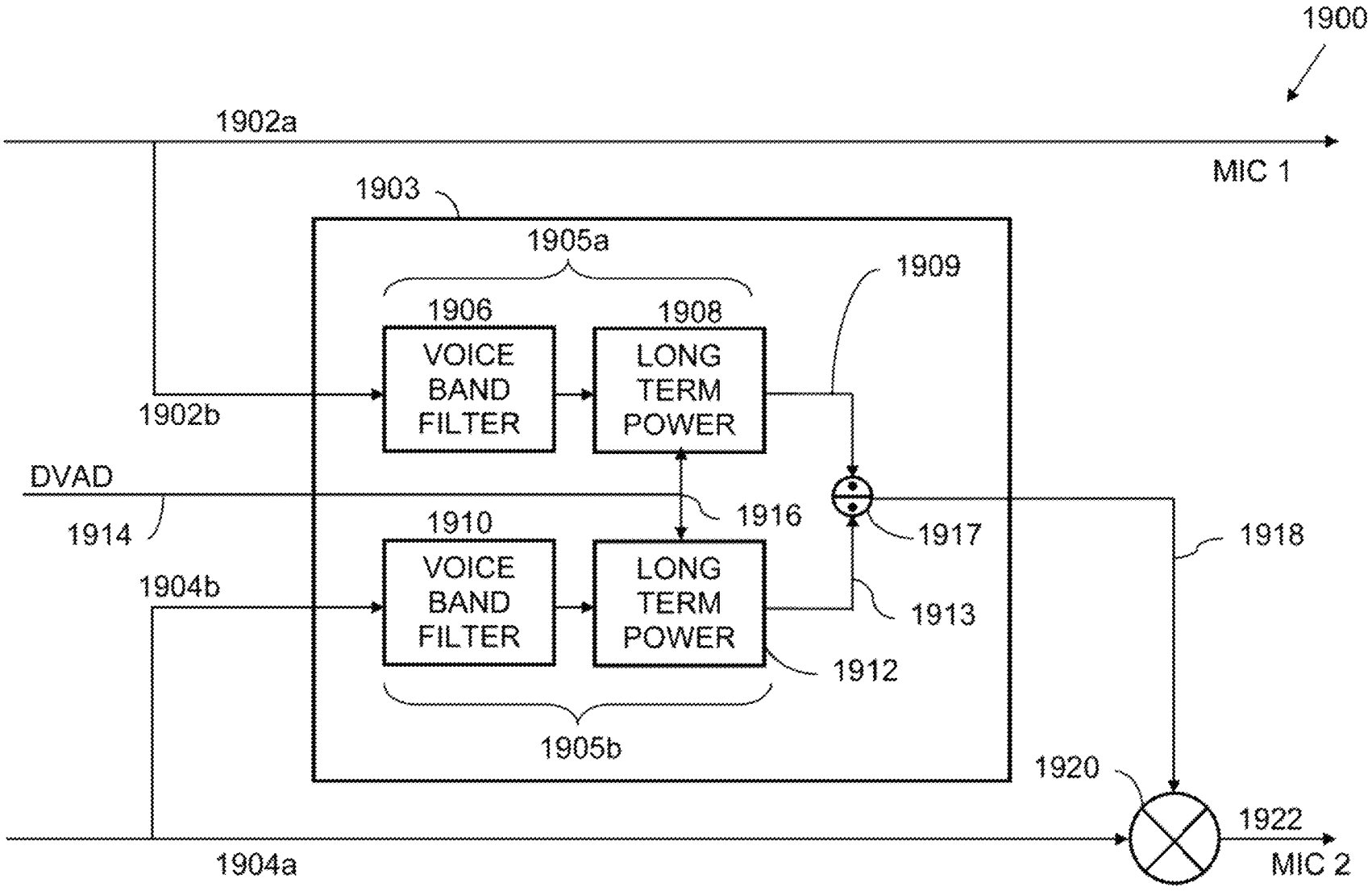
FIG. 19A illustrates an auto-balancing architecture according to embodiments of the invention.

FIG. 19A illustrates, generally at 1900, an auto-balancing architecture according to embodiments of the invention. With reference to FIG. 19A, an auto-balancing component 1903 has a first signal path 1905*a* and a second signal path 1905*b*. A first acoustic channel 1902*a* (MIC 1) is coupled to the first signal path 1905*a* at 1902*b*. A second acoustic channel 1904*a* is coupled to the second signal path 1905*b* at 1904*b*. Acoustic signals are input at 1902*b* into a voice-band filter 1906. The voice band filter 1906 captures the majority of the desired voice energy in the first acoustic channel 1902*a*. In various embodiments, the voice band filter 1906 is a band-pass filter characterized by a lower corner frequency an upper corner frequency and a roll-off from the upper corner frequency. In various embodiments, the lower corner frequency can range from 50 to 300 Hz depending on the application. For example, in wide band telephony, a lower corner frequency is approximately 50 Hz. In standard telephony the lower corner frequency is approximately 300 Hz. The upper corner frequency is chosen to allow the filter to pass a majority of the speech energy picked up by a relatively flat portion of the microphone's frequency response. Thus, the upper corner frequency can be placed in a variety of locations depending on the application. A non-limiting example of one location is 2,500 Hz. Another non-limiting location for the upper corner frequency is 4,000 Hz.

The first signal path 1905*a* includes a long-term power calculator 1908. Long-term power calculator 1908 is implemented in various embodiments as a root mean square (RMS) measurement, a power detector, an energy detector, etc. Long-term power calculator 1908 can be referred to synonymously as a long-time power calculator 1908. The long-term power calculator 1908 calculates approximately the running average long-term power in the filtered signal. The output 1909 of the long-term power calculator 1908 is input into a divider 1917. A control signal 1914 is input at 1916 to the long-term power calculator 1908. The control signal 1914 provides signals as described above in conjunction with the desired audio detector, e.g., FIG. 18A, FIG. 18B, FIG. 18C which indicate when desired audio is present and when desired audio is not present. Segments of the acoustic signals on the first channel 1902*b* which have desired audio present are excluded from the long-term power average produced at 1908.

Acoustic signals are input at 1904*b* into a voice-band filter 1910 of the second signal path 1905*b*. The voice band filter 1910 captures the majority of the desired voice energy in the second acoustic channel 1904*a*. In various embodiments, the voice band filter 1910 is a band-pass filter characterized by a lower corner frequency an upper corner frequency and a roll-off from the upper corner frequency. In various embodiments, the lower corner frequency can range from 50 to 300 Hz depending on the application. For example, in wide band telephony, a lower corner frequency is approximately 50 Hz. In standard telephony the lower corner frequency is approximately 300 Hz. The upper corner frequency is chosen to allow the filter to pass a majority of the speech energy picked up by a relatively flat portion of the microphone's frequency response. Thus, the upper corner frequency can be placed in a variety of locations depending on the application. A non-limiting example of one location is 2,500 Hz. Another non-limiting location for the upper corner frequency is 4,000 Hz.

The second signal path 1905*b* includes a long-term power calculator 1912. Long-term power calculator 1912 is implemented in various embodiments as a root mean square (RMS) measurement, a power detector, an energy detector, etc. Long-term power calculator 1912 can be referred to synonymously as a long-time power calculator 1912. The long-term power calculator 1912 calculates approximately the running average long-term power in the filtered signal. The output 1913 of the long-term power calculator 1912 is input into a divider 1917. A control signal 1914 is input at 1916 to the long-term power calculator 1912. The control signal 1916 provides signals as described above in conjunction with the desired audio detector, e.g., FIG. 18A, FIG. 18B, FIG. 18C which indicate when desired audio is present and when desired audio is not present. Segments of the acoustic signals on the second channel 1904*b* which have desired audio present are excluded from the long-term power average produced at 1912.

In one embodiment, the output 1909 is normalized at 1917 by the output 1913 to produce an amplitude correction signal 1918. In one embodiment, a divider is used at 1917. The amplitude correction signal 1918 is multiplied at multiplier 1920 times an instantaneous value of the second microphone signal on 1904*a* to produce a corrected second microphone signal at 1922.

In another embodiment, alternatively the output 1913 is normalized at 1917 by the output 1909 to produce an amplitude correction signal 1918. In one embodiment, a divider is used at 1917. The amplitude correction signal 1918 is multiplied by an instantaneous value of the first microphone signal on 1902*a* using a multiplier coupled to 1902*a* (not shown) to produce a corrected first microphone signal for the first microphone channel 1902*a*. Thus, in various embodiments, either the second microphone signal is automatically balanced relative to the first microphone signal or in the alternative the first microphone signal is automatically balanced relative to the second microphone signal.

It should be noted that the long-term averaged power calculated at 1908 and 1912 is performed when desired audio is absent. Therefore, the averaged power represents an average of the undesired audio which typically originates in the far field. In various embodiments, by way of non-limiting example, the duration of the long-term power calculator ranges from approximately a fraction of a second such as, for example, one-half second to five seconds to minutes in some embodiments and is application dependent.

Figure 19B:
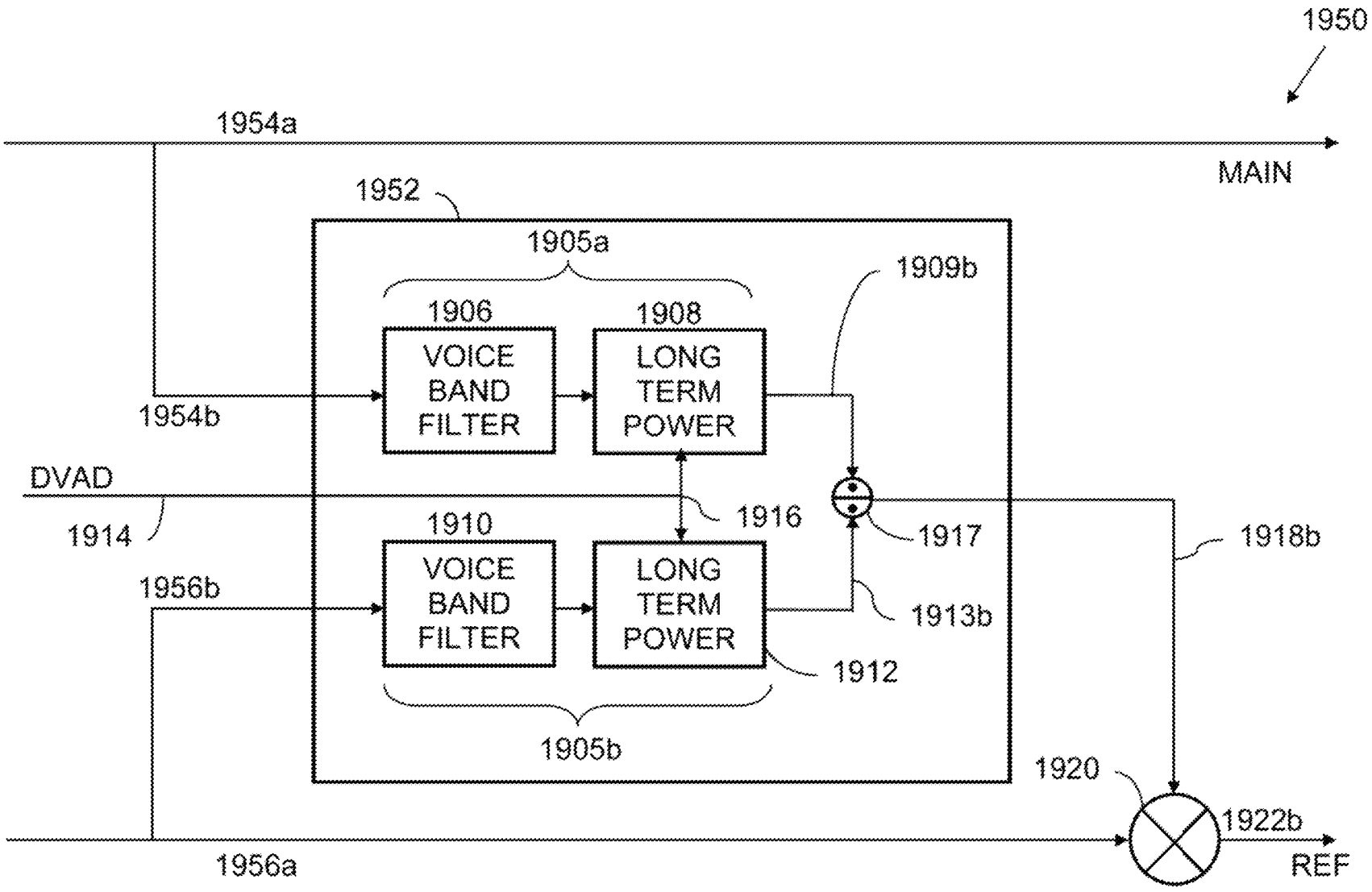
FIG. 19B illustrates auto-balancing according to embodiments of the invention.

FIG. 19B illustrates, generally at 1950, auto-balancing according to embodiments of the invention. With reference to FIG. 19B, an auto-balancing component 1952 is configured to receive as inputs a main acoustic channel 1954*a* and a reference acoustic channel 1956*a*. The balancing function proceeds similarly to the description provided above in conjunction with FIG. 19A using the first acoustic channel 1902*a* (MIC 1) and the second acoustic channel 1904*a* (MIC 2).

With reference to FIG. 19B, an auto-balancing component 1952 has a first signal path 1905*a* and a second signal path 1905*b*. A first acoustic channel 1954*a* (MAIN) is coupled to the first signal path 1905*a* at 1954*b*. A second acoustic channel 1956*a* is coupled to the second signal path 1905*b* at 1956*b*. Acoustic signals are input at 1954*b* into a voice-band filter 1906. The voice band filter 1906 captures the majority of the desired voice energy in the first acoustic channel 1954*a*. In various embodiments, the voice band filter 1906 is a band-pass filter characterized by a lower corner frequency an upper corner frequency and a roll-off from the upper corner frequency. In various embodiments, the lower corner frequency can range from 50 to 300 Hz depending on the application. For example, in wide band telephony, a lower corner frequency is approximately 50 Hz. In standard telephony the lower corner frequency is approximately 300 Hz. The upper corner frequency is chosen to allow the filter to pass a majority of the speech energy picked up by a relatively flat portion of the microphone's frequency response. Thus, the upper corner frequency can be placed in a variety of locations depending on the application. A non-limiting example of one location is 2,500 Hz. Another non-limiting location for the upper corner frequency is 4,000 Hz.

The first signal path 1905*a* includes a long-term power calculator 1908. Long-term power calculator 1908 is implemented in various embodiments as a root mean square (RMS) measurement, a power detector, an energy detector, etc. Long-term power calculator 1908 can be referred to synonymously as a long-time power calculator 1908. The long-term power calculator 1908 calculates approximately the running average long-term power in the filtered signal. The output 1909*b* of the long-term power calculator 1908 is input into a divider 1917. A control signal 1914 is input at 1916 to the long-term power calculator 1908. The control signal 1914 provides signals as described above in conjunction with the desired audio detector, e.g., FIG. 18A, FIG. 18B, FIG. 18C which indicate when desired audio is present and when desired audio is not present. Segments of the acoustic signals on the first channel 1954*b* which have desired audio present are excluded from the long-term power average produced at 1908.

Acoustic signals are input at 1956*b* into a voice-band filter 1910 of the second signal path 1905*b*. The voice band filter 1910 captures the majority of the desired voice energy in the second acoustic channel 1956*a*. In various embodiments, the voice band filter 1910 is a band-pass filter characterized by a lower corner frequency an upper corner frequency and a roll-off from the upper corner frequency. In various embodiments, the lower corner frequency can range from 50 to 300 Hz depending on the application. For example, in wide band telephony, a lower corner frequency is approximately 50 Hz. In standard telephony the lower corner frequency is approximately 300 Hz. The upper corner frequency is chosen to allow the filter to pass a majority of the speech energy picked up by a relatively flat portion of the microphone's frequency response. Thus, the upper corner frequency can be placed in a variety of locations depending on the application. A non-limiting example of one location is 2,500 Hz. Another non-limiting location for the upper corner frequency is 4,000 Hz.

The second signal path 1905*b* includes a long-term power calculator 1912. Long-term power calculator 1912 is implemented in various embodiments as a root mean square (RMS) measurement, a power detector, an energy detector, etc. Long-term power calculator 1912 can be referred to synonymously as a long-time power calculator 1912. The long-term power calculator 1912 calculates approximately the running average long-term power in the filtered signal. The output 1913*b* of the long-term power calculator 1912 is input into the divider 1917. A control signal 1914 is input at 1916 to the long-term power calculator 1912. The control signal 1916 provides signals as described above in conjunction with the desired audio detector, e.g., FIG. 18A, FIG. 18B, FIG. 18C which indicate when desired audio is present and when desired audio is not present. Segments of the acoustic signals on the second channel 1956*b* which have desired audio present are excluded from the long-term power average produced at 1912.

In one embodiment, the output 1909*b* is normalized at 1917 by the output 1913*b* to produce an amplitude correction signal 1918*b*. In one embodiment, a divider is used at 1917. The amplitude correction signal 1918*b* is multiplied at multiplier 1920 times an instantaneous value of the second microphone signal on 1956*a* to produce a corrected second microphone signal at 1922*b*.

In another embodiment, alternatively the output 1913*b* is normalized at 1917 by the output 1909*b* to produce an amplitude correction signal 1918*b*. In one embodiment, a divider is used at 1917. The amplitude correction signal 1918*b* is multiplied by an instantaneous value of the first microphone signal on 1954*a* using a multiplier coupled to 1954*a* (not shown) to produce a corrected first microphone signal for the first microphone channel 1954*a*. Thus, in various embodiments, either the second microphone signal is automatically balanced relative to the first microphone signal or in the alternative the first microphone signal is automatically balanced relative to the second microphone signal.

It should be noted that the long-term averaged power calculated at 1908 and 1912 is performed when desired audio is absent. Therefore, the averaged power represents an average of the undesired audio which typically originates in the far field. In various embodiments, by way of non-limiting example, the duration of the long-term power calculator ranges from approximately a fraction of a second such as, for example, one-half second to five seconds to minutes in some embodiments and is application dependent.

Embodiments of the auto-balancing component 1902 or 1952 are configured for auto-balancing a plurality of microphone channels such as is indicated in FIG. 14A. In such configurations, a plurality of channels (such as a plurality of reference channels) is balanced with respect to a main channel. Or a plurality of reference channels and a main channel are balanced with respect to a particular reference channel as described above in conjunction with FIG. 19A or FIG. 19B.

Figure 19C:
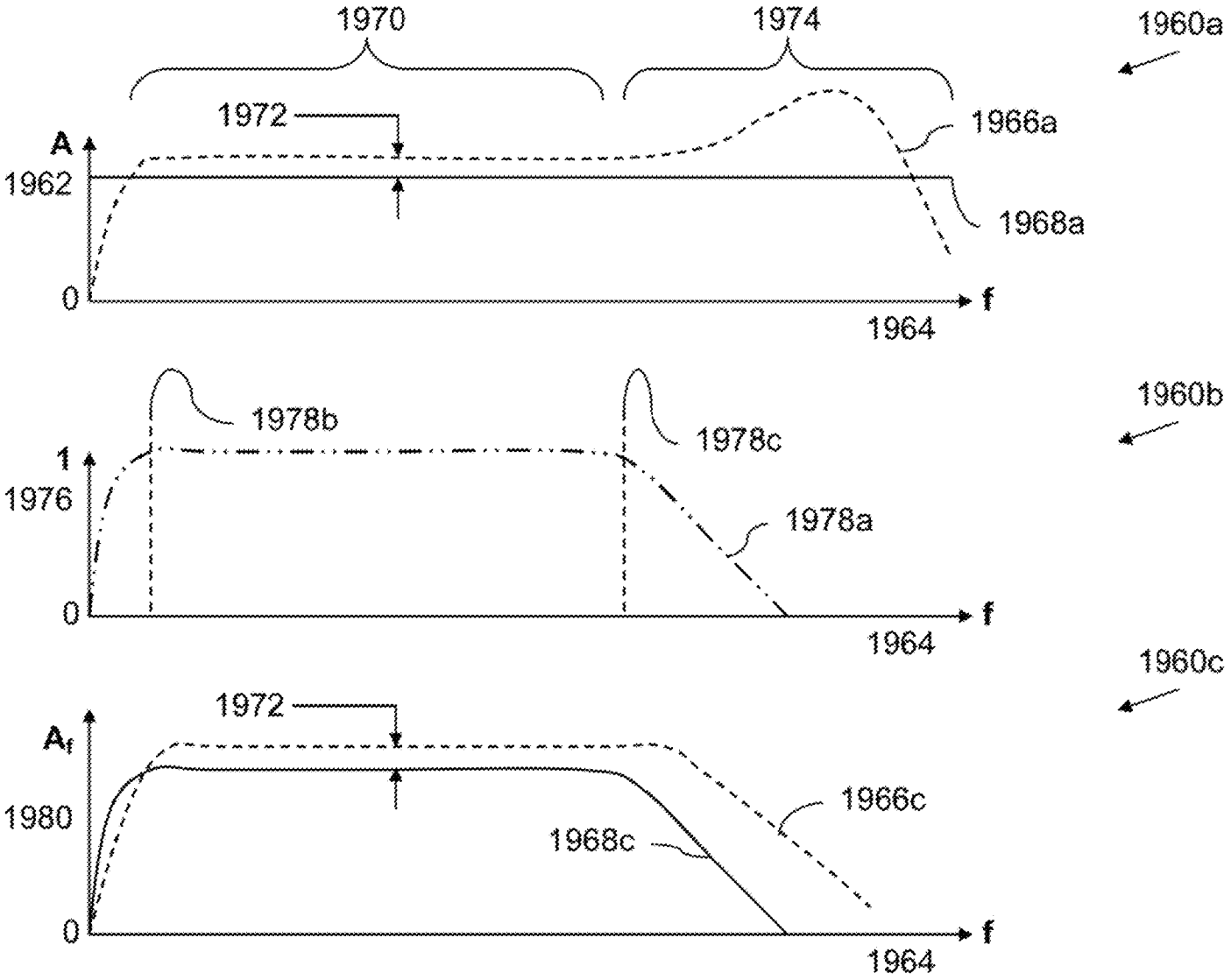
FIG. 19C illustrates filtering according to embodiments of the invention.

FIG. 19C illustrates filtering according to embodiments of the invention. With reference to FIG. 19C, 1960*a* shows two microphone signals 1966*a* and 1968*a* having amplitude 1962 plotted as a function of frequency 1964. In some embodiments, a microphone does not have a constant sensitivity as a function of frequency. For example, microphone response 1966*a* can illustrate a microphone output (response) with a non-flat frequency response excited by a broadband excitation which is flat in frequency. The microphone response 1966*a* includes a non-flat region 1974 and a flat region 1970. For this example, a microphone which produced the response 1968*a* has a uniform sensitivity with respect to frequency; therefore 1968*a* is substantially flat in response to the broadband excitation which is flat with frequency. In some embodiments, it is of interest to balance the flat region 1970 of the microphones' responses. In such a case, the non-flat region 1974 is filtered out so that the energy in the non-flat region 1974 does not influence the microphone auto-balancing procedure. What is of interest is a difference 1972 between the flat regions of the two microphones' responses.

In 1960*b* a filter function 1978*a* is shown plotted with an amplitude 1976 plotted as a function of frequency 1964. In various embodiments, the filter function is chosen to eliminate the non-flat portion 1974 of a microphone's response. Filter function 1978*a* is characterized by a lower corner frequency 1978*b* and an upper corner frequency 1978*c*. The filter function of 1960*b* is applied to the two microphone signals 1966*a* and 1968*a* and the result is shown in 1960*c*.

In 1960*c* filtered representations 1966*c* and 1968*c* of microphone signals 1966*a* and 1968*a* are plotted as a function of amplitude 1980 and frequency 1966. A difference 1972 characterizes the difference in sensitivity between the two filtered microphone signals 1966*c* and 1968*c*. It is this difference between the two microphone responses that is balanced by the systems described above in conjunction with FIG. 19A and FIG. 19B. Referring back to FIG. 19A and FIG. 19B, in various embodiments, voice band filters 1906 and 1910 can apply, in one non-limiting example, the filter function shown in 1960*b* to either microphone channels 1902*b* and 1904*b* (FIG. 19A) or to main and reference channels 1954*b* and 1956*b* (FIG. 19B). The difference 1972 between the two microphone channels is minimized or eliminated by the auto-balancing procedure described above in FIG. 19A or FIG. 19B.

Figure 20:
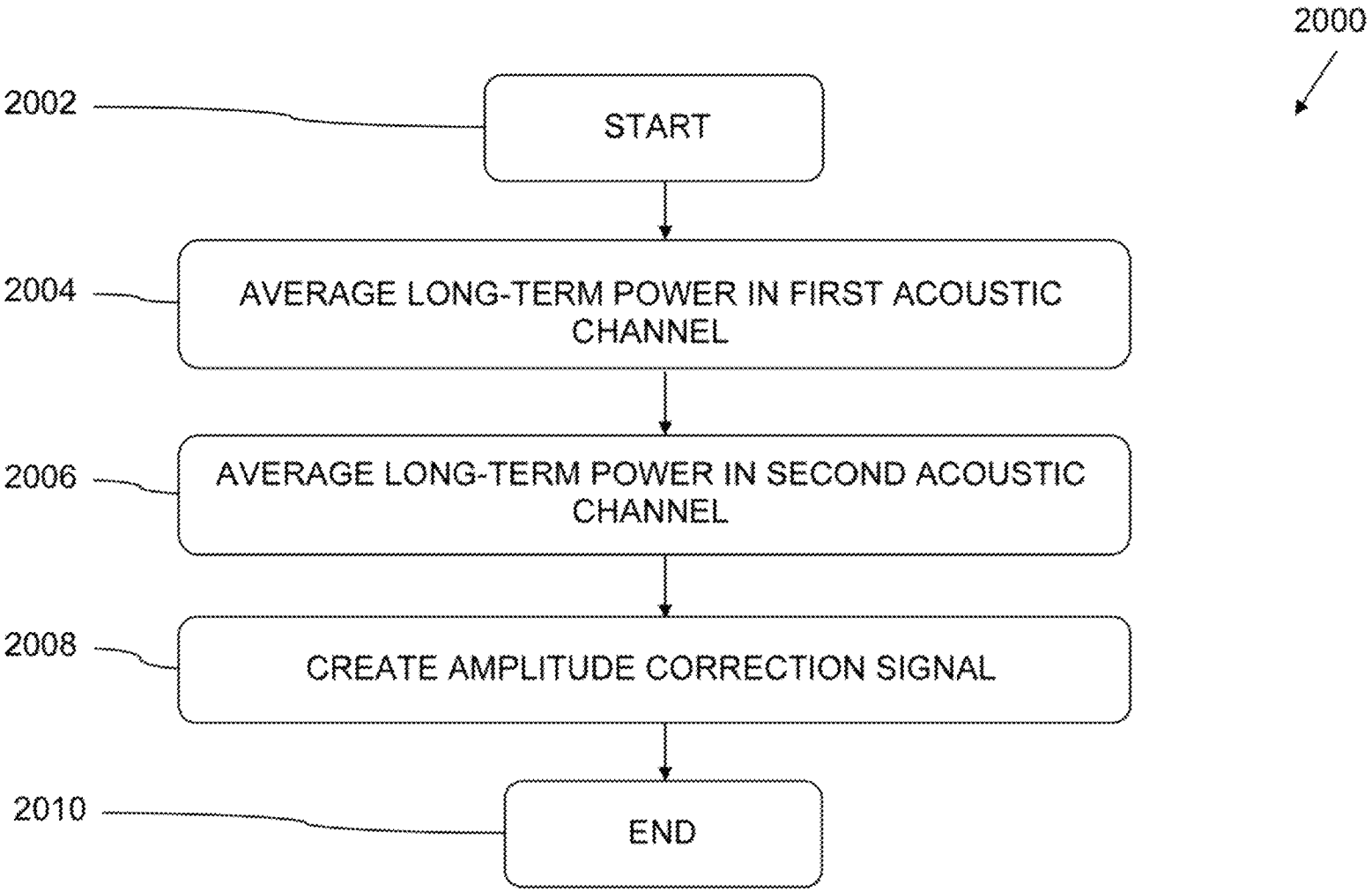
FIG. 20 illustrates a process for auto-balancing according to embodiments of the invention.

FIG. 20 illustrates, generally at 2000, a process for auto-balancing according to embodiments of the invention. With reference to FIG. 20, a process starts at a block 2002. At a block 2004 an average long-term power in a first microphone channel is calculated. The averaged long-term power calculated for the first microphone channel does not include segments of the microphone signal that occurred when desired audio was present. Input from a desired voice activity detector is used to exclude the relevant portions of desired audio. At a block 2006 an average power in a second microphone channel is calculated. The averaged long-term power calculated for the second microphone channel does not include segments of the microphone signal that occurred when desired audio was present. Input from a desired voice activity detector is used to exclude the relevant portions of desired audio. At a block 2008 an amplitude correction signal is computed using the averages computed in the block 2004 and the block 2006.

In various embodiments, the components of auto-balancing component 1903 or 1952 are implemented in an integrated circuit device, which may include an integrated circuit package containing the integrated circuit. In some embodiments, auto-balancing components 1903 or 1952 are implemented in a single integrated circuit die. In other embodiments, auto-balancing components 1903 or 1952 are implemented in more than one integrated circuit die of an integrated circuit device which may include a multi-chip package containing the integrated circuit.

Figure 21:
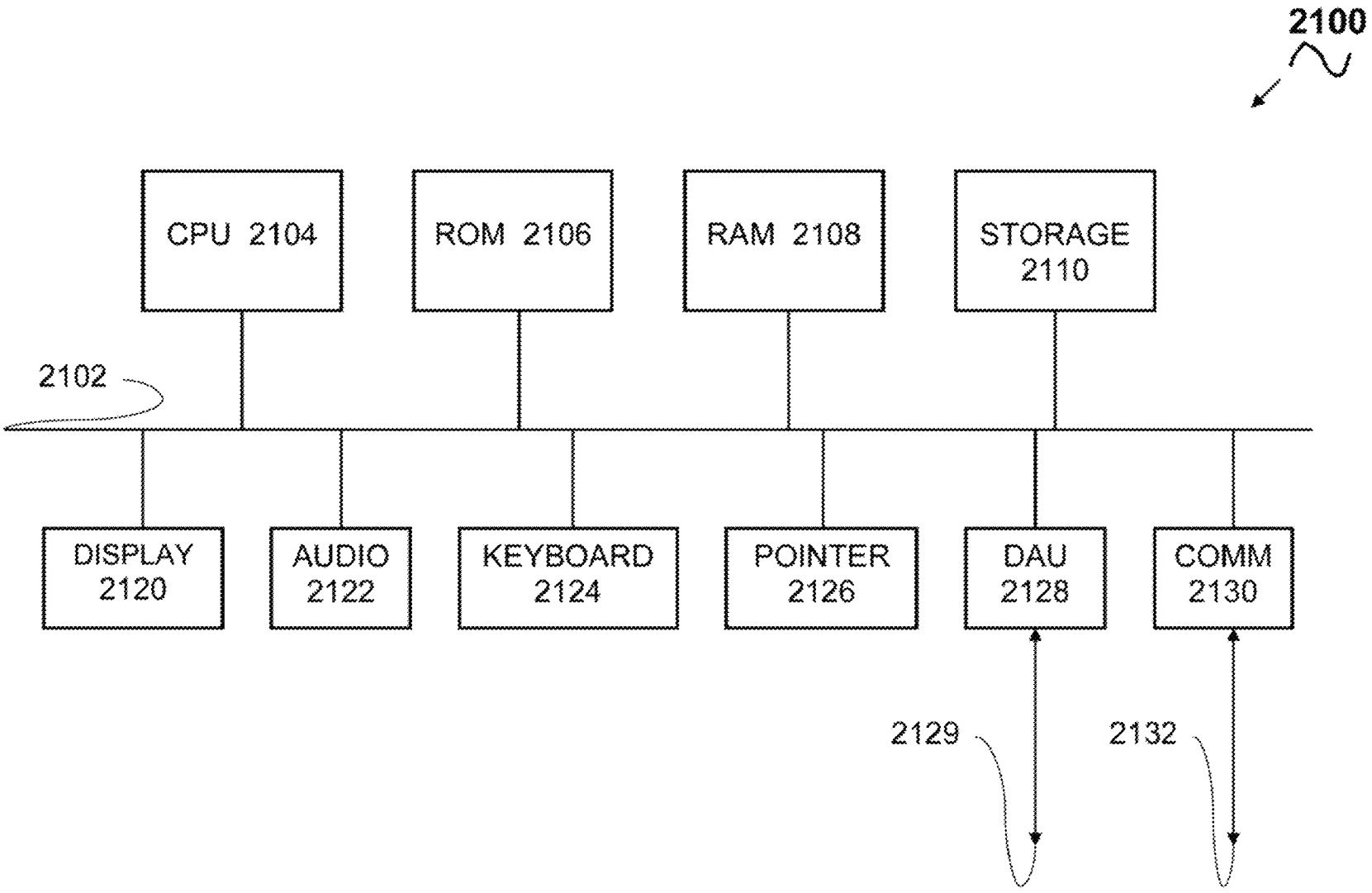
FIG. 21 illustrates an acoustic signal processing system according to embodiments of the invention.

FIG. 21 illustrates, generally at 2100, an acoustic signal processing system in which embodiments of the invention may be used. The block diagram is a high-level conceptual representation and may be implemented in a variety of ways and by various architectures. With reference to FIG. 21, bus system 2102 interconnects a Central Processing Unit (CPU) 2104, Read Only Memory (ROM) 2106, Random Access Memory (RAM) 2108, storage 2110, display 2120, audio 2122, keyboard 2124, pointer 2126, data acquisition unit (DAU) 2128, and communications 2130. The bus system 2102 may be for example, one or more of such buses as a system bus, Peripheral Component Interconnect (PCI), Advanced Graphics Port (AGP), Small Computer System Interface (SCSI), Institute of Electrical and Electronics Engineers (IEEE) standard number 1394 (FireWire), Universal Serial Bus (USB), or a dedicated bus designed for a custom application, etc. The CPU 2104 may be a single, multiple, or even a distributed computing resource or a digital signal processing (DSP) chip. Storage 2110 may be Compact Disc (CD), Digital Versatile Disk (DVD), hard disks (HD), optical disks, tape, flash, memory sticks, video recorders, etc. The acoustic signal processing system 2100 can be used to receive acoustic signals that are input from a plurality of microphones (e.g., a first microphone, a second microphone, etc.) or from a main acoustic channel and a plurality of reference acoustic channels as described above in conjunction with the preceding figures. Note that depending upon the actual implementation of the acoustic signal processing system, the acoustic signal processing system may include some, all, more, or a rearrangement of components in the block diagram. In some embodiments, aspects of the system 2100 are performed in software. While in some embodiments, aspects of the system 2100 are performed in dedicated hardware such as a digital signal processing (DSP) chip, etc. as well as combinations of dedicated hardware and software as is known and appreciated by those of ordinary skill in the art.

Thus, in various embodiments, acoustic signal data is received at 2129 for processing by the acoustic signal processing system 2100. Such data can be transmitted at 2132 via communications interface 2130 for further processing in a remote location. Connection with a network, such as an intranet or the Internet is obtained via 2132, as is recognized by those of skill in the art, which enables the acoustic signal processing system 2100 to communicate with other data processing devices or systems in remote locations.

For example, embodiments of the invention can be implemented on a computer system 2100 configured as a desktop computer or work station, on for example a WINDOWS® compatible computer running operating systems such as WINDOWS® XP Home or WINDOWS® XP Professional, Linux, Unix, etc. as well as computers from APPLE COMPUTER, Inc. running operating systems such as OS X, etc. Alternatively, or in conjunction with such an implementation, embodiments of the invention can be configured with devices such as speakers, earphones, video monitors, etc. configured for use with a BLUETOOTH communication channel. In yet other implementations, embodiments of the invention are configured to be implemented by mobile devices such as a smart phone, a tablet computer, a wearable device, such as eye glasses, a near-to-eye (NTE) headset, a wrist wearable device including but not limited to a wristband, a watch, a bracelet, etc. or the like.

For purposes of discussing and understanding the embodiments of the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

Some portions of the description may be presented in terms of algorithms and symbolic representations of operations on, for example, data bits within a computer memory. These algorithmic descriptions and representations are the means used by those of ordinary skill in the data processing arts to most effectively convey the substance of their work to others of ordinary skill in the art. An algorithm is here, and generally, conceived to be a self-consistent sequence of acts leading to a desired result. The acts are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, waveforms, data, time series or the like.

It should be borne in mind, however, that all of these and similar terms are to be associated with the appropriate physical quantities and are merely convenient labels applied to these quantities. Unless specifically stated otherwise as apparent from the discussion, it is appreciated that throughout the description, discussions utilizing terms such as "processing" or "computing" or "calculating" or "determining" or "displaying" or the like, can refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

An apparatus for performing the operations herein can implement the present invention. This apparatus may be specially constructed for the required purposes, or it may comprise a general-purpose computer, selectively activated or reconfigured by a computer program stored in the computer. Such a computer program may be stored in a computer readable storage medium, such as, but not limited to, any type of disk including floppy disks, hard disks, optical disks, compact disk read-only memories (CD-ROMs), and magnetic-optical disks, read-only memories (ROMs), random access memories (RAMs), electrically programmable read-only memories (EPROM)s, electrically erasable programmable read-only memories (EEPROMs), FLASH memories, magnetic or optical cards, etc., or any type of media suitable for storing electronic instructions either local to the computer or remote to the computer.

The algorithms and displays presented herein are not inherently related to any particular computer or other apparatus. Various general-purpose systems may be used with programs in accordance with the teachings herein, or it may prove convenient to construct more specialized apparatus to perform the required method. For example, any of the methods according to the present invention can be implemented in hard-wired circuitry, by programming a general-purpose processor, or by any combination of hardware and software. One of ordinary skill in the art will immediately appreciate that the invention can be practiced with computer system configurations other than those described, including hand-held devices, multiprocessor systems, microprocessor-based or programmable consumer electronics, digital signal processing (DSP) devices, network PCs, minicomputers, mainframe computers, and the like. The invention can also be practiced in distributed computing environments where tasks are performed by remote processing devices that are linked through a communications network. In other examples, embodiments of the invention as described above in Figure through FIG. 21 can be implemented using a system on a chip (SOC), a BLUETOOTH chip, a digital signal processing (DSP) chip, a codec with integrated circuits (ICs) or in other implementations of hardware and software.

The methods of the invention may be implemented using computer software. If written in a programming language conforming to a recognized standard, sequences of instructions designed to implement the methods can be compiled for execution on a variety of hardware platforms and for interface to a variety of operating systems. In addition, the present invention is not described with reference to any particular programming language. It will be appreciated that a variety of programming languages may be used to implement the teachings of the invention as described herein. Furthermore, it is common in the art to speak of software, in one form or another (e.g., program, procedure, application, driver, . . . ), as taking an action or causing a result. Such expressions are merely a shorthand way of saying that execution of the software by a computer causes the processor of the computer to perform an action or produce a result.

It is to be understood that various terms and techniques are used by those knowledgeable in the art to describe communications, protocols, applications, implementations, mechanisms, etc. One such technique is the description of an implementation of a technique in terms of an algorithm or mathematical expression. That is, while the technique may be, for example, implemented as executing code on a computer, the expression of that technique may be more aptly and succinctly conveyed and communicated as a formula, algorithm, mathematical expression, flow diagram or flow chart. Thus, one of ordinary skill in the art would recognize a block denoting A+B=C as an additive function whose implementation in hardware and/or software would take two inputs (A and B) and produce a summation output (C). Thus, the use of formula, algorithm, or mathematical expression as descriptions is to be understood as having a physical embodiment in at least hardware and/or software (such as a computer system in which the techniques of the present invention may be practiced as well as implemented as an embodiment).

Non-transitory machine-readable media is understood to include any mechanism for storing information in a form readable by a machine (e.g., a computer). For example, a machine-readable medium, synonymously referred to as a computer-readable medium, includes read only memory (ROM); random access memory (RAM); magnetic disk storage media; optical storage media; flash memory devices; except electrical, optical, acoustical or other forms of transmitting information via propagated signals (e.g., carrier waves, infrared signals, digital signals, etc.); etc.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

Thus, embodiments of the invention can be used to reduce or eliminate undesired audio from acoustic systems that process and deliver desired audio. Some non-limiting examples of systems are, but are not limited to, use in short boom headsets, such as an audio headset for telephony suitable for enterprise call centers, industrial and general mobile usage, an in-line "ear buds" headset with an input line (wire, cable, or other connector), mounted on or within the frame of eyeglasses, a near-to-eye (NTE) headset display or headset computing device, a long boom headset for very noisy environments such as industrial, military, and aviation applications as well as a gooseneck desktop-style microphone which can be used to provide theater or symphony-hall type quality acoustics without the structural costs. Other embodiments of the invention are readily implemented in wrist wearable devices such as a wristband, a watch, a bracelet or the like.

While the invention has been described in terms of several embodiments, those of skill in the art will recognize that the invention is not limited to the embodiments described, but can be practiced with modification and alteration within the spirit and scope of the appended claims. The description is thus to be regarded as illustrative instead of limiting.

What is claimed is:

1. An apparatus to be worn on a user's wrist, comprising:

a wrist wearable device, the wrist wearable device is configured to be worn on the user's wrist, the wrist wearable device having a plurality of receive orientations;

a first microphone, the first microphone has a first response pattern, the first microphone is coupled to the wrist wearable device, the first microphone is positioned on the wrist wearable device to receive a voice signal from a user when the wrist wearable device is on the user's wrist;

a second microphone, the second microphone is coupled to the wrist wearable device, the second microphone and the first microphone are separated by a distance on the wrist wearable device such that a first distance between the first microphone and the user's mouth is less than a second distance between the second microphone and the user's mouth when the wrist wearable device is in a first receive orientation; and logic, the logic is configured to:

a. determine a receive orientation of the wrist wearable device by comparing a first signal-to-noise ratio of the first microphone and a second signal-to-noise ratio of the second microphone; and b. select a main microphone and a reference microphone for the receive orientation.

2. The apparatus of claim 1, further comprising:

a wireless communication system, the wireless communication system is coupled to the wrist wearable device and to the first microphone.

3. The apparatus of claim 2, wherein the wireless communication system is compatible with the BLUETOOTH communication protocol.

4. The apparatus of claim 2, further comprising:

an adaptive noise cancellation unit, the adaptive noise cancellation unit to receive a main signal from the main microphone and a reference signal from the reference microphone, the main signal has a main signal-to-noise ratio, the reference signal has a reference signal-to-noise ratio, wherein the reference signal-to-noise ratio is less than the main signal-to-noise-ratio, the adaptive noise cancellation unit reduces undesired audio from the main signal;

a single channel noise cancellation unit, an output signal from the adaptive noise cancellation unit is input to the single channel noise cancellation unit, the single channel noise cancellation unit further reduces undesired audio from the output signal to provide mostly desired audio; and a filter control, the filter control to create a control signal from a normalized main signal, wherein the apparatus normalizes the main signal by the reference signal, the control signal to control filtering in the adaptive noise cancellation unit and to control filtering in the single channel noise cancellation unit.

5. The apparatus of claim 4, further comprising:

a beamformer, the beamformer is configured to receive a first signal from the first microphone and a second signal from the second microphone and to provide a main signal on a main channel and at least one reference signal on at least one reference channel to the adaptive noise cancellation unit and to the filter control.

6. The apparatus of claim 4, wherein the wrist wearable device is selected from the group consisting of a wristband, a watch, a bracelet, and a user defined wrist wearable device.

7. The apparatus of claim 4, wherein at least one of the adaptive noise cancellation unit, the single channel noise cancellation unit, and the filter control are part of an integrated circuit and the integrated circuit is coupled to the wrist wearable device.

8. The apparatus of claim 4, wherein the adaptive noise cancellation unit, the single channel noise cancellation unit, and the filter control are part of an integrated circuit and the integrated circuit is coupled to the wrist wearable device.

9. The apparatus of claim 2, wherein the first microphone and the second microphone have substantially omni directional response patterns.

10. The apparatus of claim 9, wherein a first location for the first microphone and a second location for the second microphone provide a signal-to-noise ratio difference.

11. The apparatus of claim 10, wherein the signal-to-noise ratio difference is selected from the group consisting of a value of a curve illustrated in FIG. 6, and a value specified for a system.

12. The apparatus of claim 1, further comprising:

a second microphone, the second microphone has a second response pattern and a second response pattern main sensitivity axis, the second response pattern is different from the first response pattern and the second response pattern main sensitivity axis is misaligned with a direction of desired audio, wherein a signal-to-noise ratio difference between the first microphone and the second microphone is enhanced by the misalignment.

13. The apparatus of claim 12, wherein the first response pattern is omni-directional and the second response pattern is cardioid.

14. The apparatus of claim 12, wherein the first response pattern is selected from the group consisting of omni-directional, cardioid, bidirectional, super cardioid, hyper cardioid, and user defined, and the second response pattern is selected from the group consisting of omni-directional, cardioid, bidirectional, super cardioid, hyper cardioid, and user defined.

15. The apparatus of claim 12, further comprising:

an adaptive noise cancellation unit, the adaptive noise cancellation unit to receive a main signal from the first microphone and a reference signal from the second microphone, the main signal has a main signal-to-noise ratio, the reference signal has a reference signal-to-noise ratio, wherein the reference signal-to-noise ratio is less than the main signal-to-noise-ratio, the adaptive noise cancellation unit reduces undesired audio from the main signal;

a single channel noise cancellation unit, an output signal from the adaptive noise cancellation unit is input to the single channel noise cancellation unit, the single channel noise cancellation unit further reduces undesired audio from the output signal to provide mostly desired audio; and a filter control, the filter control to create a control signal from a normalized main signal, wherein the apparatus normalizes the main signal by the reference signal, the control signal to control filtering in the adaptive noise cancellation unit and to control filtering in the single channel noise cancellation unit.

16. The apparatus of claim 12, wherein the second microphone is positioned on the wrist wearable device at substantially any location.

17. The apparatus of claim 16, wherein the first microphone and the second microphone are substantially co-located.

18. The apparatus of claim 1, further comprising:

a second microphone; and a beamformer, the beamformer is configured to receive a first signal from the first microphone and a second signal from the second microphone and to output a main signal on a main channel and at least one reference signal on at least one reference channel.

19. The apparatus of claim 18, further comprising:

a third microphone, the third microphone is input into the beamformer, the beamformer configured to output a main signal and two reference signals.

20. An apparatus to be worn on a user's wrist, comprising:

a wrist wearable device, the wrist wearable device is configured to be worn on the user's wrist;

a plurality of microphones, at least a first microphone and a second microphone of the plurality are separated by a distance on the wrist wearable device such that a distance between the first microphone and the user's mouth is less than a distance between the second microphone and the user's mouth when the wrist wearable device is in a receive orientation;

logic, the logic is configured to determine a current receive orientation of the wrist wearable device and to select a main microphone and a reference microphone from the plurality based on the current receive orientation;

a beamformer, the beamformer is configured to receive input signals from at least the first microphone and the second microphone and to provide a main signal on a main channel and at least one reference signal on at least one reference channel;

an adaptive noise cancellation unit, the adaptive noise cancellation unit receives the main signal and the at least one reference signal from the beamformer, the adaptive noise cancellation unit reduces a first amount of undesired audio from the main signal to form a filtered output signal;

a filter control, the filter control is coupled to the beamformer, the filter control creates a control signal from the main signal and the at least one reference signal to control reduction of undesired audio; and a single channel noise reduction unit, the single channel noise reduction unit receives the filtered output signal and is coupled to the filter control, the single channel noise reduction unit reduces a second amount of undesired audio from the filtered output signal to provide mostly desired audio in the main signal.

21. The apparatus of claim 20, wherein a first location for the first microphone and a second location for the second microphone provide a signal-to-noise ratio difference.

22. The apparatus of claim 21, wherein the signal-to-noise ratio difference is selected from the group consisting of a value of a curve illustrated in FIG. 6, and a value specified for a system.

23. The apparatus of claim 20, wherein the logic is configured to update the current receive orientation to an updated current receive orientation of the wrist wearable device and to select at least one of a new main microphone and a new reference microphone from the plurality, based on the updated current receive orientation.

24. An apparatus to be worn on a user's wrist, comprising:

a wrist wearable device;

a data processing system, the data processing system is configured to process acoustic signals and the data processing system is contained within the wrist wearable device; and a computer readable medium containing executable computer program instructions, which when executed by the data processing system, cause the data processing system to perform a method comprising:

determining a current receive orientation for the wrist wearable device;

selecting a main microphone channel and a reference microphone channel from a plurality of microphone channels based on the current receive orientation;

receiving a main signal and a reference signal;

producing a filter control signal from the main signal and the reference signal, wherein the apparatus normalizes the main signal by the reference signal during the producing;

applying a first stage of filtering with the main signal and the reference signal input to a multi-channel filter to create a first reduction in undesired audio from the main signal, wherein the apparatus uses the filter control signal is used to separate desired audio from undesired audio during the applying; and applying a second stage of filtering to an output of the first stage to create a second reduction in undesired audio from the main signal, the apparatus uses the filter control signal to separate desired audio from undesired audio in the second stage, the second stage outputs a main signal which is mostly desired audio.

25. The apparatus of claim 24, wherein in the method performed by the data processing system, the applying the first stage further comprising:

controlling adaptation of the multi-channel filter with the control signal, wherein the control signal utilizes a combination of the main signal and the reference signal.

26. The apparatus of claim 24, wherein in the method performed by the data processing system, the method further comprising:

beamforming with signals from a number of microphone channels to create the main signal and the reference signal.

27. The apparatus of claim 26, wherein a first microphone is positioned on the wrist wearable device to receive a voice signal from the user and a second microphone is positioned on the wrist wearable device at substantially any location.

28. The apparatus of claim 26, wherein a second microphone and a first microphone are separated by a distance on the wrist wearable device such that a first distance between the first microphone and the user's mouth is less than a second distance between the second microphone and the user's mouth when the wrist wearable device is in a receive orientation.

29. The apparatus of claim 24, wherein a second microphone has a response pattern and a response pattern main sensitivity axis, a first microphone has a response pattern and the second microphone response pattern is different from the first microphone response pattern and the second microphone response pattern main sensitivity axis is misaligned with a direction of desired audio, wherein a signal-to-noise ratio difference between the first microphone and the second microphone is enhanced by the misalignment.

30. The apparatus of claim 29, wherein the first response pattern is omni-directional and the second response pattern is cardioid.

31. The apparatus of claim 29, wherein the first response pattern is selected from the group consisting of omni-directional, cardioid, bidirectional, super cardioid, hyper cardioid, and user defined, and the second response pattern is selected from the group consisting of omni-directional, cardioid, bidirectional, super cardioid, hyper cardioid, and user defined.

32. The apparatus of claim 24, wherein the method further comprising:

updating the current receive orientation and selecting at least one of a new main microphone and a new reference microphone based on the updating.

* * * * *